US012385677B2

(12) United States Patent
Min et al.

(10) Patent No.: US 12,385,677 B2
(45) Date of Patent: Aug. 12, 2025

(54) REFRIGERATOR AND METHOD FOR CONTROLLING THE SAME

(71) Applicant: SAMSUNG ELECTRONICS CO., LTD., Suwon-si (KR)

(72) Inventors: Seulki Min, Suwon-si (KR); Heemoon Jeong, Suwon-si (KR); Gaeul Cho, Suwon-si (KR); Kookjeong Seo, Suwon-si (KR); Insub Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 162 days.

(21) Appl. No.: 18/230,961

(22) Filed: Aug. 7, 2023

(65) Prior Publication Data

US 2024/0125525 A1 Apr. 18, 2024

Related U.S. Application Data

(63) Continuation of application No. PCT/KR2023/010670, filed on Jul. 24, 2023.

(30) Foreign Application Priority Data

Oct. 12, 2022 (KR) ..... 10-2022-0130972

(51) Int. Cl.
*F25D 21/04* (2006.01)
*F25B 5/02* (2006.01)
(Continued)

(52) U.S. Cl.
CPC ..... *F25B 41/20* (2021.01); *F25B 5/02* (2013.01); *F25B 41/37* (2021.01); *F25D 21/04* (2013.01);
(Continued)

(58) Field of Classification Search
CPC .. F25B 5/02; F25B 41/20; F25B 41/37; F25D 11/22; F25D 21/04
See application file for complete search history.

(56) References Cited

U.S. PATENT DOCUMENTS 8,738,040 B2 5/2014 Pérez Lafuente
8,934,922 B2 1/2015 Perez Lafuente
(Continued)

FOREIGN PATENT DOCUMENTS

EP 2 339 276 B1 3/2019
JP 2014-211181 11/2014
(Continued)

OTHER PUBLICATIONS

International Search Report dated Nov. 20, 2023 issued in PCT Application No.
(Continued)

*Primary Examiner* — Jonathan Bradford
(74) *Attorney, Agent, or Firm* — STAAS & HALSEY LLP

(57) ABSTRACT

A refrigerator includes: a compressor; a condenser; a hot pipe; at least one capillary tube; at least one evaporator; a valve device including: an input port connected to the condenser; a first port connected to one end of the hot pipe; a second port connected to an other end; and at least one output port connected to the at least one capillary tube; and a controller configured to: control the valve device to operate in the first mode by connecting one of the first port and the second port to the input port and connecting an other one to the output port; control the valve device to operate in the second mode, by closing one of the first port and the second port and connecting an other one to the output port; and control the valve device to operate in the third mode, by closing all the first port and the second port.

15 Claims, 35 Drawing Sheets

(51) Int. Cl.

| | |
|---|---|
| ***F25B 41/20*** | (2021.01) |
| ***F25B 41/37*** | (2021.01) |
| ***F25D 11/02*** | (2006.01) |

(52) U.S. Cl.
CPC ..... *F25B 2500/24* (2013.01); *F25B 2500/26* (2013.01); *F25B 2600/0253* (2013.01); *F25B 2600/2511* (2013.01); *F25B 2700/02* (2013.01); *F25B 2700/2106* (2013.01); *F25D 11/022* (2013.01); *F25D 2700/14* (2013.01)

(56) References Cited

U.S. PATENT DOCUMENTS

| | | | | |
|---|---|---|---|---|
| 9,057,550 | B2 | 6/2015 | Bae et al. | |
| 9,816,741 | B2 | 11/2017 | Lee et al. | |
| 10,746,445 | B2 | 8/2020 | Kim | |
| 2009/0113923 | A1 | 5/2009 | Young | |
| 2013/0192285 | A1* | 8/2013 | Bae | F25B 6/04 62/196.4 |
| 2022/0163244 | A1 | 5/2022 | Bae et al. | |
| 2023/0097656 | A1 | 3/2023 | Min et al. | |

FOREIGN PATENT DOCUMENTS

| | | |
|---|---|---|
| JP | 2020-91045 | 6/2020 |
| JP | 6934603 | 9/2021 |
| KR | 10-0366449 | 12/2002 |
| KR | 10-2004-0077032 | 9/2004 |
| KR | 10-2009-0046251 | 5/2009 |
| KR | 10-2014-0144020 | 12/2014 |
| KR | 10-1622727 | 5/2016 |
| KR | 10-1942526 | 1/2019 |
| KR | 10-2211202 | 2/2021 |
| KR | 10-2237596 | 4/2021 |
| KR | 10-2255294 | 5/2021 |
| KR | 10-2022-0073490 | 6/2022 |
| KR | 10-2407651 | 6/2022 |
| KR | 10-2023-0046579 | 4/2023 |

OTHER PUBLICATIONS

Written Opinion dated Nov. 20, 2023 issued in PCT Application No.

* cited by examiner

REFRIGERATOR AND METHOD FOR CONTROLLING THE SAME

CROSS-REFERENCE TO RELATED APPLICATION(S)

This application is a continuation application, under 35 U.S.C. § 111(a), of international application No. PCT/KR2023/010670, filed on Jul. 24, 2023, which claims priority to Korean Patent Application No. 10-2022-0130972, filed on Oct. 12, 2022, in the Korean Intellectual Property Office, the disclosures of which are incorporated by reference herein in their entireties.

BACKGROUND

1. Field

The disclosure relates to a refrigerator equipped with a cold air supplier and method for controlling the refrigerator.

2. Description of Related Art

A refrigerator employing a common cooling cycle by which a refrigerant is circulated therein is to keep various food items fresh for a long time by supplying cold air into food storage chambers, the cold air generated as the refrigerant in a liquid state absorbs surrounding heat while being evaporated. Of the food storage chambers, a freezer is maintained at a temperature of about minus 20 degrees and a fridge is maintained at a low temperature of about minus 3 degrees.

The refrigerant circulating through the refrigerator in the cooling cycle may have different cooling levels according to the surrounding temperature. For example, when the surrounding temperature is low, the refrigerant is supercooled and concentrated in the condenser, causing shortage of refrigerant on the side of the evaporator.

A way to solve the shortage of refrigerant by increasing the number of revolutions of the compressor to increase pressure in the cooling cycle not only increases noise of the refrigerator but also increases the whole power consumption.

SUMMARY

A refrigerator may comprise a compressor having an inlet and an outlet; a condenser having an inlet and an outlet, the inlet of the condenser connected to the outlet of the compressor; a hot pipe; at least one capillary tube; at least one evaporator connected to the at least one capillary tube and the inlet of the compressor; a valve device including: an input port connected to the outlet of the condenser; a first port connected to one end of the hot pipe; a second port connected to an other end of the hot pipe; and at least one output port connected to the at least one capillary tube; and a controller configured to: control the valve device to operate in a first mode, a second mode, and a third mode during an operation of the compressor, control the valve device to operate in the first mode by connecting one of the first port and the second port to the input port and connecting an other one of the first port and the second port to the output port; control the valve device to operate in the second mode, by closing one of the first port and the second port and connecting an other one of the first port and the second port to the output port; and control the valve device to operate in the third mode, by closing all the first port and the second port.

The controller may be configured to control the valve device to operate in an order of the first mode, the second mode, and the third mode or in an order of the second mode, the third mode, and the first mode.

The refrigerator may further comprise a plurality of sensors to detect outside temperature and outside humidity, and wherein the controller is configured to determine a duration of the first mode based on at least one of the detected outside temperature or the detected outside humidity.

The controller may be configured to control the valve device to close the output port based on the compressor being turned off.

The controller may operate the valve device in the first mode based on the start of operation of the compressor.

The controller may operate the valve device in the second mode based on the start of operation of the compressor.

A refrigerant flowing into the input port may pass through the hot pipe, and is discharged to the at least one evaporator in the first mode, a refrigerant left in the hot pipe is collected to the at least one evaporator in the second mode, and a refrigerant flowing into the input port bypasses the hot pipe, and is discharged to the at least one evaporator in the third mode.

The controller may be configured to control a frequency of the compressor to a first value based on the valve device being operating in the first mode and control the frequency of the compressor to a second value lower than the first value based on the valve device being operating in the third mode.

The controller may be configured to: control the valve device to switch from the first mode to the second mode based on a termination condition of the first mode being satisfied; control the valve device to switch from the second mode to the third mode based on a termination condition of the second mode being satisfied, and control the valve device to switch from the third mode to the first mode based on a termination condition of the third mode being satisfied, during the operation of the compressor.

The controller may be configured to control the valve device to operate in the second mode after an operation in the first mode and before an operation in the third mode.

The controller may be configured to control the valve device to operate in the second mode after an operation in the first mode and before an operation in the third mode.

The at least one capillary tube may comprise a first capillary tube and a second capillary tube; the at least one output port comprises a first output port connected to the first capillary tube and a second output port connected to the second capillary tube; and the controller is configured to control the valve device such that the first port is connected to the first output port and the second port is connected to the input port in the first mode based on the refrigerator being operating in a fridge mode, and control the valve device such that the second port is connected to the second output port and the first port is connected to the input port in the first mode based on the refrigerator being operating in a freezer mode.

The at least one capillary tube comprises a first capillary tube and a second capillary tube; the at least one output port comprises a first output port connected to the first capillary tube and a second output port connected to the second capillary tube; and the controller is configured to: control the valve device such that the first port is closed and the second port is connected to the second output port in the second mode based on the refrigerator being operating in a fridge mode, and control the valve device such that the second port is closed and the first port is connected to the first output port in the second mode based on the refrigerator being operating in a freezer mode.

The controller may be configured to control the valve device such that the input port is connected to the first output port in the second mode based on the refrigerator being operating in the fridge mode, and control the valve device such that the input port is connected to the second output port in the second mode based on the refrigerator being operating in the freezer mode.

At least one capillary tube may comprise a first capillary tube and a second capillary tube; the at least one output port comprises a first output port connected to the first capillary tube and a second output port connected to the second capillary tube; and the controller is configured to: control the valve device such that the input port is connected to the first output port in the third mode based on the refrigerator being operating in a fridge mode; and control the valve device such that the input port is connected to the second output port in the third mode based on the refrigerator being operating in a freezer mode.

A method of controlling a refrigerator may include a valve device including an input port connected to a condenser, a first port connected to one end of a hot pipe, a second port connected to an other end of the hot pipe, and at least one output port connected to at least one capillary tube, the method comprising: controlling the valve device to operate in a first mode, a second mode and a third mode during an operation of a compressor; controlling the valve device to operate in the first mode to connect one of the first port and the second port to the input port and connect an other one of the first port and the second port to the output port; controlling the valve device to operate in the second mode to close one of the first port and the second port and connect an other one of the first port and the second port to the output port; and controlling the valve device to operate in the third mode to close all the first port and the second port.

The controlling of the valve device to operate in the first mode, the second mode, and the third mode during an operation of the compressor may comprise controlling the valve device to operate in an order of the first mode, the second mode and the third mode or in an order of the second mode, the third mode and the first mode.

The method may further include determining duration of the first mode based on at least one of outside temperature or outside humidity.

The method may further include controlling the valve device to close the output port based on the compressor being off.

The method may further include operating the valve device in the first mode based on the start of operation of the compressor.

The method may further include operating the valve device in the second mode based on the start of operation of the compressor.

The method may further include controlling frequency of the compressor to a first value based on the valve device operating in the first mode and controlling the frequency of the compressor to a second value lower than the first value based on the valve device operating in the third mode.

The method may further include switching the valve device from the first mode to the second mode based on a termination condition of the first mode satisfied, switching the valve device from the second mode to the third mode based on a termination condition of the second mode satisfied, and switching the valve device from the third mode to the first mode based on a termination condition of the third mode satisfied, during operation of the compressor.

The controlling of the valve device such that one of the first port and the second port is connected to the input port and the other is connected to the output port in the first mode may include controlling the valve device such that the first port is connected to the first output port and the second port is connected to the input port in the first mode based on the refrigerator operating in a fridge mode, and controlling the valve device such that the second port is connected to the second output port and the first port is connected to the input port in the first mode based on the refrigerator operating in a freezer mode.

The controlling of the valve device such that one of the first port and the second port is closed and the other is connected to the output port in the second mode may include controlling the valve device such that the first port is closed and the second port is connected to the second output port in the second mode based on the refrigerator operating in a fridge mode, and controlling the valve device such that the second port is closed and the first port is connected to the first output port in the second mode based on the refrigerator operating in a freezer mode.

The controlling of the valve device such that one of the first port and the second port is closed and the other is connected to the output port may include controlling the valve device such that the input port is connected to the first output port in the second mode based on the refrigerator operating in a fridge mode, and controlling the valve device such that the input port is connected to the second output port in the second mode based on the refrigerator operating in a freezer mode.

The method may further include controlling the valve device such that the input port is connected to the first output port in the third mode based on the refrigerator operating in a fridge mode, and control the valve device such that the input port is connected to the second output port in the third mode based on the refrigerator operating in a freezer mode.

DETAILED DESCRIPTION

Figure 1:
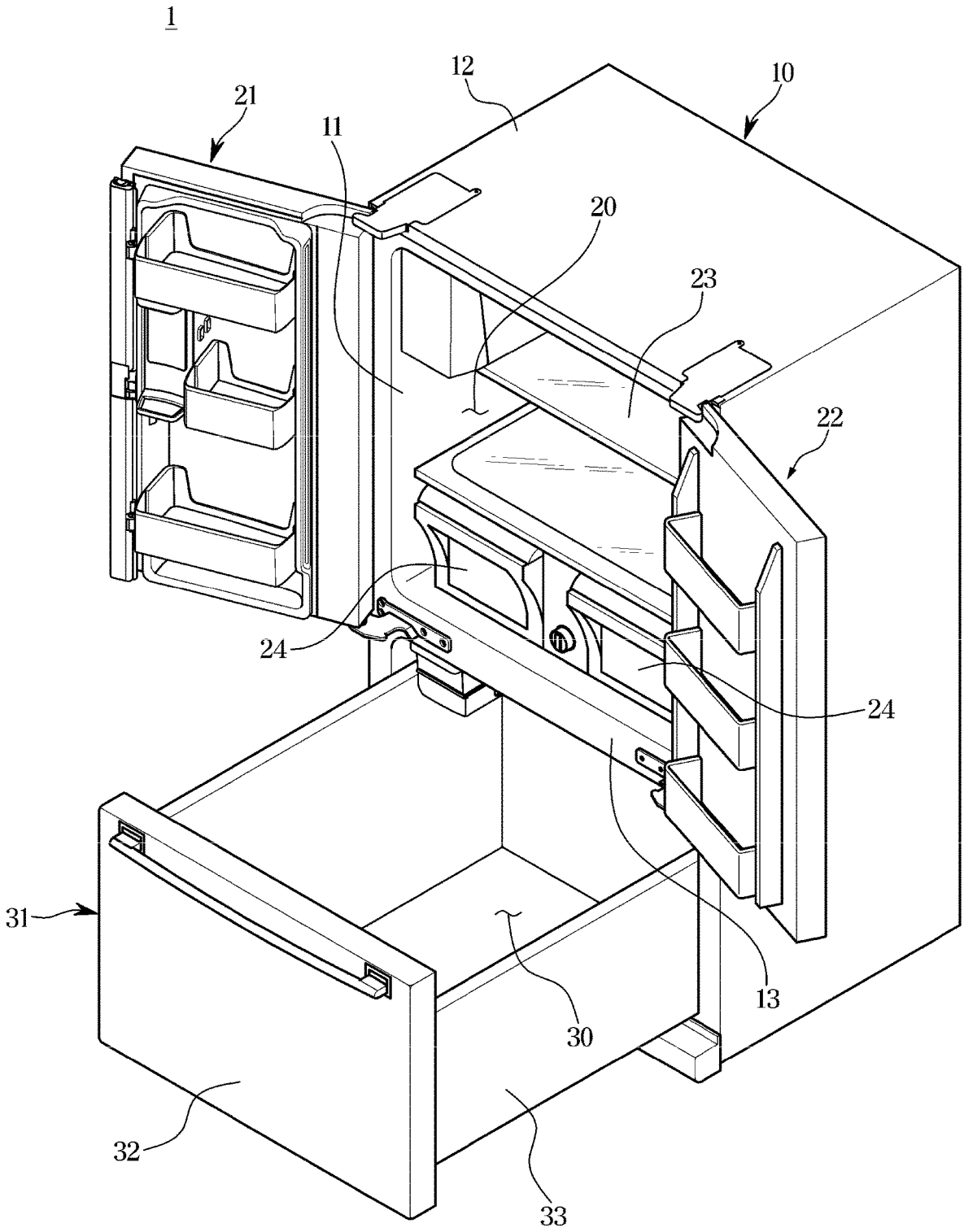
FIG. 1 is a perspective view of a refrigerator, according to an embodiment.

Embodiments and features as described and illustrated in the disclosure are merely examples, and there may be various modifications replacing the embodiments and drawings at the time of filing this application.

The terminology used herein is for the purpose of describing particular embodiments only and is not intended to limit the disclosure.

For example, the singular forms "a", "an" and "the" as herein used are intended to include the plural forms as well, unless the context clearly indicates otherwise.

The terms "comprises" and/or "comprising," when used in this specification, represent the presence of stated features, integers, steps, operations, elements, components or combinations thereof, but do not preclude the presence or addition of one or more other features, integers, steps, operations, elements, components, or combinations thereof.

The term including an ordinal number such as "first", "second", or the like is used to distinguish one component from another and does not restrict the former component.

Furthermore, the terms, such as "— part", "— block", "— member", "— module", etc., may refer to a unit of handling at least one function or operation. For example, the terms may refer to at least one process handled by hardware such as a field-programmable gate array (FPGA)/application specific integrated circuit (ASIC), etc., software stored in a memory, or at least one processor.

An embodiment of the disclosure will now be described in detail with reference to accompanying drawings. Throughout the drawings, like reference numerals or symbols refer to like parts or components.

The working principle and embodiments of the disclosure will now be described with reference to accompanying drawings.

The disclosure provides a refrigerator and method for controlling the refrigerator capable of preventing shortage of refrigerant on the side of an evaporator.

The disclosure also provides a refrigerator and method for controlling the refrigerator capable of collecting refrigerant left in a hot pipe.

The disclosure provides a refrigerator and method for controlling the refrigerator capable of increasing energy efficiency by minimizing a thermal load with the hot pipe.

Technological objectives of the disclosure are not limited to what are mentioned above, and throughout the specification, it will be clearly appreciated by those of ordinary skill in the art that there may be other technological objectives unmentioned.

According to the disclosure, a refrigerator may have increased energy efficiency.

According to the disclosure, a shortage of refrigerant in an evaporator may be prevented.

The effects according to the disclosure are not limited thereto, and throughout the specification it will be clearly appreciated by those of ordinary skill in the art that there may be other effects unmentioned.

FIG. 1 is a perspective view of a refrigerator, according to an embodiment.

Referring to FIG. 1, a refrigerator 1 may include a main body 10, at least one storeroom 20 and 30 formed in the main body 10, and at least one door 21, 22, and 31 arranged to open or close the at least one storeroom 20 and 30.

The main body 10 may include an inner case 11 that defines the storerooms 20 and 30, an outer case 12 coupled onto the outer side of the inner case 11, and insulation (not shown) arranged between the inner case 11 and the outer case 12.

The inner case 11 may be formed of a plastic substance through injection molding, and the outer case 12 may be formed of a metal substance. For the insulation, urethane foam insulation may be used, and when required, used with vacuum insulation.

After the inner case 11 and the outer case 12 are coupled with each other, the urethane foam insulation may be formed by filling foamed urethane obtained by mixing urethane and a foam agent in between the inner case 11 and the outer case 12. The foamed urethane is strongly adhesive, thus reinforcing coupling power between the inner case 11 and the outer case 12, and may have sufficient strength after foaming is complete.

The main body 10 may include a middle wall 13 that makes vertical division into the storerooms 20 and 30. The middle wall 13 may separate the fridge 20 from the freezer 30.

How to divide the storerooms 20 and 30 is not, however, limited to what is shown in FIG. 1, but may be implemented in various known ways.

The storerooms 20 and 30 may include the fridge 20 formed in the upper portion of the main body 10 and the freezer 30 formed in the lower portion of the main body 10. In other words, the freezer 30 may be placed under the fridge 20.

The fridge 20 may be maintained at temperatures of about 0 to 5 degrees Celsius to keep foods refrigerated. The freezer 30 may be maintained at temperatures of about minus 30 to 0 degree Celsius to keep foods frozen.

Shelves 23 for food items to be put thereon and containers 24 for storing food items may be provided in the fridge 20.

The fridge 20 and the freezer 30 may each have an open front to put in and take out foods. The open front of the fridge 20 may be opened or closed by a pair of fridge doors 21 and 22 coupled with the main body 10. The fridge doors 21 and 22 may be rotationally coupled with the main body 10. The open front of the freezer 30 may be opened or closed by a freezer door 31 that may slide against the main body 10. The freezer door 31 may be shaped like a box with an open top side and may include a front plate 32 defining an exterior and a drawer 33 coupled to the rear side of the front plate 32.

The shape of the freezer door 31 is not, however, limited thereto, and it is obvious that the freezer door 31 may have a shape that is rotationally coupled with the main body 10 like the fridge doors 21 and 22.

Gaskets (not shown) may be arranged on rear edges of the fridge doors 21 and 22 to seal up the space between the fridge doors 21 and 22 and the main body 10 to contain cold air of the fridge 20 when the fridge doors 21 and 22 are closed.

The refrigerator 1 may also include a cold air supplier 100 for supplying cold air into the storeroom. The cold air supplier 100 will be described in detail later.

In the meantime, the shape of the refrigerator 1 may not be limited to what is described above, but may have various forms, such as a top-mounted freezer (TMF) refrigerator with the freezer formed in the upper portion of the main body 10 and the fridge formed in the lower portion of the main body 10 or a side-by-side (SBS) refrigerator.

Moreover, it is obvious that any type of refrigerator 1 may be used as long as it receives cold air from the cold air supplier 100.

Figure 2:
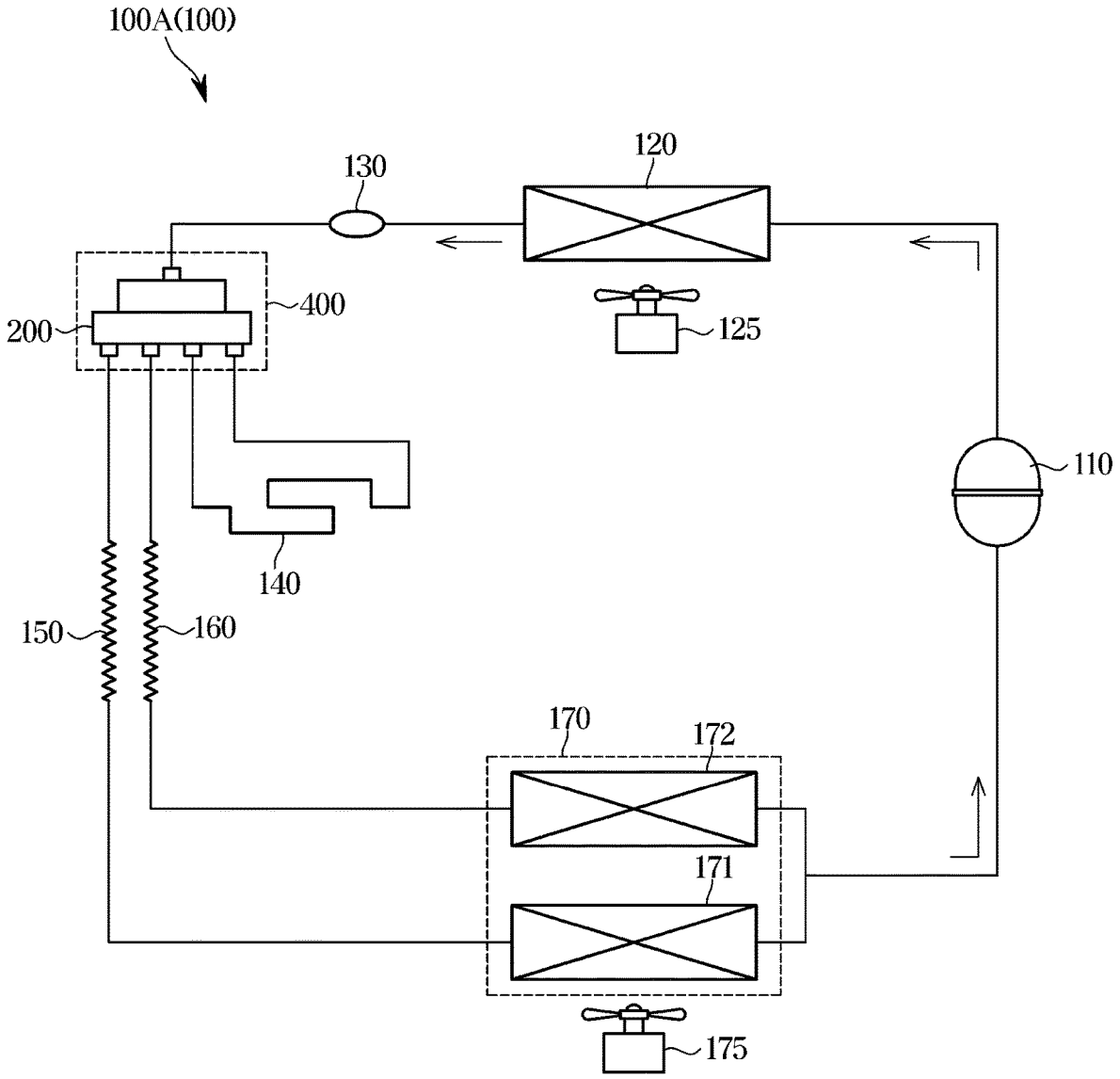
FIG. 2 illustrates an example of a cold air supplier including a valve device, according to an embodiment.
Figure 3:
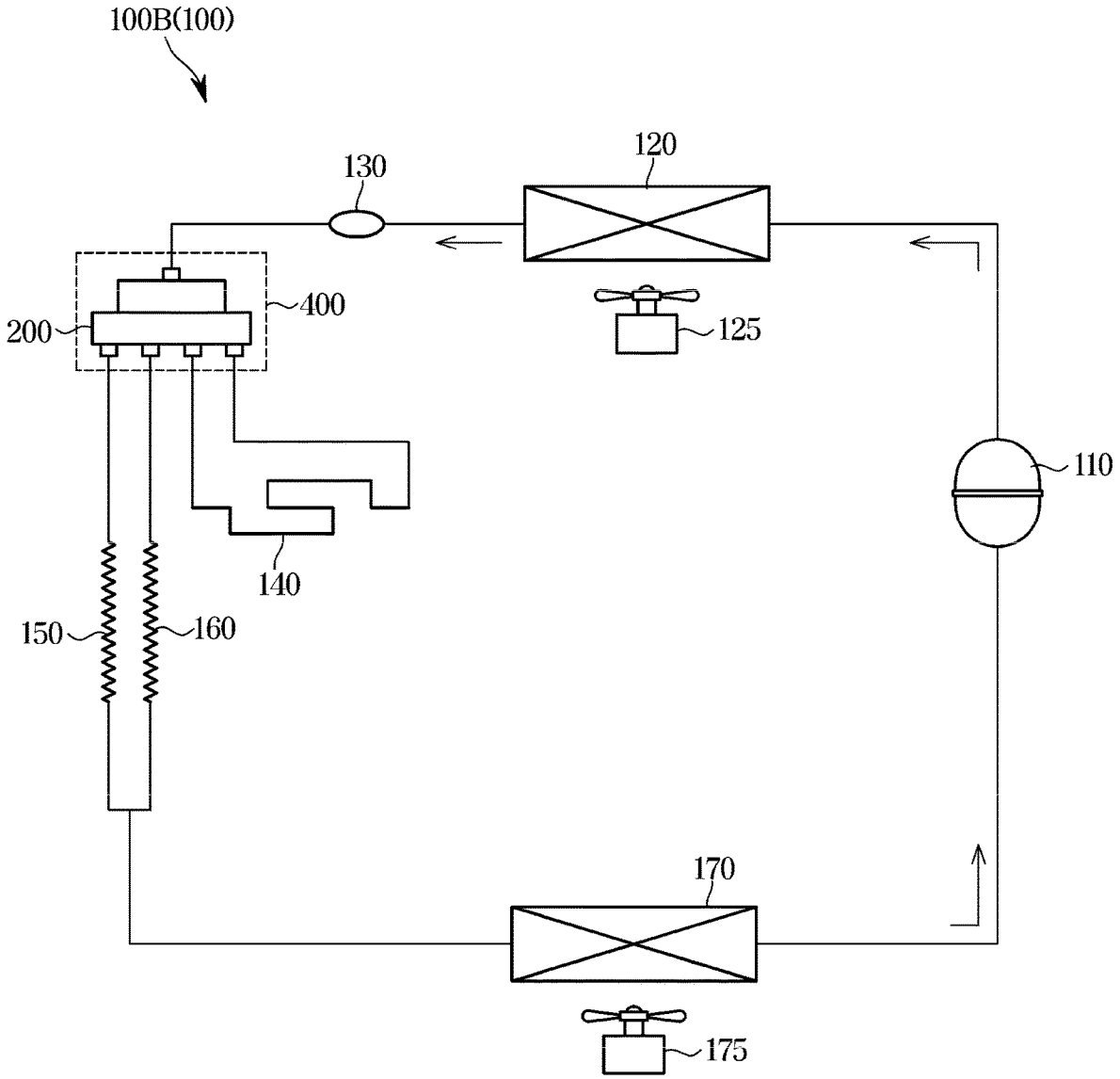
FIG. 3 illustrates another example of a cold air supplier including a valve device, according to an embodiment.

FIG. 2 illustrates a cold air supplier including a valve device, according to an embodiment. FIG. 3 illustrates another example of a cold air supplier including a valve device, according to an embodiment.

Referring to FIGS. 2 and 3, the cold air supplier 100 (see 100A in FIG. 2, 100B in FIG. 3, 100C in FIGS. 11 and 100D in FIG. 12) may include a compressor 110 and a condenser 120.

The compressor 110 may be provided to compress a refrigerant provided to circulate through the cold air supplier 100 to high-temperature and high-pressure gas.

The condenser 120 may be provided to condense the refrigerant compressed by the compressor 110. Specifically, the condenser 120 may be connected to an outlet of the compressor 110 for radiating heat from the high-temperature high-pressure gaseous refrigerant compressed by the compressor 110 to make a phase change to a room temperature liquid.

The cold air supplier 100 may further include a dryer 130. The dryer 130 may remove moisture contained in the refrigerant.

The working refrigerant flowing through the cold air supplier 100 may include HC based isobutane (R600a), propane (R290), HFC-based R134a, or HFO-based R1234yf. The type of the refrigerant is not, however, limited thereto, but any refrigerant that attains a target temperature through heat exchange with surroundings may be used.

An outlet of the condenser 120 may be connected to the valve device 400 directly or via the dryer 130.

The cold air supplier 100 may include a hot pipe 140.

The hot pipe 140 may be arranged where the main body 10 of the refrigerator 1 meets the doors 21, 22 and 31 and installed around the main body 10 to prevent condensation of water vapor.

The hot pipe 140 may be a pipe installed to prevent dew formation caused in a gasket portion of the doors 21, 22 and 31, which is vulnerable to the temperature in the refrigerator 1. When the hot refrigerant flows in the hot pipe 140, it may prevent the problem of dew formation around the doors 21, 22 and 31.

Both ends of the hot pipe 140 may be connected to the valve device 400.

The cold air supplier 100 may include at least one capillary tube 150 and 160.

For example, the cold air supplier 100 may include the first capillary tube 150 and the second capillary tube 160.

The first and second capillary tubes 150 and 160 may be provided to have different diameters and lengths. Specifically, the second capillary tube 160 may be provided to be longer than the first capillary tube 150.

The refrigerant may expand and be decompressed while flowing through the at least one capillary tube 150 and 160.

For example, the refrigerant may expand and be decompressed while flowing through the first capillary tube 150 or the second capillary tube 160.

One end of the at least one capillary tube 150 and 160 may be connected to the valve device 400 and the other end may be connected to at least one evaporator 170.

The cold air supplier 100 may include the at least one evaporator 170.

For example, the cold air supplier 100A may include a first evaporator 171 connected to the first capillary tube 150 and a second evaporator 172 connected to the second capillary tube 160.

In various embodiments, the first evaporator 171 may be arranged in the fridge 20 and the second evaporator 172 may be arranged in the freezer 30. The first evaporator 171 may supply cold air into the fridge 20 and the second evaporator 172 may supply cold air into the freezer 30.

Locations of the first and second evaporators 171 and 172 are not, however, limited thereto, and both the first and second evaporators 171 and 172 may be arranged in the fridge 20. In the case that both the first and second evaporators 171 and 172 are arranged in the fridge 20, the refrigerator 1 may lower the temperature in the freezer 30 by using the cold air subsidence phenomenon.

In an embodiment, the refrigerator 1 may operate in a fridge mode or a freezer mode.

For example, the refrigerator 1 may operate in the fridge mode or the freezer mode based on the temperature in the storeroom 20 or 30.

In an embodiment, when the refrigerator 1 operates in the fridge mode, the refrigerant may flow to the first evaporator 171. When the refrigerator 1 operates in the freezer mode, the refrigerant may flow to the second evaporator 172.

In another example, the cold air supplier 100B may include a single evaporator 170 connected to the first and second capillary tubes 150 and 160.

In various embodiments, the evaporator 170 may be arranged in the fridge 20 or the freezer 30.

In an embodiment, when the refrigerator 1 operates in the fridge mode, the refrigerant may flow to the evaporator 170 through the first capillary tube 150. When the refrigerator 1 operates in the freezer mode, the refrigerant may flow to the evaporator 170 through the second capillary tube 160.

The cold air supplier 100 may include a heat radiation fan 125 and an air blow fan 175.

The heat radiation fan 125 may be arranged near the condenser 120. The air blow fan 175 may be arranged near the evaporator 170. The heat radiation fan 125 may be provided to increase heat radiation efficiency of the condenser 120. The air blow fan 175 may be provided to increase evaporation efficiency of the evaporator 170.

The cold air supplier 100 may include the valve device 400.

The valve device 400 may include a plurality of ports connected to the respective components of the cold air supplier 100.

In an embodiment, the valve device 400 may include an input port connected to the outlet of the condenser 120, a first port connected to an end of the hot pipe 140, a second port connected to the other end of the hot pipe 140, and at least one output port connected to the at least one capillary tube 150 and 160.

In various embodiments, the valve device 400 may include a 5-way valve device 200. That is, the cold air supplier 100A or 100B may include the 5-way valve device 200.

The 5-way valve device 200 may include an input port 223 connected to the outlet of the condenser 120, a first port 283 connected to an end of the hot pipe 140, a second port 285 connected to the other end of the hot pipe 140, a first output port 284 connected to the first capillary tube 150 and a second output port 286 connected to the second capillary tube 160.

The structure of the 5-way valve device 200 will be described in connection with FIGS. 4 to 9.

A closed loop refrigerant circuit may be formed in the refrigerator 1 by connecting the compressor 110, the condenser 120, the dryer 130, the hot pipe 140, the valve device 400, the first capillary tube 150, the second capillary tube 160, and the evaporator 170 through connection tubes, through which the refrigerant circulates.

The cold air supplier 100 may include the condenser 120 connected to the outlet of the compressor 110, the valve device 400 connected to the outlet of the condenser 120, the hot pipe 140 connected to the valve device 400, at least one capillary tube 150 and 160, and the at least one evaporator 170 connected to the at least one capillary tube 150 and 160, and the outlet of the at least one evaporator 170 may be connected to the compressor 110.

As the compressor 110 operates, the refrigerant may circulate from the compressor 110 to the condenser 120 to the evaporator 170.

In various embodiments, the cold air supplier 100 may further include additional components and omit a certain component (e.g., the dryer 130).

Furthermore, as will be described later, the cold air supplier 100 may include the valve device 400 in various embodiments.

An example of the valve device shown in FIGS. 2 and 3, i.e., the 5-way valve device, will now be described in connection with FIGS. 4 to 9.

Figure 4:
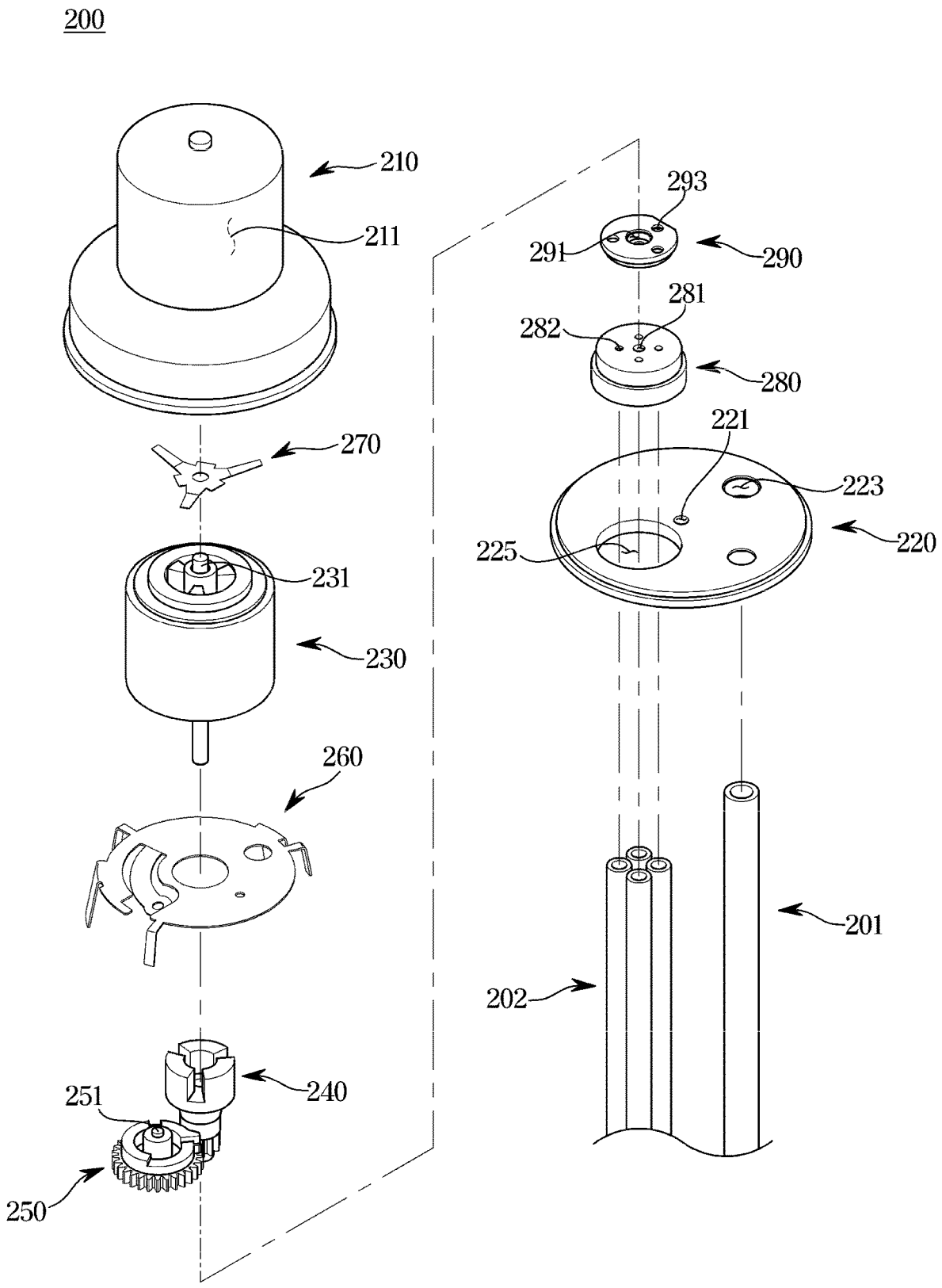
FIG. 4 is an exploded perspective view of a valve device, according to an embodiment.
Figure 5:
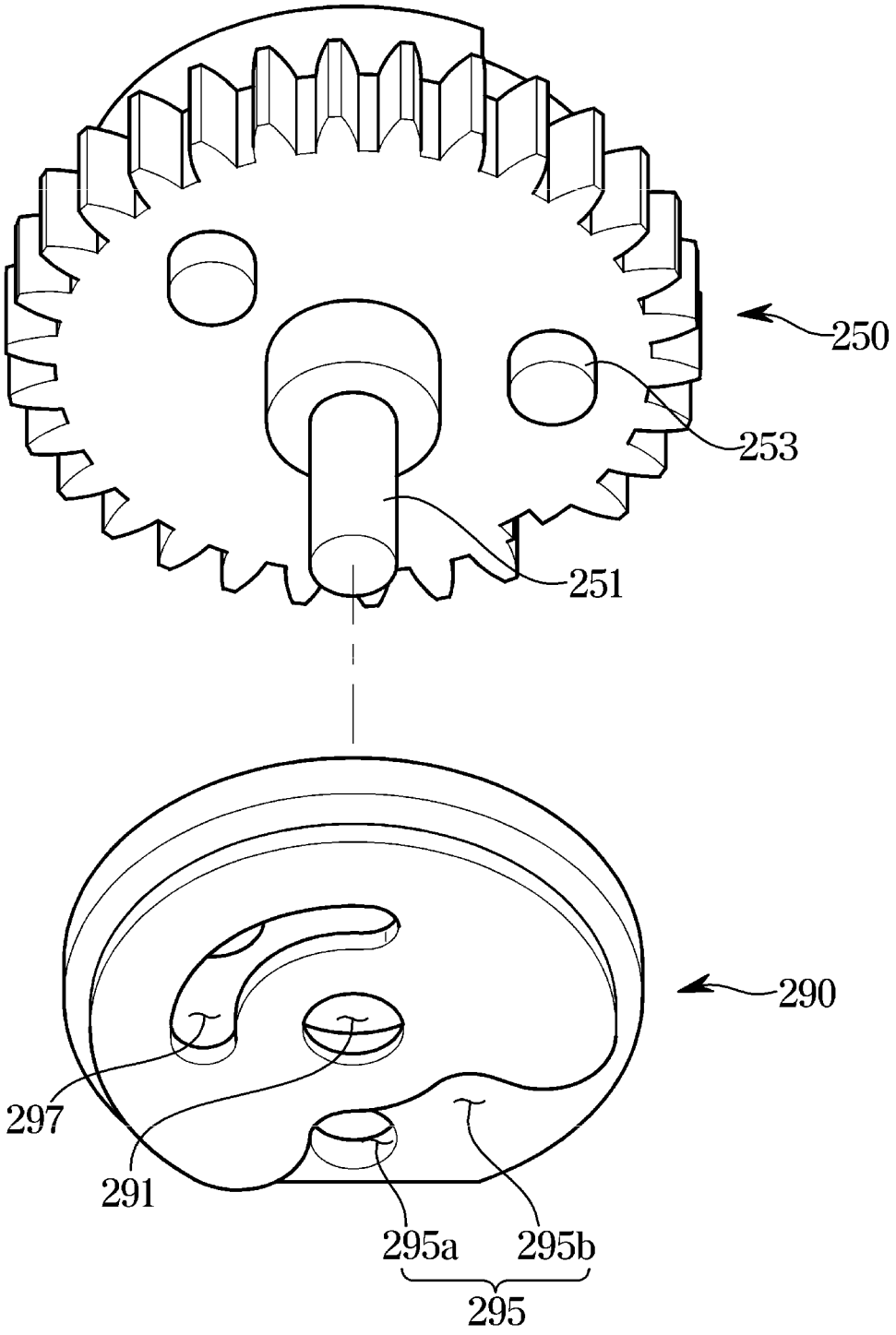
FIG. 5 illustrates a pad gear and a pad of a valve device being coupled to each other, according to an embodiment.
Figure 6:
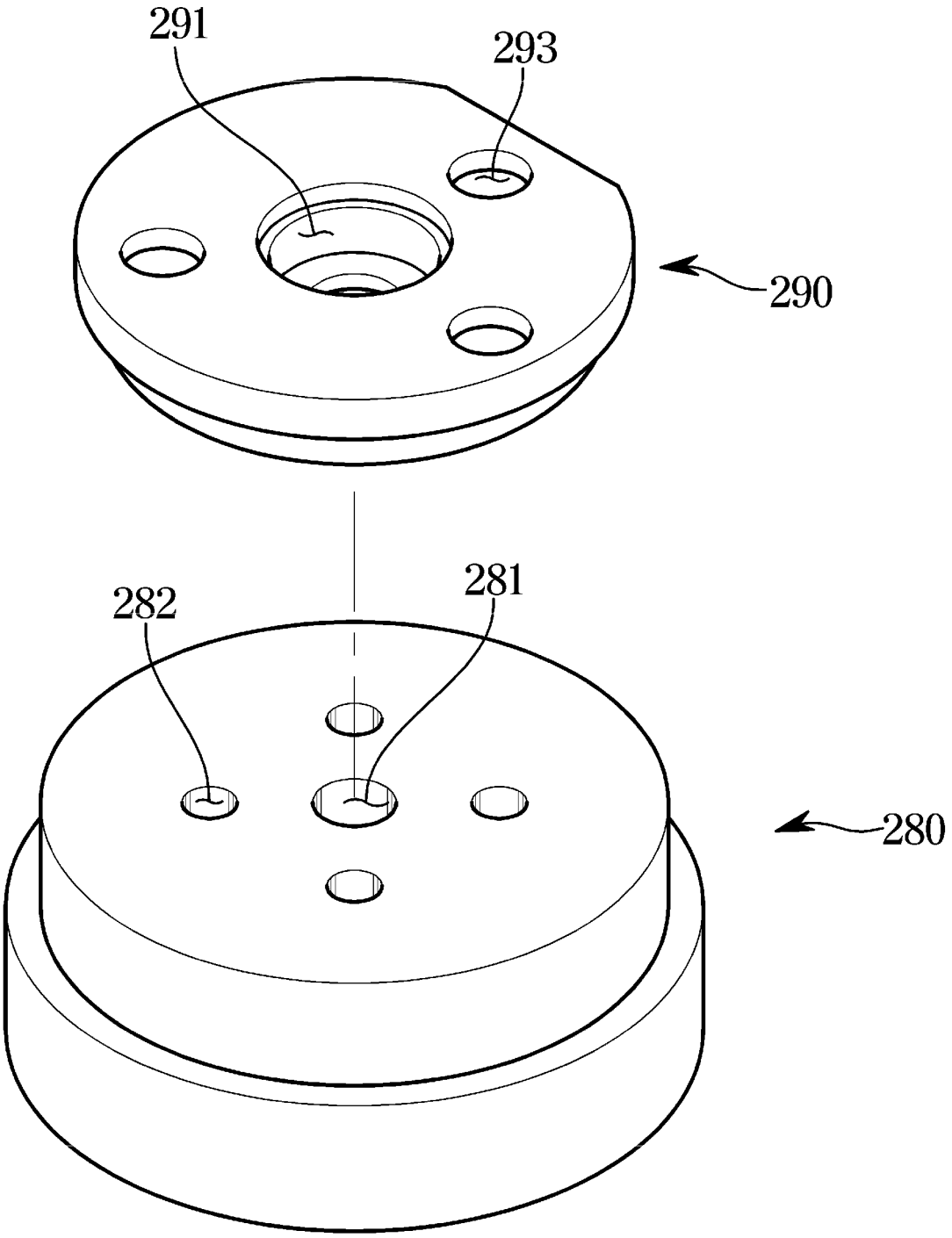
FIG. 6 illustrates a pad of a valve device arranged on the top of a boss, according to an embodiment.
Figure 7:
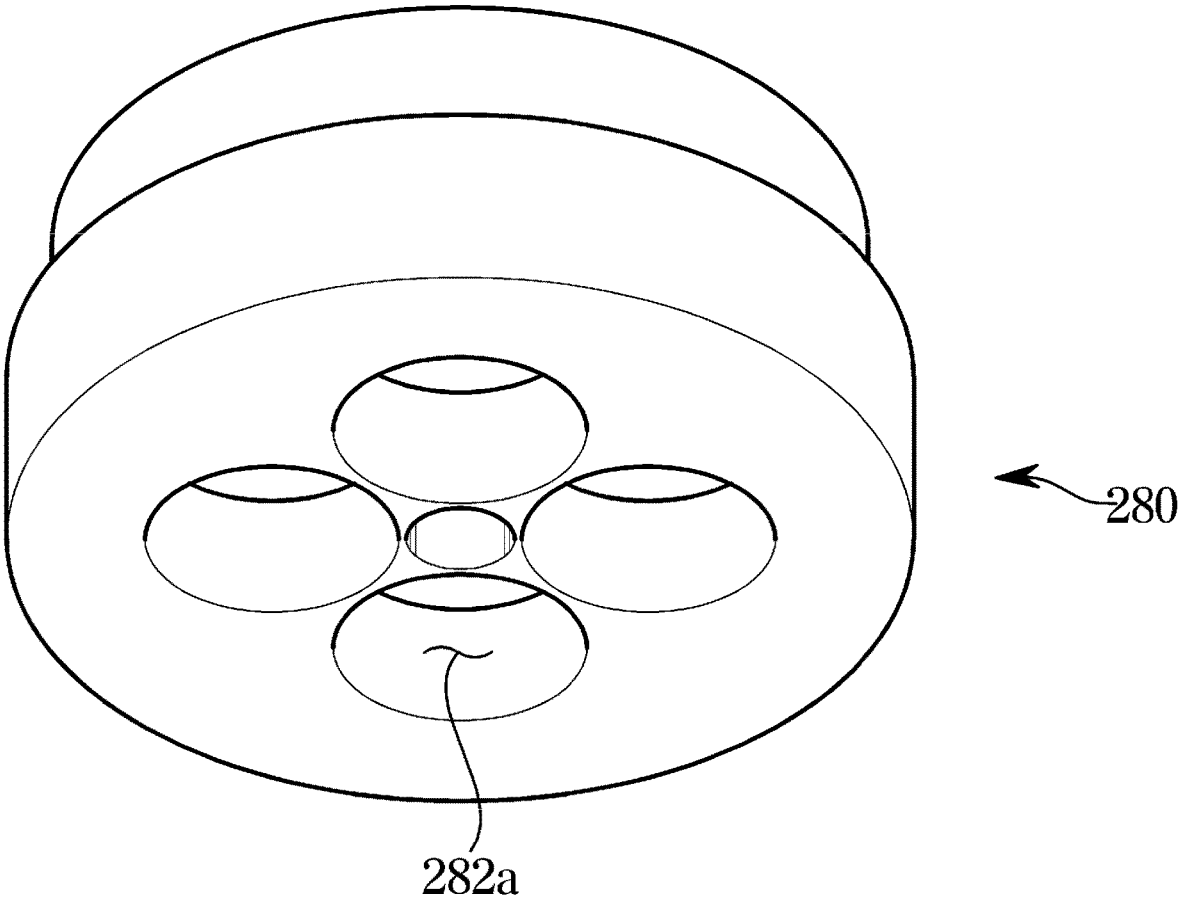
FIG. 7 illustrates a bottom surface of a boss of a valve device, according to an embodiment.
Figure 8:
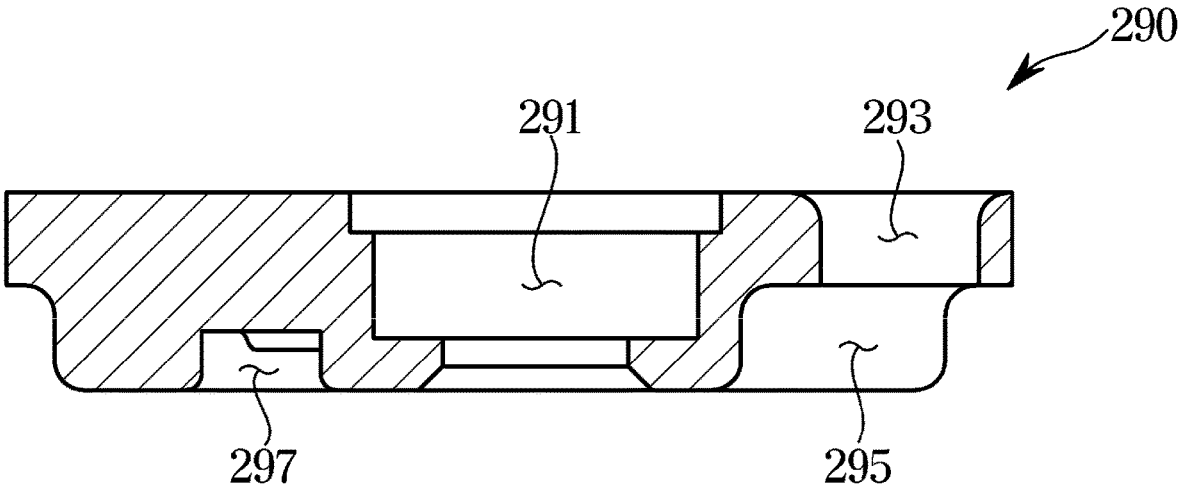
FIG. 8 is a cross-sectional view of a pad of a valve device, according to an embodiment.
Figure 9:
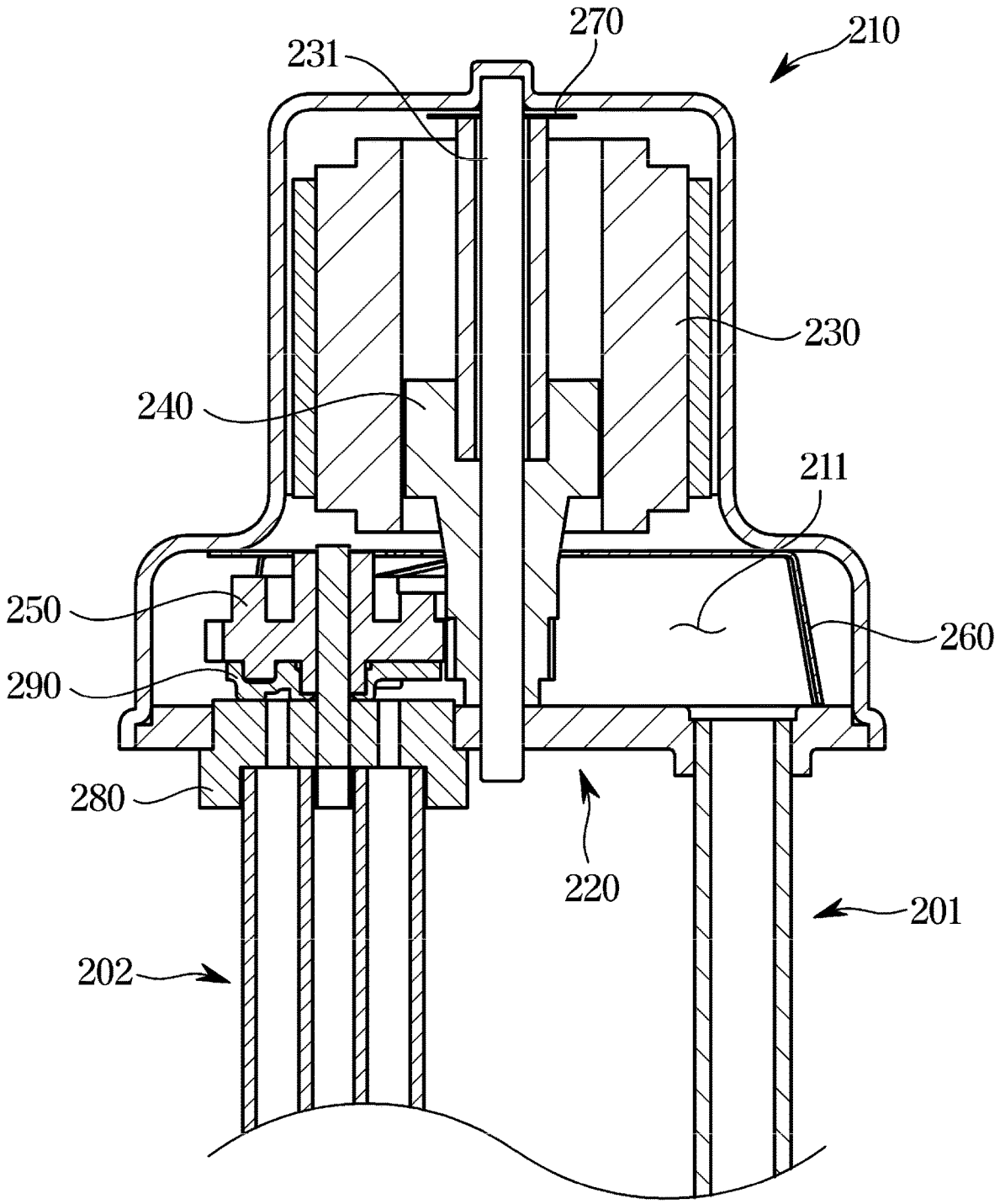
FIG. 9 is a side cross-sectional view of a valve device, according to an embodiment.

FIG. 4 is an exploded perspective view of a valve device, according to an embodiment. FIG. 5 illustrates a pad gear and a pad of a valve device being coupled to each other, according to an embodiment. FIG. 6 illustrates a pad of a valve device arranged on the top of a boss, according to an embodiment. FIG. 7 illustrates a bottom surface of a boss of a valve device, according to an embodiment. FIG. 8 is a cross-sectional view of a pad of a valve device, according to an embodiment. FIG. 9 is a side cross-sectional view of a valve device, according to an embodiment.

In an embodiment, the valve device 400 may include the 5-way valve device 200.

Referring to FIGS. 4 to 9, the 5-way valve device 200 may include a case 210, a base plate 220 covering an open bottom of the case 210, a flow-in pipe 201 into which the refrigerant flows, a plurality of flow-in/out pipes 202 through which the refrigerant flows in/out, a boss 280 including a plurality of ports 282 through which the refrigerant flows in/out, and a pad 290 rotationally arranged on the boss 280.

The case 210 may be provided to have the bottom open and a receiving space 211 formed therein.

A rotor 230 may be arranged in the receiving space 211 in the case 210. The rotor 230 may include a rotor shaft 231.

Furthermore, a pinion gear 240 may be arranged in the receiving space 211. The pinion gear 240 may be coupled to the rotor 230. The pinion gear 240 may be coupled to the rotor shaft 231 and rotated along with the rotor 230.

In addition, a pad gear 250 may be arranged in the receiving space 211. The pad gear 250 may be arranged on a side of the pinion gear 240. The pad gear 250 may be in gear with the pinion gear 240 and engaged with the pinion gear 240. Accordingly, when the pinion gear 240 is rotated by the rotor 230, the pad gear 250 may be rotated by the pinion gear 240. The pad gear 250 may include a pad valve device shaft 251 corresponding to a rotation axis. The pad valve device shaft 251 may be coupled to the pad 290 so that the pad 290 may be rotated along with the pad gear 250. The pad gear 250 may include a pad coupling projection 253 coupled to the pad 290. The pad coupling projection 253 may be provided in the plural. The pad coupling projection 253 may be provided on the bottom surface of the pad gear 250. The pad coupling projection 253 may be coupled to a pad gear coupling hole 293 formed at the top surface of the pad 290.

In addition, an elastic support spring 260 may be arranged in the receiving space 211. The elastic support spring 260 may be fixed to the case 210 in the receiving space 211. The elastic support spring 260 may be in a plate type. The elastic support spring 260 may elastically support a top center of the pad gear 250. The pad gear 250 may be rotationally mounted at the elastic support spring 260.

Furthermore, a rotor support plate spring 270 may be arranged in the receiving space 211. The rotor support plate spring 270 may be fixed to the case 210 in the receiving space 211. The rotor support plate spring 270 may elastically support the rotor 230. The rotor 230 may be rotationally supported on the rotor support late spring 270.

The base plate 220 may cover the open bottom of the case 210. The base plate 220 may include a rotor shaft support hole 221 through which the rotor shaft 231 is rotationally supported. The base plate 220 may include the input port 223 coupled to the flow-in pipe 201 to which the refrigerant flows in. The base plate 220 may include a boss hole 225 through which the boss 280 is installed.

The boss 280 may be installed in the boss hole 225 of the base plate 220. An upper portion of the boss 280 may be arranged in the receiving space 211. A lower portion of the boss 280 may be arranged outside the receiving space 211. The boss 280 may include the pad valve device shaft hole 281 to which the pad valve device shaft 251 is rotationally inserted. The boss 280 may include the plurality of ports 282 through which the refrigerant flows in/out. The plurality of ports 282 may be coupled to the plurality of flow-in/out pipes 202 through which the refrigerant flows in/out. There may be four ports 282. Also, there may be four flow-in/out pipes 202 coupled to the plurality of ports 282. The boss 280 may include a plurality of insertion holes 282*a* to which the plurality of flow-in/out pipes 202 are inserted. There may be four insertion holes 282*a* to match the number of the plurality of flow-in/out pipes 202. The plurality of insertion holes 282*a* may be connected to the plurality of ports 282.

The pad 290 may be rotationally arranged on the top of the boss 280. The pad 290 may include a pad valve device shaft coupling hole 291 to which the pad valve device shaft 251 is coupled. The pad 290 may include a pad gear coupling hole 293 to which the pad coupling projection 253 of the pad gear 250 is coupled. Accordingly, the pad 290 may be rotated along with the pad gear 250.

The pad 290 may include an open cavity 295 that selectively opens one of the plurality of ports 282 formed at the boss 280. The open cavity 295 may be formed in a lower portion of the pad 290. The open cavity 295 may have the form of a groove sunken upward from the bottom surface of the pad 290. The open cavity 295 may be formed to extend to an edge of the pad 290 in a radial direction. The open cavity 295 may have a size of 75 to 80 degrees in a circumferential direction of the pad 290 with respect to the center of the pad 290. The open cavity 295 may include a first area 295*a* formed on one side of the open cavity 295 and a second area 295*b* formed on the other side of the open cavity 295. The first area 295*a* may be located near the leftmost end of the pad 290 when the pad 290 is viewed from above (see FIG. 8). The second area 295*b* may be located near the rightmost end of the pad 290 when the pad 290 is viewed from above. The second area 295*b* may be at a location rotated 45 degrees from the first area 295*a* with respect to the center of the pad 290. The open cavity 295 may have an enough size to selectively open one of the plurality of ports 282 in the first area 295*a* or the second area 295*b*. The open cavity 295 may have a size that is unable to open two of the plurality of ports 282 at a time. In other words, one of the plurality of ports 282 may be opened in the first area 295*a* or opened in the second area 295*b*. The pad 290 may be rotated along with the pad gear 250 to selectively open one of the plurality of ports 282 formed at the boss 280.

The pad 290 may include a connection cavity 297 that selectively connects two of the plurality of ports 282 formed at the boss 280. The connection cavity 297 may be formed in a lower portion of the pad 290. The connection cavity 297 may have the form of a groove sunken upward from the bottom surface of the pad 290. The connection cavity 297 may connect two adjacent ports 282 among the plurality of ports 282.

The 5-way valve device 200 may further include a stator (not shown). The stator may be provided to enclose a portion in which the rotor 230 is arranged, from outside of the case 210.

The 5-way valve device 200 may further include a bracket (not shown). The bracket may allow the case 210 to be coupled to the stator. The bracket may allow the 5-way valve device 200 to be fixed to an external device.

Figure 10:
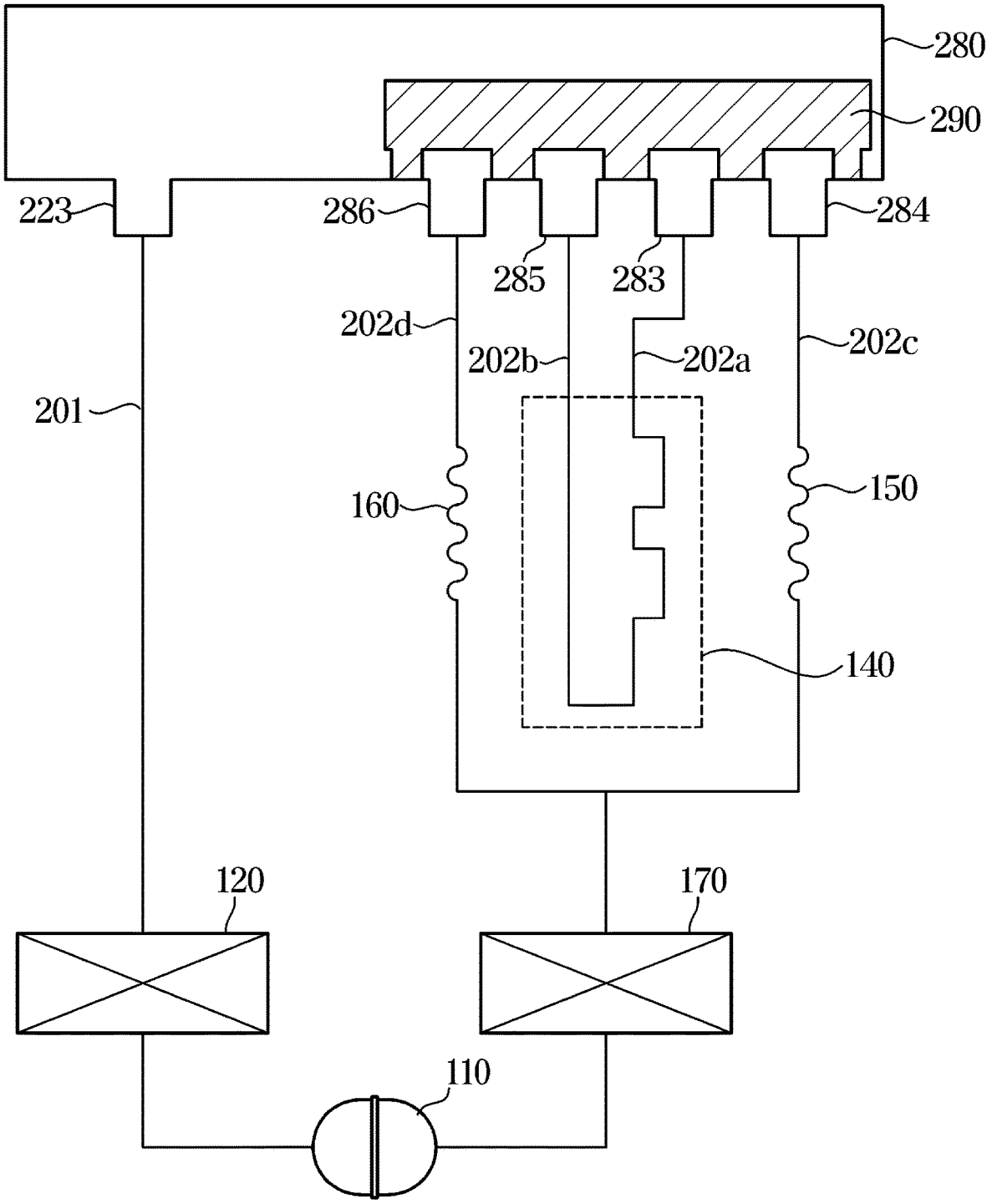
FIG. 10 is a schematic view for describing a flow of refrigerant through a valve device, according to an embodiment.

FIG. 10 is a schematic view for describing a flow of refrigerant through a valve device, according to an embodiment.

Referring to FIG. 10, when the valve device 400 is implemented with the 5-way valve device 200, the valve device 400 may include the input port 223 connected to the outlet of the condenser 120, the first port 283 connected to an end of the hot pipe 140, the second port 285 connected to the other end of the hot pipe 140, the first output port 284 connected to the first capillary tube 150 and the second output port 286 connected to the second capillary tube 160.

The outlet of the condenser 120 may be connected to the flow-in pipe 201, which may be connected to the input port 223.

The plurality of flow-in/out pipes 202 to which the refrigerant flows in or out may include a first pipe 202*a*, a second pipe 202*b*, a third pipe 202*c*, and a fourth pipe 202*d*.

One end of the hot pipe 140 may be connected to the first pipe 202*a*, which may be connected to the first port 283.

The other end of the hot pipe 140 may be connected to the second pipe 202*b*, which may be connected to the second port 285.

The first capillary tube 150 may be connected to the third pipe 202*c*, which may be connected to the first output port 284.

The second capillary tube 160 may be connected to the fourth pipe 202*d*, which may be connected to the second output port 286.

As described above, the pad 290 may include an open cavity 295 that selectively opens one of the plurality of ports 282, 283, 284, 285 and 286 formed at the boss 280.

The open cavity 295 may connect the input port to one of the plurality of ports 282, 283, 284, 285 and 286.

In other words, the refrigerant flowing in through the input port 223 may be delivered to one of the plurality of ports 282, 283, 284, 285 and 286 through the open cavity 295. As described above, the pad 290 may include the connection cavity 297 that selectively connects two of the plurality of ports 282, 283, 284, 285 and 286 formed at the boss 280.

The connection cavity 297 may connect two of the plurality of ports 282, 283, 284, 285 and 286.

As will be described later, the 5-way valve device 200 may connect the input port 223 to one port 283, 284, 285 or 286 and connect two ports of the plurality of ports 282, 283, 284, 285 and 286 according to a control signal of the controller 60 (see FIG. 13).

An example in which the valve device 400 included in the cold air supplier 100 is implemented with the 5-way valve device 200 has thus far been described.

Figure 11:
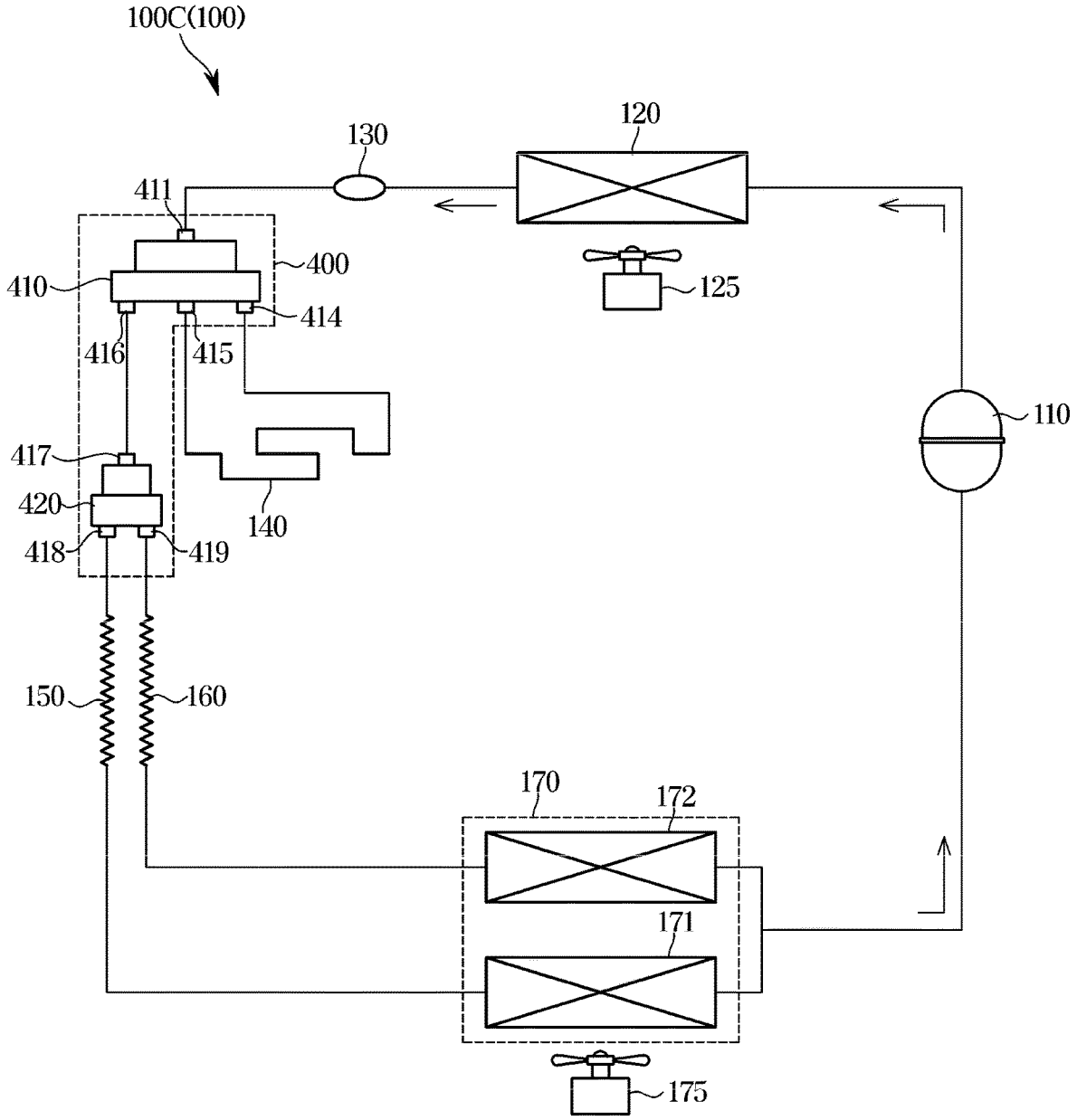
FIG. 11 illustrates an example of a cold air supplier including a valve device, according to an embodiment.
Figure 12:
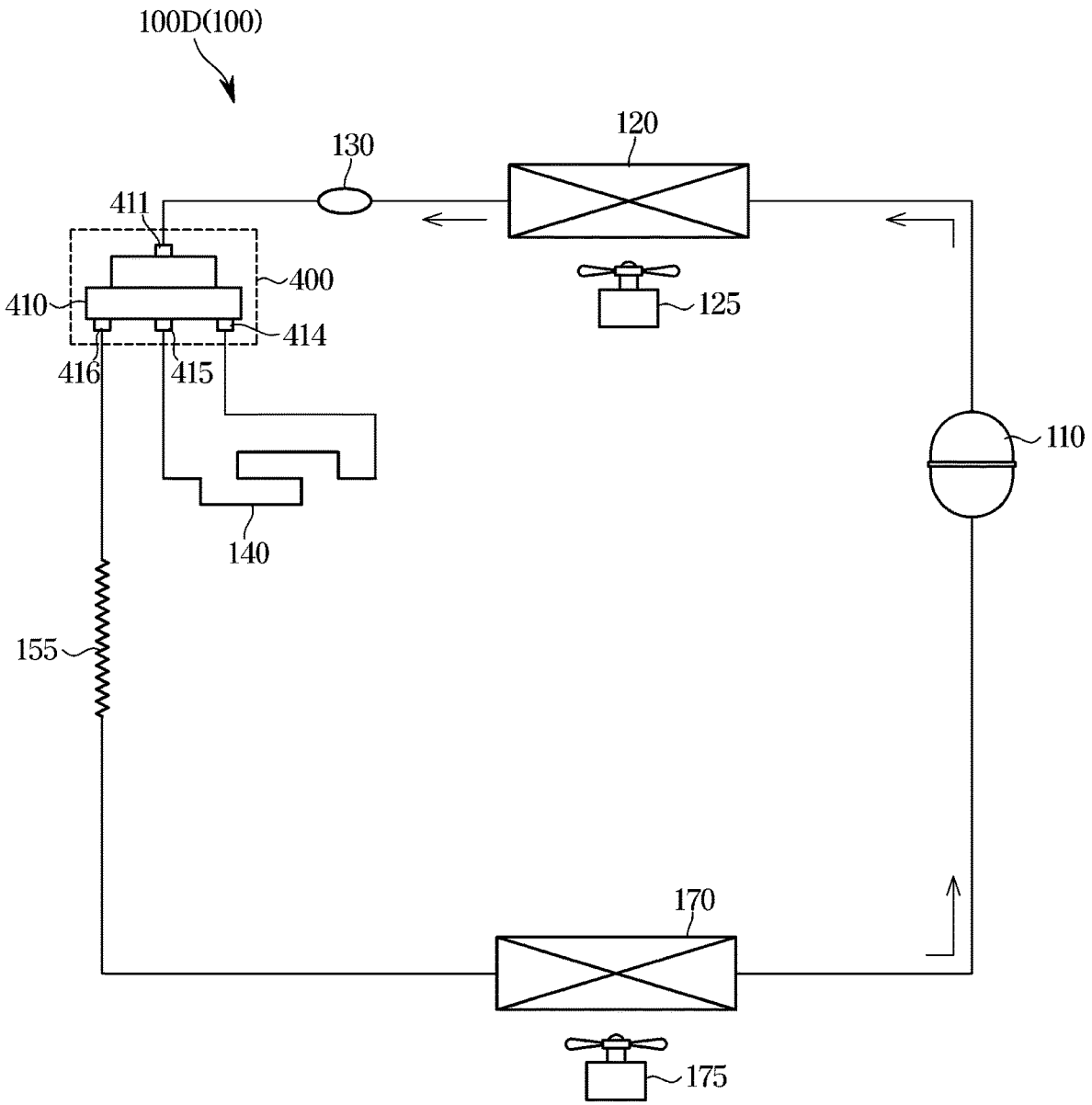
FIG. 12 illustrates an example of a cold air supplier including a valve device, according to an embodiment.

Referring to FIGS. 11 and 12, a cold air supplier including the valve device 400 will now be described according to various embodiments. Overlapping components use the same reference numerals, and detailed description thereof will not be repeated.

FIG. 11 illustrates an example of a cold air supplier including a valve device, according to an embodiment.

Referring to FIG. 11, the valve device 400 may include a 4-way valve device 410 and a 3-way valve device 420.

Unlike the aforementioned cold air supplier 100A or 100B, a cold air supplier 100C in an embodiment may include the 4-way valve device 410 and the 3-way valve device 420. As the structure of the 5-way valve device 200 was described in connection with FIGS. 4 to 9, structures of the 4-way valve device 410 and the 3-way valve device 420 will not be described in detail.

The 4-way valve device 410 may include one input port 411 and three output ports 414, 415 and 416. The input port 411 of the 4-way valve device 410 may be connected to one of the three output ports 414, 415 and 416. Furthermore, two of the three output ports 414, 415 and 416 of the 4-way valve device 410 may be connected to each other.

The 3-way valve device 420 may include one input port 417 and two output ports 418 and 419. The input port 417 of the 3-way valve device 420 may be connected to one of the two output ports 418 and 419.

In an embodiment, when the valve device 400 is implemented with the 4-way valve device 410 and the 3-way valve device 420, the valve device 400 may include the input port 411 connected to the outlet of the condenser 120, the first port 414 connected to an end of the hot pipe 140, the second port 415 connected to the other end of the hot pipe 140, the first output port 418 connected to the first capillary tube 150 and the second output port 419 connected to the second capillary tube 160.

As will be described later, the 4-way valve device 410 and the 3-way valve device 420 may connect the input port 411 to one port 414, 418 or 419 and connect two ports of the plurality of ports 414, 415, 418 and 419 according to a control signal of the controller 60 (see FIG. 13).

Furthermore, although the cold air supplier 100C is shown as including two evaporators 171 and 172 in FIG. 11, the cold air supplier 100C may include a single evaporator 170 as in the cold air supplier 100B of FIG. 3 in various embodiments.

In other words, the cold air supplier 100C may include at least one evaporator 170.

FIG. 12 illustrates a cold air supplier including a valve device, according to an embodiment.

Referring to FIG. 12, the valve device 400 may include the 4-way valve device 410.

Unlike the aforementioned cold air supplier 100A, 100B or 100C, the valve device 400 of a cold air supplier 100D in an embodiment may include only the 4-way valve device 410.

Furthermore, unlike the aforementioned cold air supplier 100A, 100B or 100C, the cold air supplier 100D may include a single capillary tube 155.

The 4-way valve device 410 may include one input port 411 and three output ports 414, 415 and 416. The input port 411 of the 4-way valve device 410 may be connected to one of the three output ports 414, 415 and 416. Furthermore, two of the three output ports 414, 415 and 416 of the 4-way valve device 410 may be connected to each other.

In an embodiment, when the valve device 400 is implemented with the 4-way valve device 410, the valve device 400 may include the input port 411 connected to the outlet of the condenser 120, the first port 414 connected to an end of the hot pipe 140, the second port 415 connected to the other end of the hot pipe 140, and the output port 416 connected to the capillary tube 155.

As will be described later, the 4-way valve device 410 may connect the input port 411 to one port 414, 415 or 416 and connect two of the plurality of ports 414, 415 and 416 according to a control signal of the controller 60 (see FIG. 13).

The cold air supplier 100D may include the evaporator 170 connected to the capillary tube 155.

Various examples of the cold air supplier 100 (100A, 100B, 100C and 100D) included in the refrigerator 1 were described above. The examples of the components included in the cold air supplier 100 are not, however, limited thereto, and those of ordinary skill in the art may omit some of the components of the cold air supplier 100 or add certain components to the cold air supplier 100 as required.

Figure 13:
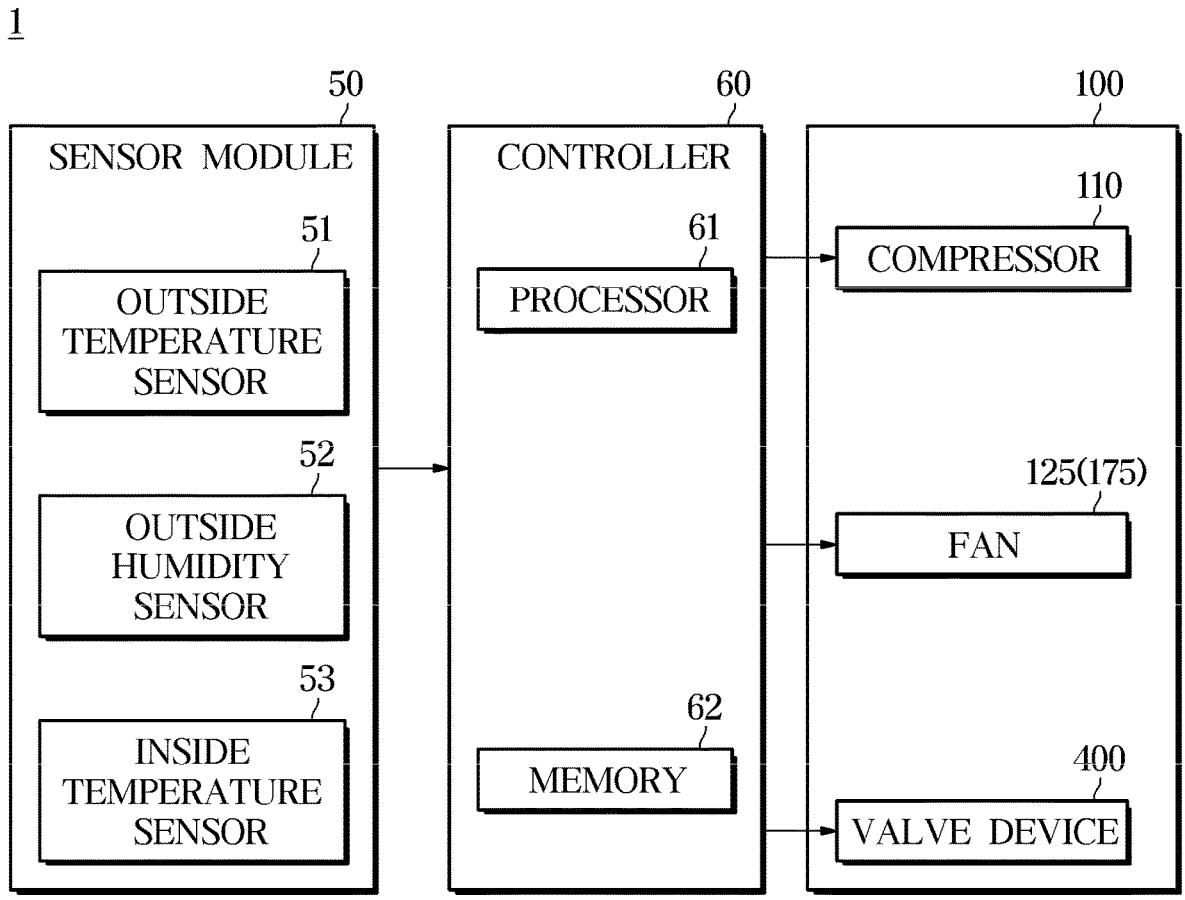
FIG. 13 is a block diagram illustrating a configuration of a refrigerator, according to an embodiment.

FIG. 13 is a block diagram illustrating a configuration of a refrigerator, according to an embodiment.

Referring to FIG. 13, the refrigerator 1 according to the embodiment may include a sensor module 50, a controller 60, and the cold air supplier 100.

The cold air supplier 100 may include the compressor 110, the fans 125 and 175, and the valve device 400.

In an embodiment, the valve device 400 may include the input port 223 or 411 connected to the outlet of the condenser 120, the first port 283 or 414 connected to an end of the hot pipe 140, a second port 285 or 415 connected to the other end of the hot pipe 140, the at least one output port 284 and 286, 418 and 419, or 416 connected to the at least one capillary tube 150 and 160 or 155.

The compressor 110, the fans 125 and 175, and the valve device 400 were already described above, so the description thereof will not be repeated.

The sensor module 50 may include an outside temperature sensor 51.

The outside temperature sensor 51 may detect air temperature outside the refrigerator 1, and send the outside temperature information to the controller 60. For this, the outside temperature sensor 51 may be arranged on the main body 10.

The sensor module 50 may include an outside humidity sensor 52.

The outside humidity sensor 52 may detect air humidity outside the refrigerant 1 and send the outside humidity information to the controller 60. For this, the outside humidity sensor 52 may be arranged on the main body 10.

The sensor module 50 may include an inside temperature sensor 53.

The inside temperature sensor 53 may be arranged in at least one storeroom 20 and 30 to detect temperature in the at least one storeroom 20 and 30. The inside temperature sensor 53 may send the inside temperature information to the controller 60.

In various embodiments, the inside temperature sensor 53 may include a first inside temperature 53 arranged in the fridge 20 and a second inside temperature sensor 53 arranged in the freezer 30. The first inside temperature sensor 53 may send temperature information of the fridge 20 to the controller 60, and the second inside temperature sensor 53 may send temperature information of the freezer 30 to the controller 60.

In various embodiments, among the components of the sensor module 50, the outside temperature sensor 51 and/or the outside humidity sensor 52 may be omitted. In various embodiments, the outside temperature sensor 51 and the outside humidity sensor 52 may be implemented with a single sensor. In various embodiments, the sensor module 50 may further include an inside humidity sensor. For example, the inside humidity sensor may be implemented in the inside temperature sensor 53.

In an embodiment, the controller 60 may estimate outside temperature based on operation information of the compressor 110 and the inside temperature information.

For example, the controller 60 may estimate the outside temperature based on an operation time of the compressor 110 required to reduce the inside temperature by a certain value.

Although not shown, the refrigerator 1 may further include a communication module. Functions of the outside temperature sensor 51 and the outside humidity sensor 52 may be replaced by the communication module.

The communication module may transmit or receive data to or from an external device. For example, the communication module may transmit or receive various data by communicating with a server and/or a user terminal and/or a home appliance.

For this, the communication module may support establishment of a direct (e.g., wired) communication channel or a wireless communication channel between external devices (e.g., a server, a user terminal and/or a home appliance), and communication through the established communication channel According to an embodiment, the communication module may include a wireless communication module (e.g., a cellular communication module, a short-range wireless communication module or a global navigation satellite system (GNSS) communication module) or a wired communication module (e.g., a local area network (LAN) communication module or a power-line communication module). A corresponding one of the communication modules may communicate with an external electronic device over a first network (e.g., a short-range communication network such as bluetooth, wireless-fidelity (Wi-Fi) direct or infrared data association (IrDA)) or a second network (e.g., a remote communication network such as a legacy cellular network, a fifth generation (5G) network, a next generation communication network, the Internet, or a computer network (e.g., a LAN or wide area network (WAN)). These various types of communication modules may be integrated into a single component (e.g., a single chip) or implemented as a plurality of separate components (e.g., a plurality of chips).

The communication module may include a Wi-Fi module, and perform communication with an external server and/or a user terminal and/or a home appliance based on establishment of communication with a home access point (AP).

The communication module may communicate with a home appliance at home to receive outside temperature information and outside humidity information from the home appliance.

For example, the communication module may communicate with an air conditioner at home to receive outside temperature information and outside humidity information from the air conditioner. The controller 60 may include a processor 61 for generating a control signal for an operation of the refrigerator 1, and a memory 62 for storing a program, an application, instructions and/or data for operation of the refrigerator 1. The processor 61 and the memory 62 may be implemented with separate semiconductor devices or in a single semiconductor device. The controller 60 may include a plurality of processors 61 and a plurality of memories 62. The controller 60 may be provided in various positions inside the refrigerator 1. For example, the controller 60 may be included in a printed circuit board arranged inside a control panel.

The processor 61 may include an operation circuit, a storage circuit, and a control circuit. The processor 61 may include one or multiple chips. Furthermore, the processor 61 may include one or multiple cores.

The memory 62 may store a program for controlling the cold air supplier and data required to control the cold air supplier.

The memory 62 may include a volatile memory, such as a static random access memory (S-RAM) or a dynamic RAM (D-RAM), and a non-volatile memory, such as a read only memory (ROM) or an erasable programmable ROM (EPROM). The memory 62 may include a memory device, or multiple memory devices.

The processor 61 may process data and/or a signal based on the program provided from the memory 62, and transmit a control signal to each component of the refrigerator 1 based on the processing result. For example, the processor 61 may process information obtained from the sensor module 50 (e.g., outside humidity information, outside temperature information, inside temperature information) and/or operation information of components included in the cold air supplier (e.g., mode information of the valve device 400, operation information of the compressor 110).

The components of the cold air supplier 100 (e.g., the compressor 110, the valve device 400, and the fans 125 and 175) may be controlled by the controller 60.

Figure 14:
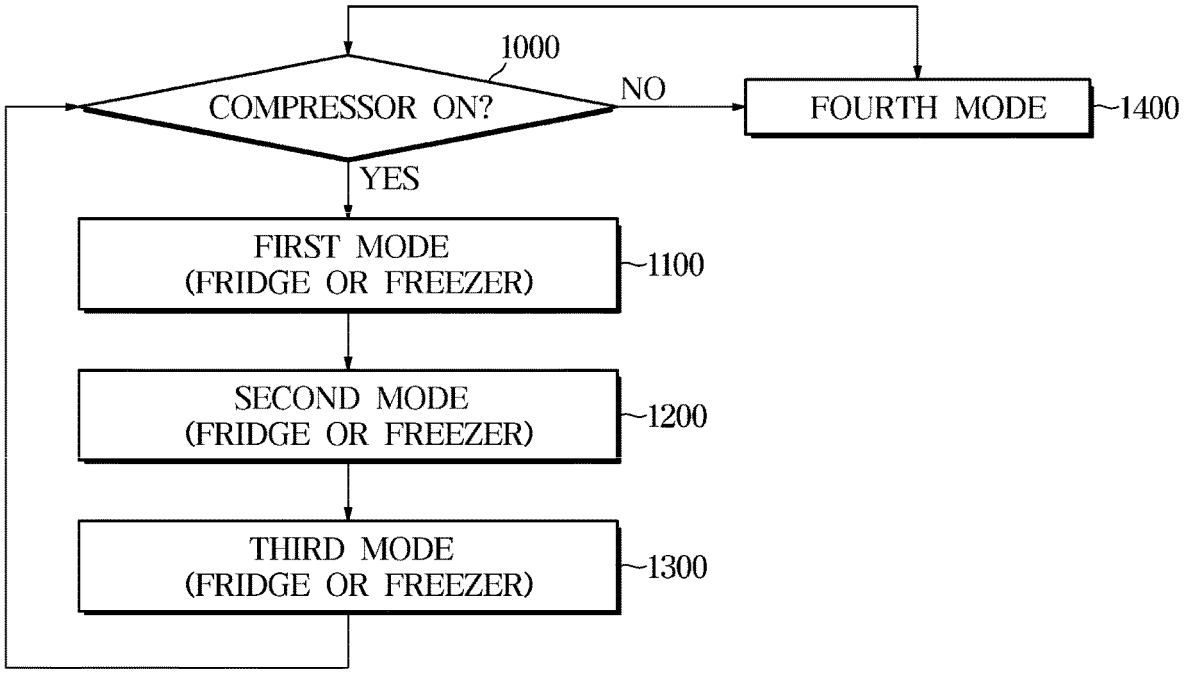
FIG. 14 is a flowchart illustrating an example of a method of controlling a refrigerator, according to an embodiment.

FIG. 14 is a flowchart illustrating an example of a method of controlling a refrigerator, according to an embodiment.

Referring to FIG. 14, the controller 60 may operate the compressor 110 based on an operation condition of the compressor 110 being satisfied, in 1000. The controller 60 may switch the valve device 400 into the fourth mode based on the compressor 110 being off in 1000, in 1400.

For example, the controller 60 may operate the compressor 110 based on the temperature of the storeroom 20 or 30 rising above a certain temperature.

In an embodiment, when the cold air supplier 100A, 100B or 100C includes at least two capillary tubes, the controller 60 may control the refrigerator 1 to perform fridge operation or freezer operation.

Accordingly, the refrigerator 1 may operate in a fridge mode or a freezer mode. During operation of the compressor 110 in 1000, the controller 60 may operate the valve device 400 in a first mode, a second mode and a third mode in 1100, 1200 and 1300.

Although it is shown that the controller 60 operates the valve device 400 in an order of the first mode, the second mode and the third mode, the controller 60 may operate the valve device 400 in an order of the first mode, the second mode and the third mode or the second mode, the third mode and the first mode based on the compressor 110 being started to operate.

For example, the controller 60 may operate the valve device 400 in the first mode based on the compressor 110 being started to operate.

Furthermore, the controller 60 may operate the valve device 400 in the second mode based on the compressor 110 being started to operate.

The controller 60 may switch the valve device 400 from the first mode to the second mode based on a termination condition of the first mode satisfied, switch the valve device 400 from the second mode to the third mode based on a termination condition of the second mode satisfied, and switch the valve device 400 from the third mode to the first mode based on a termination condition of the third mode satisfied, during operation of the compressor 110.

The controller 60 may switch the valve device 400 to a fourth mode based on the compressor 110 being off in 1000 while the valve device 400 is operating in the first, second, or third mode.

The controller 60 may operate the valve device 400 in the first mode during operation of the compressor 110, in 1100.

The controller 60 may operate the valve device 400 in the second mode during operation of the compressor 110, in 1200.

The controller 60 may operate the valve device 400 in the third mode during operation of the compressor 110, in 1300.

When the cold air supplier 100 (100A, 100B or 100C) includes at least two capillary tubes 150 and 160, the flow path switching method of the valve device 400 in the first, second and third modes may be different depending on whether the refrigerator 1 operates in the fridge mode or the freezer mode.

Flows of refrigerant in the cold air supplier 100A or 100B including the 5-way valve device 200 will now be described with reference to FIGS. 15 to 21.

Figure 15:
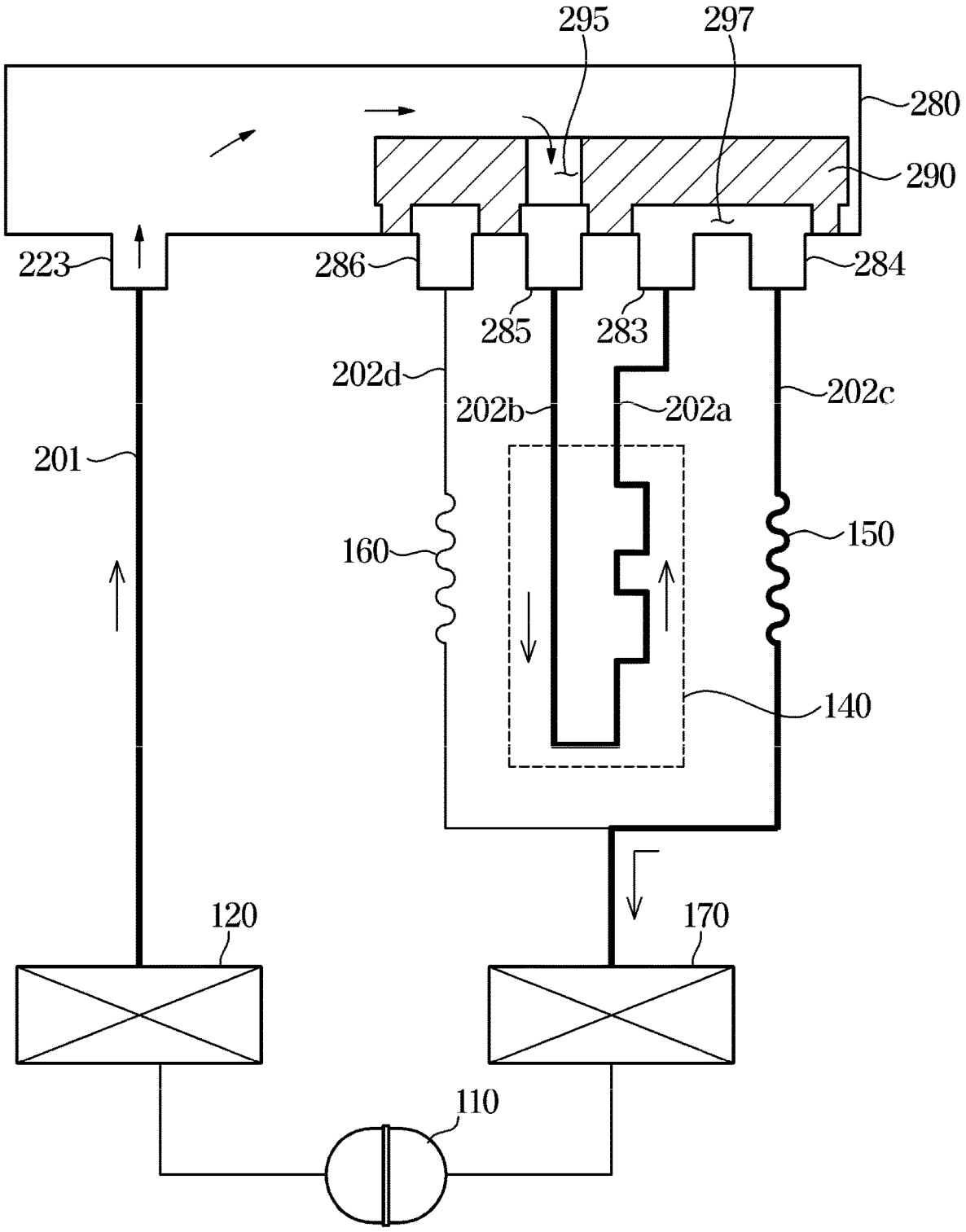
FIG. 15 illustrates flows of a refrigerant through a valve device operating in a first mode when a refrigerator operates in a fridge mode, according to an embodiment.
Figure 16:
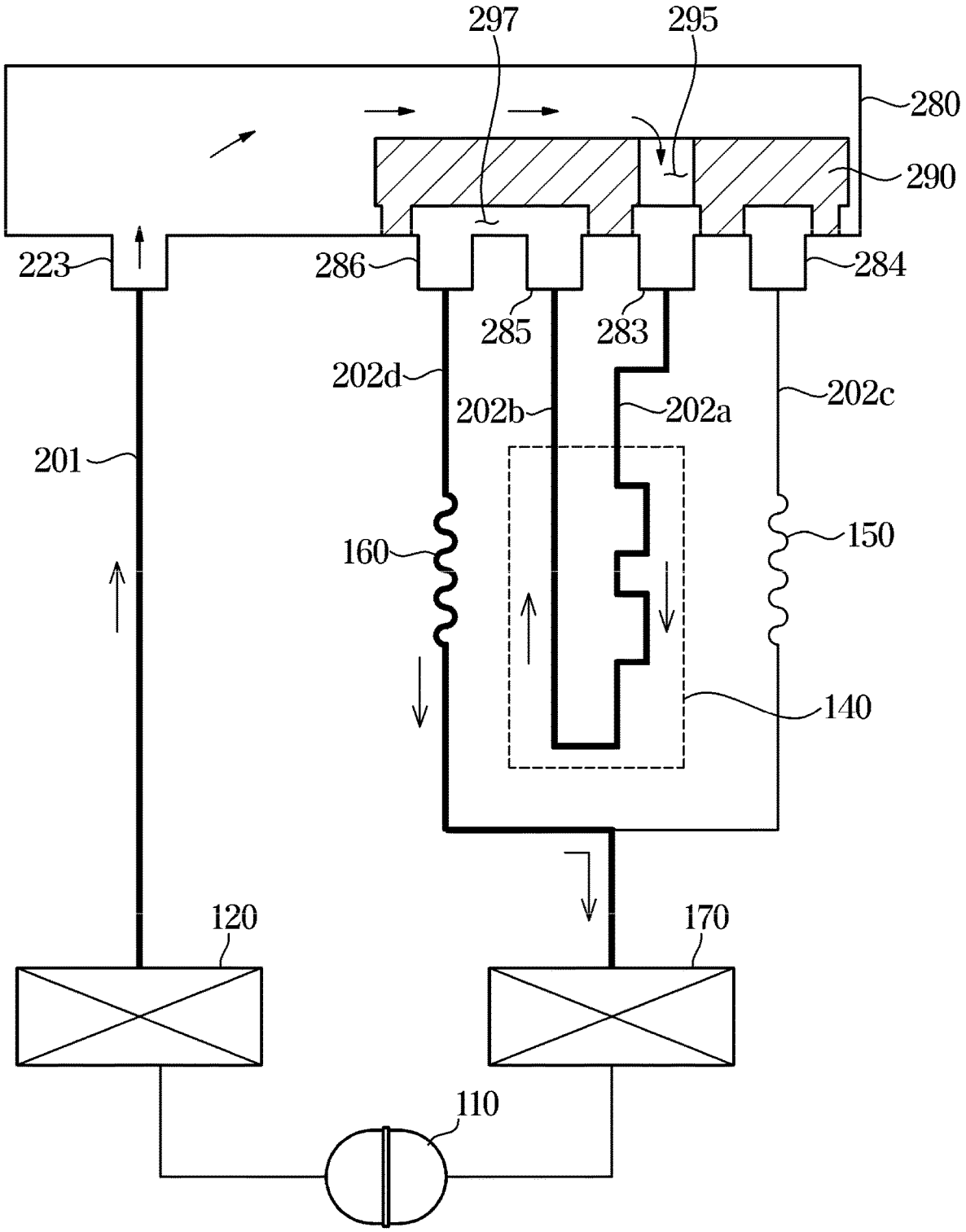
FIG. 16 illustrates flows of a refrigerant through a valve device operating in a first mode when a refrigerator operates in a freezer mode, according to an embodiment.

FIG. 15 illustrates flows of a refrigerant through a valve device operating in a first mode when a refrigerator operates in the fridge mode, according to an embodiment. FIG. 16 illustrates flows of a refrigerant through a valve device operating in a first mode when a refrigerator operates in the freezer mode, according to an embodiment.

When the valve device 400 operates in the first mode, the refrigerant discharged through the outlet of the condenser 120 may be supplied into the capillary tubes 150 and 160 via the hot pipe 140.

The controller 60 may control the valve device 400 such that one of the first port 283 and the second port 285 is connected to the input port 223 and the other is connected to the output port 284 or 286.

Accordingly, the first mode may be defined as a hot pipe-pass mode.

When the refrigerator 1 operates in the fridge mode and the valve device 400 operates in the first mode, the refrigerant discharged through the outlet of the condenser 120 may be supplied into the first capillary tube 150 via the hot pipe 140.

When the refrigerator 1 operates in the freezer mode and the valve device 400 operates in the first mode, the refrigerant discharged through the outlet of the condenser 120 may be supplied into the second capillary tube 160 via the hot pipe 140.

Hence, the first mode may be divided into two modes, e.g., fridge-first and freezer-first modes, according to the operation mode of the refrigerator 1.

Referring to FIG. 15, when the refrigerator 1 operates in the fridge mode, the controller 60 may control the 5-way valve device 200 such that the first port 283 is connected to the first output port 284 and the second port 285 is connected to the input port 223 in the first mode. Furthermore, when the refrigerator 1 operates in the fridge mode, the controller 60 may control the 5-way valve device 200 to close the second output port 286 in the first mode.

In the fridge-first mode, the refrigerant discharged from the condenser 120 and flowing into the input port 223 may flow into the second port 285 through the open cavity 295, the refrigerant flowing into the second port 285 may pass through the hot pipe 140 and flow into the first port 283, the refrigerant flowing into the first port 283 may flow into the first output port 284 through the connection cavity 297, and the refrigerant flowing into the first output port 284 may be delivered into the first capillary tube 150 through the third pipe 202*c*.

Referring to FIG. 16, when the refrigerator 1 operates in the freezer mode, the controller 60 may control the 5-way valve device 200 such that the second port 285 is connected to the second output port 286 and the first port 283 is connected to the input port 223 in the first mode. Furthermore, when the refrigerator 1 operates in the freezer mode, the controller 60 may control the 5-way valve device 200 to close the first output port 284 in the first mode.

In the freezer-first mode, the refrigerant discharged from the condenser 120 and flowing into the input port 223 may flow into the first port 283 through the open cavity 295, the refrigerant flowing into the first port 283 may pass through the hot pipe 140 and flow into the second port 285, the refrigerant flowing into the second port 285 may flow into the second output port 286 through the connection cavity 297, and the refrigerant flowing into the first output port 286 may be delivered into the second capillary tube 160 through the fourth pipe 202*d*.

In various embodiments, when the operation mode of the refrigerator 1 is switched to the freezer mode from the fridge mode while the valve device 400 is operating in the fridge-first mode, the controller 60 may switch the valve device 400 operating in the fridge-first mode to the freezer-first mode.

In the disclosure, the refrigerator 1 may have the refrigerant having passed through the hot pipe 140 supplied to the different capillary tube 150 or 160 depending on the operation mode of the refrigerator 1.

Figure 17:
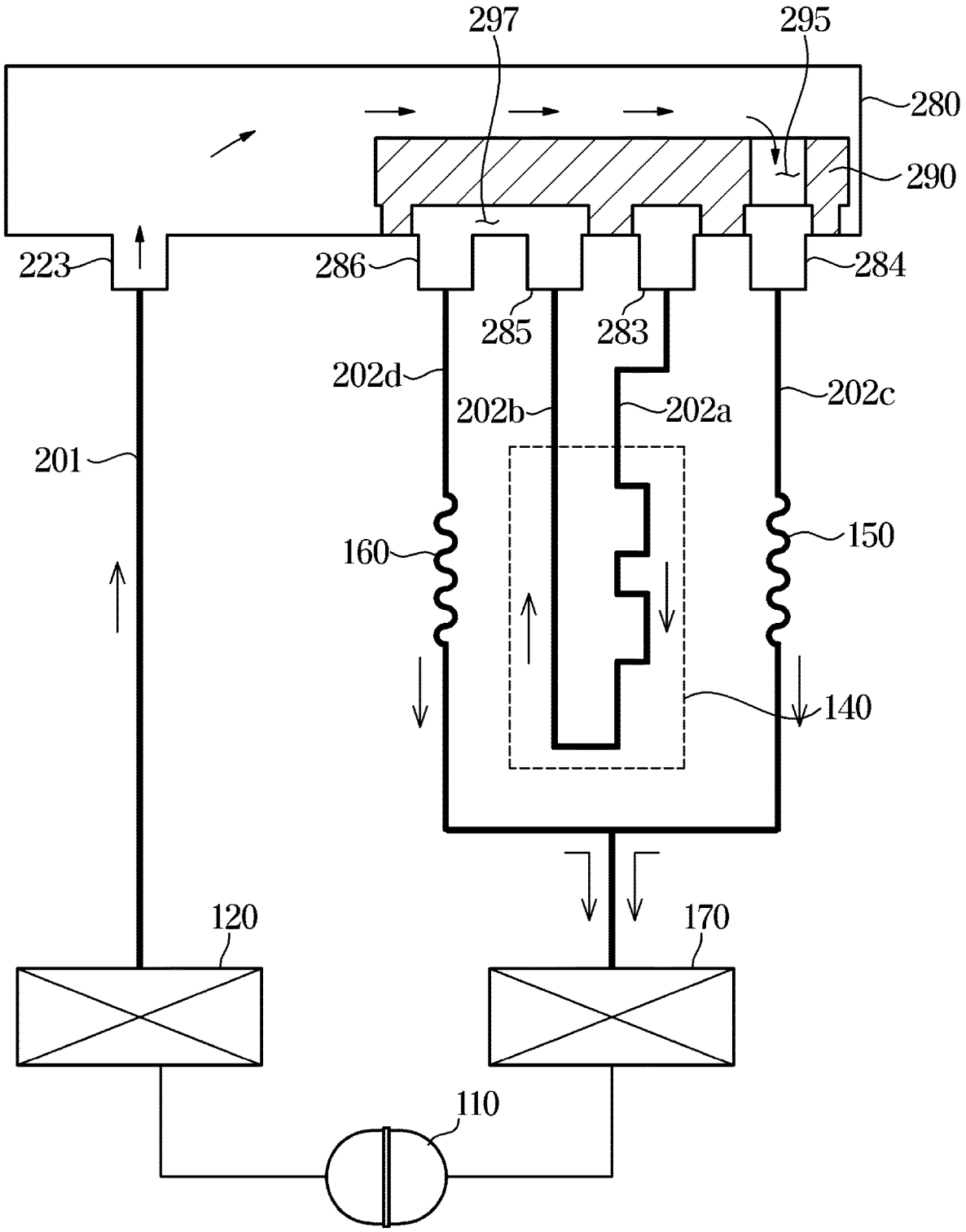
FIG. 17 illustrates flows of a refrigerant through a valve device operating in a second mode when a refrigerator operates in a fridge mode, according to an embodiment.
Figure 18:
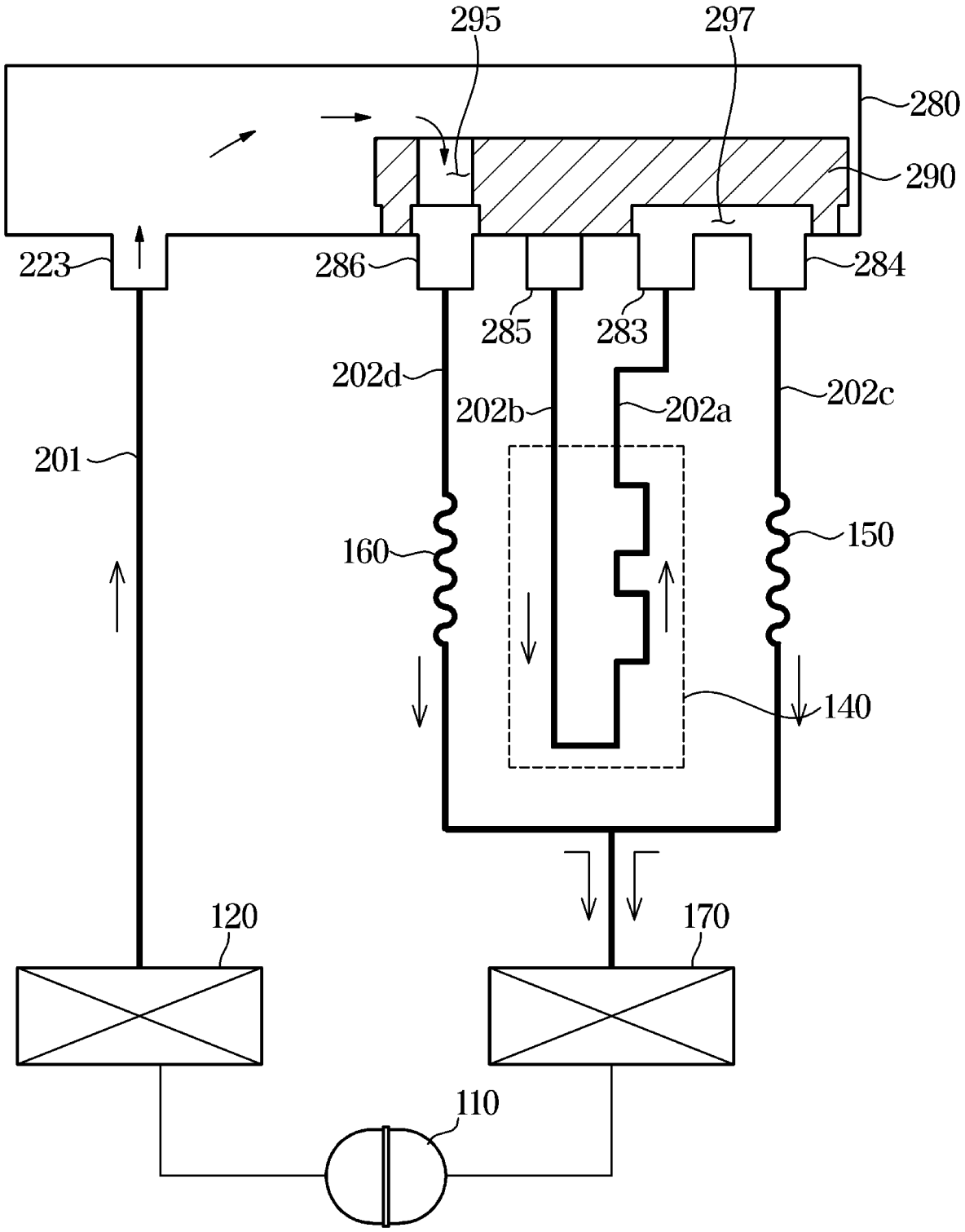
FIG. 18 illustrates flows of a refrigerant through a valve device operating in a second mode when a refrigerator operates in a freezer mode, according to an embodiment.

FIG. 17 illustrates flows of a refrigerant through the valve device 400 operating in a second mode when a refrigerator operates in a fridge mode, according to an embodiment. FIG. 18 illustrates flows of a refrigerant through a valve device operating in a second mode when a refrigerator operates in a freezer mode, according to an embodiment.

When the valve device 400 operates in the second mode, the refrigerant left in the hot pipe 140 may be collected through the capillary tube 150 or 160.

The controller 60 may control the valve device 400 such that one of the first port 283 and the second port 285 is closed and the other is connected to the output port 284 or 286.

Accordingly, the second mode may be defined as a refrigerant collection mode.

In an embodiment, when the refrigerator 1 operates in the fridge mode and the valve device 400 operates in the second mode, the refrigerant left in the hot pipe 140 may be collected to the evaporator 170 through the second capillary tube 160.

In various embodiments, when the refrigerator 1 operates in the fridge mode and the valve device 400 operates in the second mode, the refrigerant discharged through the outlet of the condenser 120 may detour around the hot pipe 140 and be supplied into the first capillary tube 150.

When the refrigerator 1 operates in the freezer mode and the valve device 400 operates in the second mode, the refrigerant left in the hot pipe 140 may be collected to the evaporator 170 through the first capillary tube 150.

In various embodiments, when the refrigerator 1 operates in the freezer mode and the valve device 400 operates in the second mode, the refrigerant discharged through the outlet of the condenser 120 may detour around the hot pipe 140 and be supplied into the second capillary tube 160.

Hence, the second mode may be divided into two modes, e.g., fridge-second and freezer-second modes, according to the operation mode of the refrigerator 1.

Referring to FIG. 17, when the refrigerator 1 operates in the fridge mode, the controller 60 may control the 5-way valve device 200 such that the first port 283 is closed and the second port 285 is connected to the second output port 286 in the second mode. Furthermore, when the refrigerator 1 operates in the fridge mode, the controller 60 may control the 5-way valve device 200 to connect the input port 223 to the first output port 284 in the second mode.

As the compressor 110 operates, the refrigerant is moved in a direction from the evaporator 170 to the compressor 110.

In the fridge-second mode, as the first port 283 is closed, the refrigerant left in the hot pipe 140 may not move toward the first port 283. In the meantime, as the second port 285 is connected to the second output port 286 through the connection cavity 297, the refrigerant left in the hot pipe 140 is discharged toward the second output port 286 through the connection cavity 297.

As the refrigerant left in the hot pipe 140 is discharged toward the second output port 286, the refrigerant left in the hot pipe 140 is collected to the evaporator 170 through the second capillary tube 160.

According to the disclosure, as the refrigerant left in the hot pipe 140 is collected to the evaporator 170, the shortage of refrigerant in the cold air supplier 100 may be prevented.

Furthermore, according to the disclosure, by securing a sufficient amount of refrigerant required for a cooling cycle through the second mode, frequency of the compressor 110 may be lowered, thereby saving energy.

In the meantime, in the fridge-second mode, the refrigerant discharged from the condenser 120 and flowing into the input port 223 may flow into the first output port 284 through the open cavity 295, and the refrigerant flowing into the first output port 284 may be delivered into the first capillary tube 150 through the third pipe 202*c*.

According to the disclosure, refrigeration performance may be maintained by collecting the refrigerant left in the hot pipe 140 through the second capillary tube and simultaneously, forcing the refrigerant discharged from the condenser 120 to flow into the first capillary tube 150.

Referring to FIG. 18, when the refrigerator 1 operates in the freezer mode, the controller 60 may control the 5-way valve device 200 such that the second port 285 is closed and the first port 283 is connected to the first output port 284 in the second mode. Furthermore, when the refrigerator 1 operates in the freezer mode, the controller 60 may control the 5-way valve device 200 to connect the input port 223 to the second output port 286 in the second mode.

As the compressor 110 operates, the refrigerant is moved in a direction from the evaporator 170 to the compressor 110.

In the freezer-second mode, as the second port 285 is closed, the refrigerant left in the hot pipe 140 may not move toward the second port 285. In the meantime, as the first port 283 is connected to the first output port 284 through the connection cavity 297, the refrigerant left in the hot pipe 140 is discharged toward the first output port 284 through the connection cavity 297.

As the refrigerant left in the hot pipe 140 is discharged toward the first output port 284, the refrigerant left in the hot pipe 140 is collected to the evaporator 170 through the first capillary tube 150.

According to the disclosure, as the refrigerant left in the hot pipe 140 is collected to the evaporator 170, the shortage of refrigerant in the cold air supplier 100 may be prevented.

Furthermore, according to the disclosure, by securing a sufficient amount of refrigerant required for a cooling cycle through the second mode, frequency of the compressor 110 may be lowered, thereby saving energy.

In the meantime, in the freezer-second mode, the refrigerant discharged from the condenser 120 and flowing into the input port 223 may flow into the second output port 286 through the open cavity 295, and the refrigerant flowing into the second output port 286 may be delivered into the second capillary tube 160 through the fourth pipe 202*d*.

According to the disclosure, refrigeration performance may be maintained by collecting the refrigerant left in the hot pipe 140 through the first capillary tube 150 and simultaneously, forcing the refrigerant discharged from the condenser 120 to flow into the second capillary tube 160.

Figure 19:
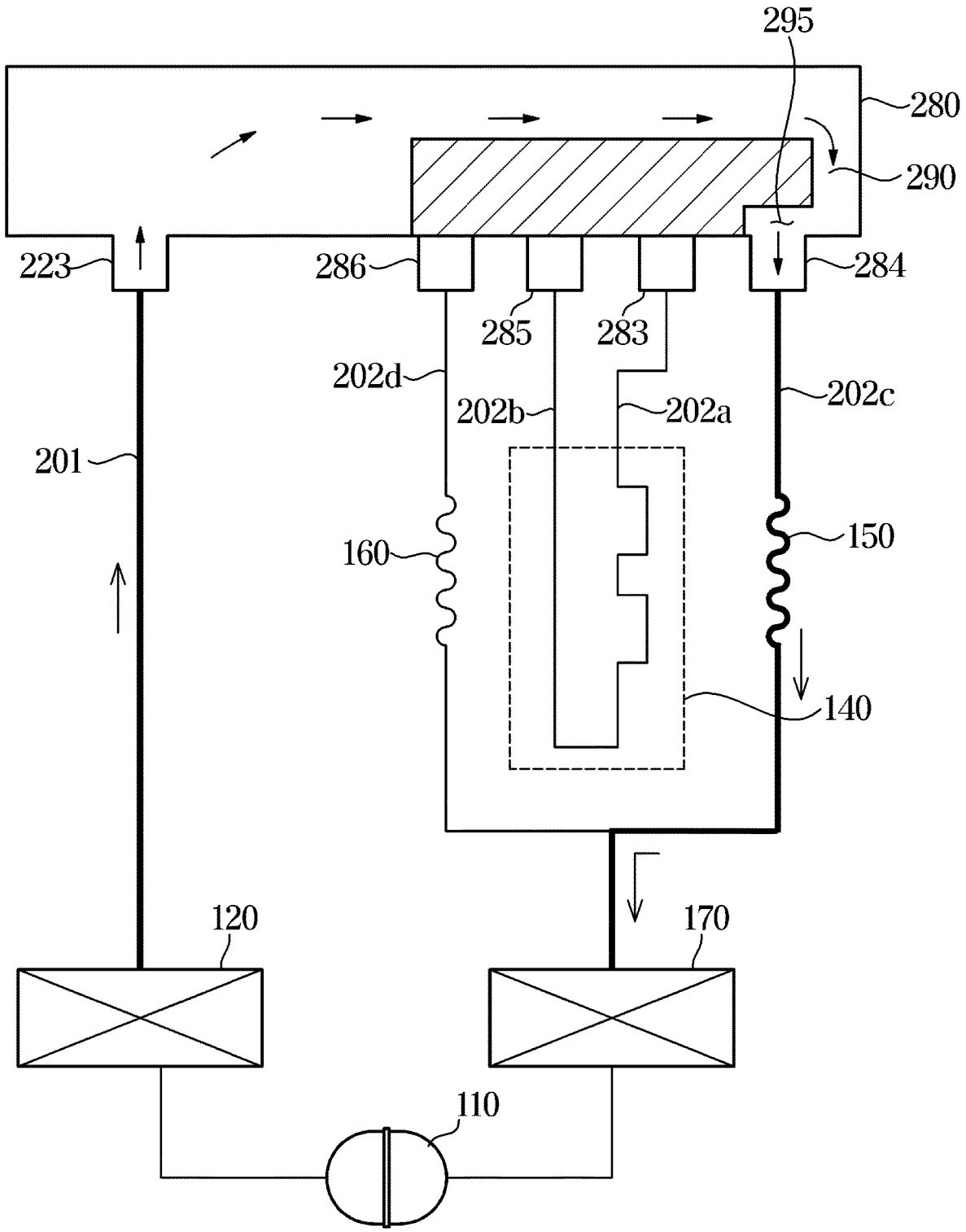
FIG. 19 illustrates flows of a refrigerant through a valve device operating in a third mode when a refrigerator operates in a fridge mode, according to an embodiment.
Figure 20:
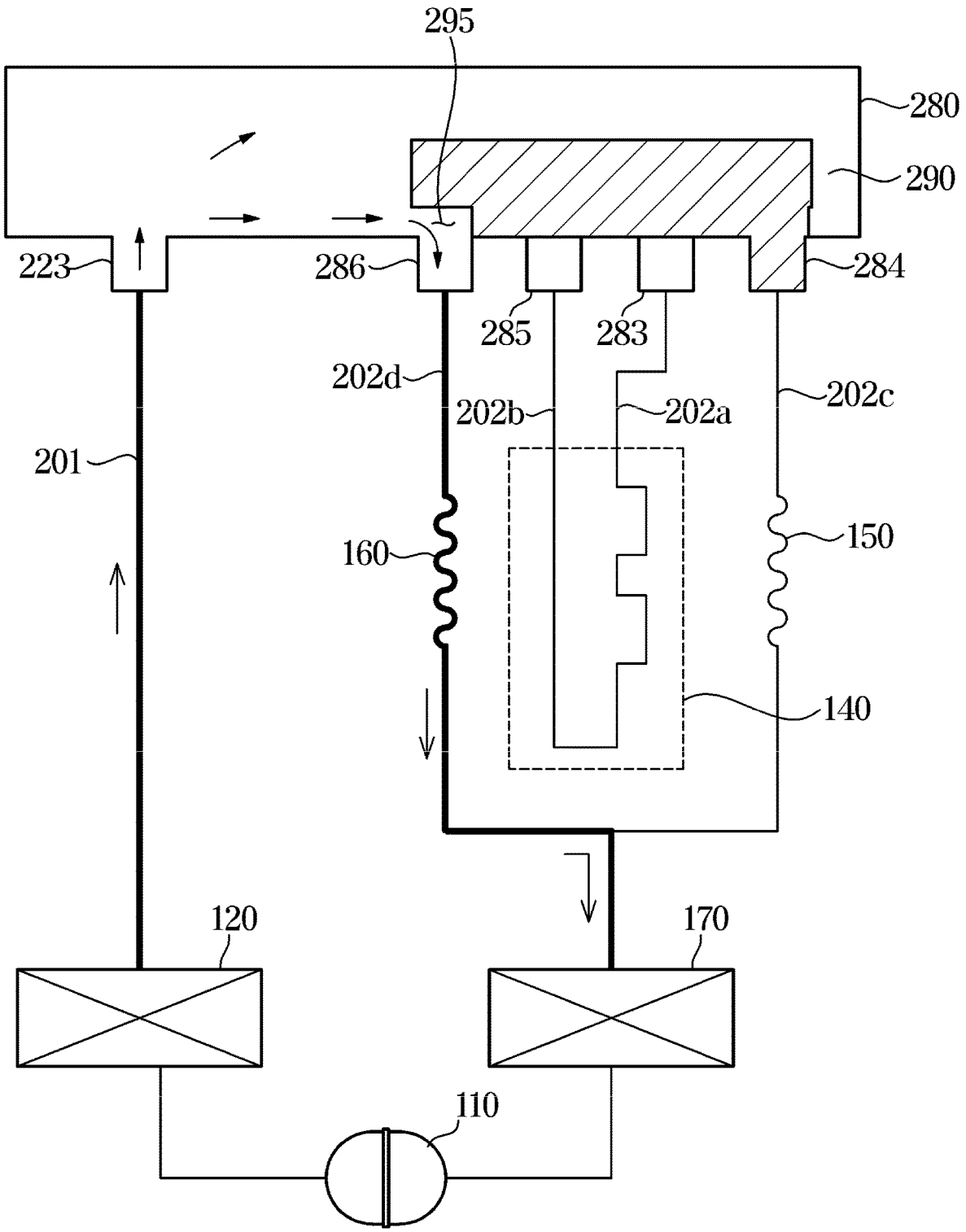
FIG. 20 illustrates flows of a refrigerant through a valve device operating in a third mode when a refrigerator operates in a freezer mode, according to an embodiment.

FIG. 19 illustrates flows of a refrigerant through a valve device operating in a third mode when a refrigerator operates in a fridge mode, according to an embodiment. FIG. 20 illustrates flows of a refrigerant through a valve device operating in a third mode when a refrigerator operates in a freezer mode, according to an embodiment.

When the valve device 400 operates in the third mode, the refrigerant discharged through the outlet of the condenser 120 may detour around the hot pipe 140 and be supplied into the capillary tubes 150 and 160.

The controller 60 may control the valve device 400 to close both the first port 283 and the second port 285 in the third mode. Furthermore, the controller 60 may control the valve device 400 to connect the input port 223 to the output port 284 or 286 in the third mode.

Accordingly, the third mode may be defined as a hot pipe-detour mode.

When the refrigerator 1 operates in the fridge mode and the valve device 400 operates in the third mode, the refrigerant discharged through the outlet of the condenser 120 may detour around the hot pipe 140 and be supplied into the first capillary tube 150.

When the refrigerator 1 operates in the freezer mode and the valve device 400 operates in the third mode, the refrigerant discharged through the outlet of the condenser 120 may detour around the hot pipe 140 and be supplied into the second capillary tube 160.

Hence, the third mode may be divided into two modes, e.g., fridge-third and freezer-third modes, according to the operation mode of the refrigerator 1.

Referring to FIG. 19, when the refrigerator 1 operates in the fridge mode, the controller 60 may control the 5-way valve device 200 to close both the first port 283 and the second port 285 in the third mode.

Furthermore, when the refrigerator 1 operates in the fridge mode, the controller 60 may control the 5-way valve device 200 to close the second output port 286 in the third mode.

Furthermore, when the refrigerator 1 operates in the fridge mode, the controller 60 may control the 5-way valve device 200 to connect the input port 223 to the first output port 284 in the third mode.

In the fridge-third mode, the refrigerant discharged from the condenser 120 and flowing into the input port 223 may flow into the first output port 284 through the open cavity 295, and the refrigerant flowing into the first output port 284 may be delivered into the first capillary tube 150 through the third pipe 202*c*.

In this case, the refrigerant delivered into the first capillary tube 150 may not pass through the hot pipe 140.

According to the disclosure, the shortage of refrigerant may be prevented by forcing the refrigerant to detour around the hot pipe 140 and be directly delivered to the evaporator 170 in a situation where there is no need to put the refrigerant into the hot pipe 140.

Referring to FIG. 20, when the refrigerator 1 operates in the freezer mode, the controller 60 may control the 5-way valve device 200 to close both the first port 283 and the second port 285 in the third mode.

Furthermore, when the refrigerator 1 operates in the freezer mode, the controller 60 may control the 5-way valve device 200 to close the first output port 284 in the third mode.

Furthermore, when the refrigerator 1 operates in the freezer mode, the controller 60 may control the 5-way valve device 200 to connect the input port 223 to the second output port 286 in the third mode.

In the freezer-third mode, the refrigerant discharged from the condenser 120 and flowing into the input port 223 may flow into the second output port 286 through the open cavity 295, and the refrigerant flowing into the second output port 286 may be delivered into the second capillary tube 160 through the fourth pipe 202*d*.

In this case, the refrigerant delivered into the second capillary tube 160 may not pass through the hot pipe 140.

According to the disclosure, the shortage of refrigerant may be prevented by forcing the refrigerant to detour around the hot pipe 140 and be directly delivered to the evaporator 170 in a situation where there is no need to put the refrigerant into the hot pipe 140.

Figure 21:
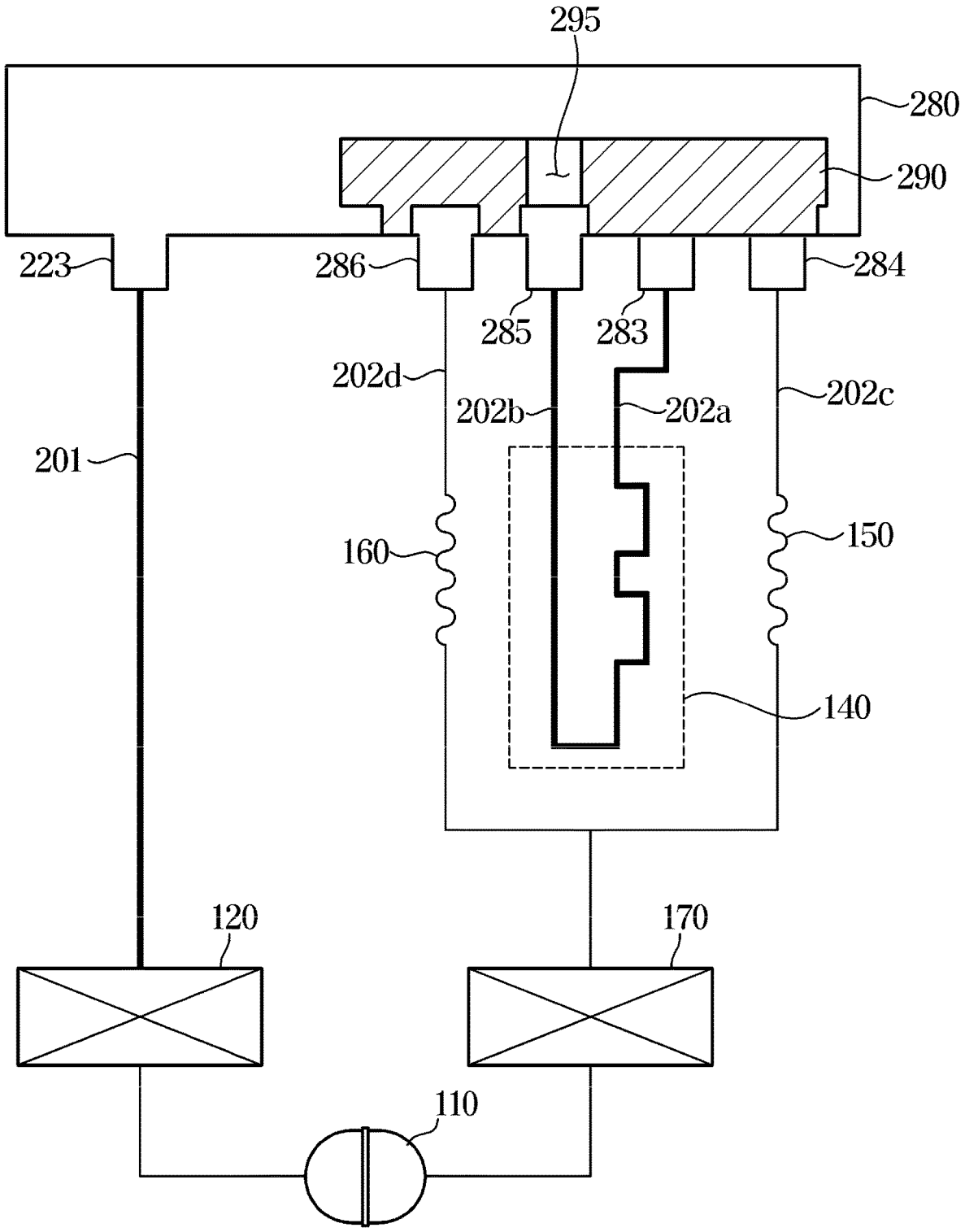
FIG. 21 illustrates flows of a refrigerant through a valve device operating in a fourth mode.

FIG. 21 illustrates flows of a refrigerant through a valve device operating in a fourth mode.

The controller 60 may switch the valve device 400 into the fourth mode based on the compressor 110 being off in 1000, in 1400.

Referring to FIG. 21, the controller 60 may control the valve device 400 to close the output ports 284 and 286 in the fourth mode.

In an embodiment, the controller 60 may control the 5-way valve device 200 to close the first output port 284 and the second output port 286 based on the compressor 110 being off.

In various embodiments, the controller 60 may open one of the first port 283 or the second port 285 based on the compressor 110 being off.

In the fourth mode, as one of the first port 283 or the second port 285 is opened and the other is closed, flow-in of the refrigerant to the valve device 400 and/or the hot pipe 140 may be stopped due to a difference in pressure between inside and outside of the hot pipe 140.

Accordingly, the fourth mode may be defined as a differential pressure mode.

As the compressor 110 is off, movement of the refrigerant disappears, but the refrigerant having been in the 5-way valve device 200 may flow into the hot pipe 140 through the open cavity 295.

According to the disclosure, when the compressor 110 is off, a problem of dew formation around the door 21, 22 or 31 may be prevented by leaving hot refrigerant in the hot pipe 140.

Flows of refrigerant in the cold air supplier 100A or 100B including the 5-way valve device 200 have thus far been described with reference to FIGS. 15 to 21.

Flows of refrigerant in the cold air supplier 100C including the 4-way valve device 410 and the 3-way valve device 420 will now be described with reference to FIGS. 22 to 28.

Figure 22:
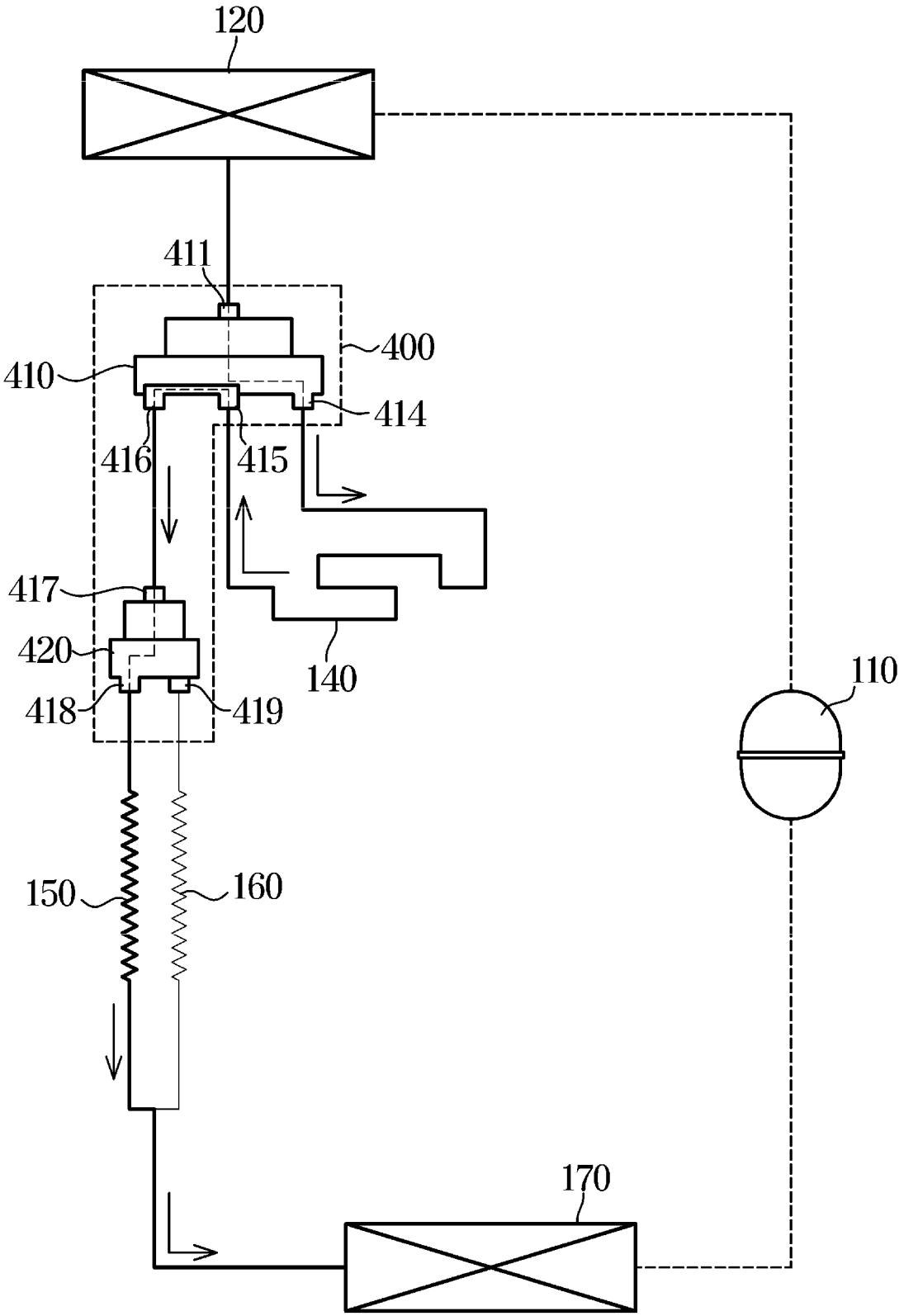
FIG. 22 illustrates flows of a refrigerant through a valve device operating in a first mode when a refrigerator operates in a fridge mode, according to an embodiment.
Figure 23:
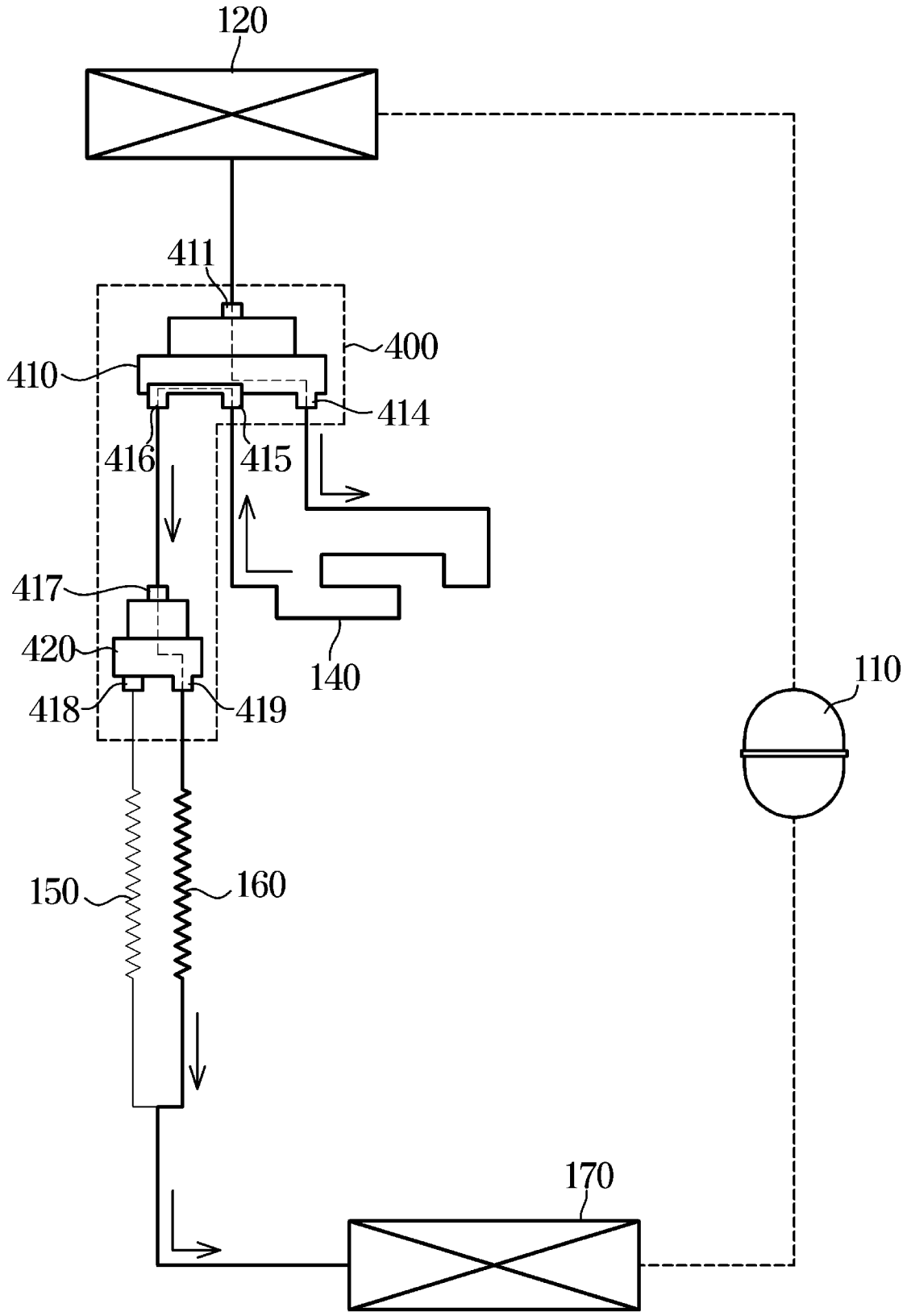
FIG. 23 illustrates flows of a refrigerant through a valve device operating in a first mode when a refrigerator operates in a freezer mode, according to an embodiment.

FIG. 22 illustrates flows of a refrigerant through a valve device operating in a first mode when a refrigerator operates in a fridge mode, according to an embodiment. FIG. 23 illustrates flows of a refrigerant through a valve device operating in a first mode when a refrigerator operates in a freezer mode, according to an embodiment.

When the valve device 400 operates in the first mode, the refrigerant discharged through the outlet of the condenser 120 may be supplied into the capillary tubes 150 and 160 via the hot pipe 140.

The controller 60 may control the valve device 400 such that one of the first port 414 and the second port 415 is connected to the input port 411 and the other is connected to the output port 418 or 419.

Accordingly, the first mode may be defined as a hot pipe-pass mode.

When the refrigerator 1 operates in the fridge mode and the valve device 400 operates in the first mode, the refrigerant discharged through the outlet of the condenser 120 may be supplied into the first capillary tube 150 via the hot pipe 140.

When the refrigerator 1 operates in the freezer mode and the valve device 400 operates in the first mode, the refrigerant discharged through the outlet of the condenser 120 may be supplied into the second capillary tube 160 via the hot pipe 140.

Hence, the first mode may be classified into two modes, e.g., fridge-first and freezer-first modes, according to the operation mode of the refrigerator 1.

Referring to FIG. 22, when the refrigerator 1 operates in the fridge mode, the controller 60 may control the 4-way valve device 410 such that the input port 411 is connected to the first port 414 and the second port 415 is connected to the other output port 416 in the first mode.

Furthermore, when the refrigerator 1 operates in the fridge mode, the controller 60 may control the 3-way valve device 420 to connect the input port 417 to the first output port 418 connected to the first capillary tube 150 in the first mode.

Furthermore, when the refrigerator 1 operates in the fridge mode, the controller 60 may control the 3-way valve device 420 to close the second output port 419 in the first mode.

Consequently, when the refrigerator 1 operates in the fridge mode, the controller 60 may control the valve device 400 such that the second port 415 is connected to the first output port 418 and the first port 414 is connected to the input port 411 in the first mode.

In the fridge-first mode, the refrigerant discharged from the condenser 120 and flowing into the input port 411 of the 4-way valve device 410 may flow into the first port 414, the refrigerant flowing into the first port 414 may pass through the hot pipe 140 and flow into the second port 415, the refrigerant flowing into the second port 415 may flow into the input port 417 of the 3-way valve device 420 through the other output port 416, and the refrigerant flowing into the input port 417 may be delivered into the first capillary tube 150 through the first output port 418.

Referring to FIG. 23, when the refrigerator 1 operates in the freezer mode, the controller 60 may control the 4-way valve device 410 such that the input port 411 is connected to the first port 414 and the second port 415 is connected to the other output port 416 in the first mode.

Furthermore, when the refrigerator 1 operates in the freezer mode, the controller 60 may control the 3-way valve device 420 to connect the input port 417 to the second output port 419 connected to the second capillary tube 160 in the first mode.

Furthermore, when the refrigerator 1 operates in the freezer mode, the controller 60 may control the 3-way valve device 420 to close the first output port 418 in the first mode.

Consequently, when the refrigerator 1 operates in the freezer mode, the controller 60 may control the valve device 400 such that the second port 415 is connected to the second output port 419 and the first port 414 is connected to the input port 411 in the first mode.

In the freezer-first mode, the refrigerant discharged from the condenser 120 and flowing into the input port 410 of the 4-way valve device 410 may flow into the first port 414, the refrigerant flowing into the first port 414 may pass through the hot pipe 140 and flow into the second port 415, the refrigerant flowing into the second port 415 may flow into the input port 417 of the 3-way valve device 420 through the other output port 416, and the refrigerant flowing into the input port 417 may be delivered into the second capillary tube 160 through the second output port 419.

In the disclosure, the refrigerator 1 may have the refrigerant having passed the hot pipe 140 supplied to the different capillary tube 150 or 160 depending on the operation mode of the refrigerator 1.

Figure 24:
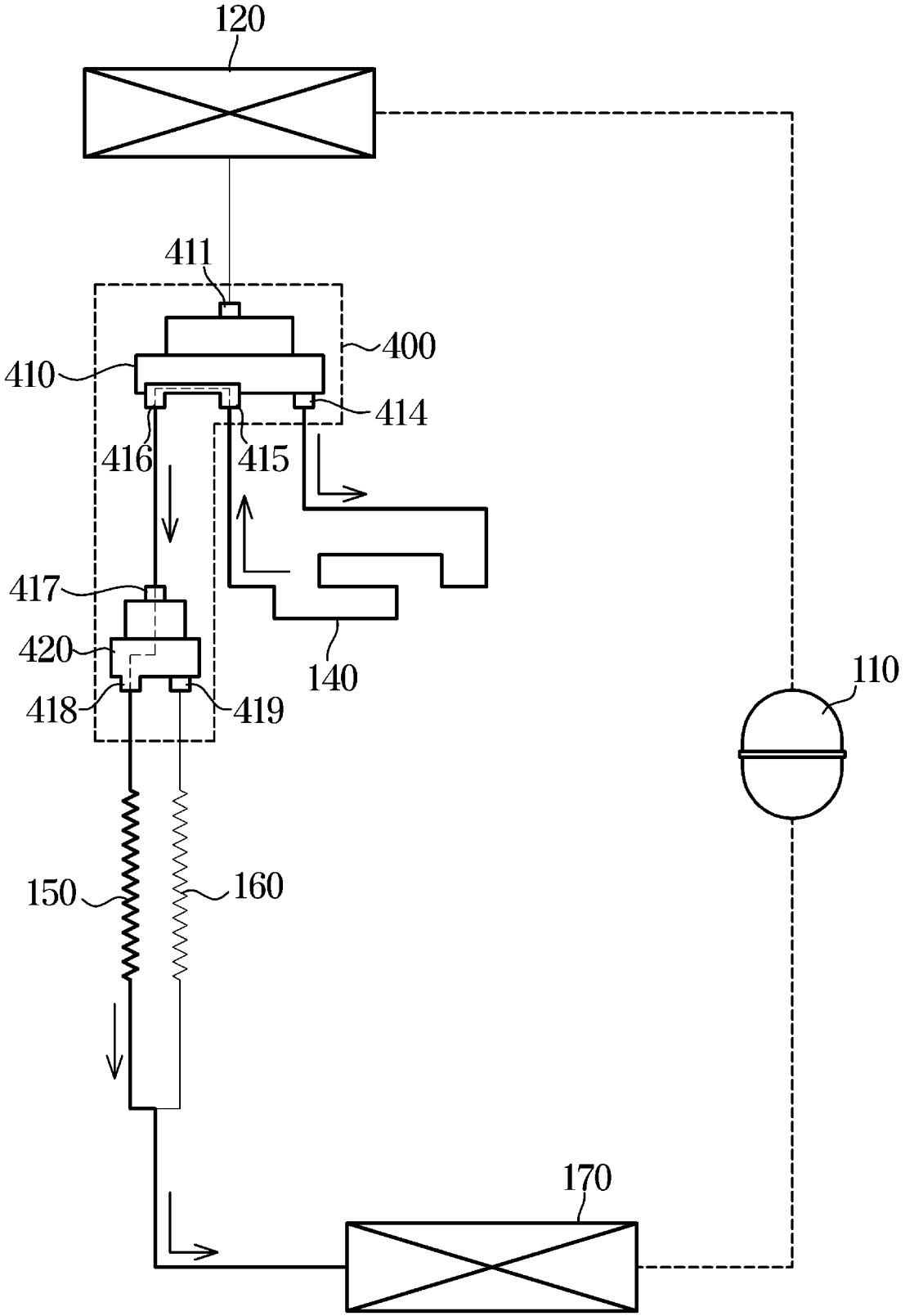
FIG. 24 illustrates flows of a refrigerant through a valve device operating in a second mode when a refrigerator operates in a fridge mode, according to an embodiment.
Figure 25:
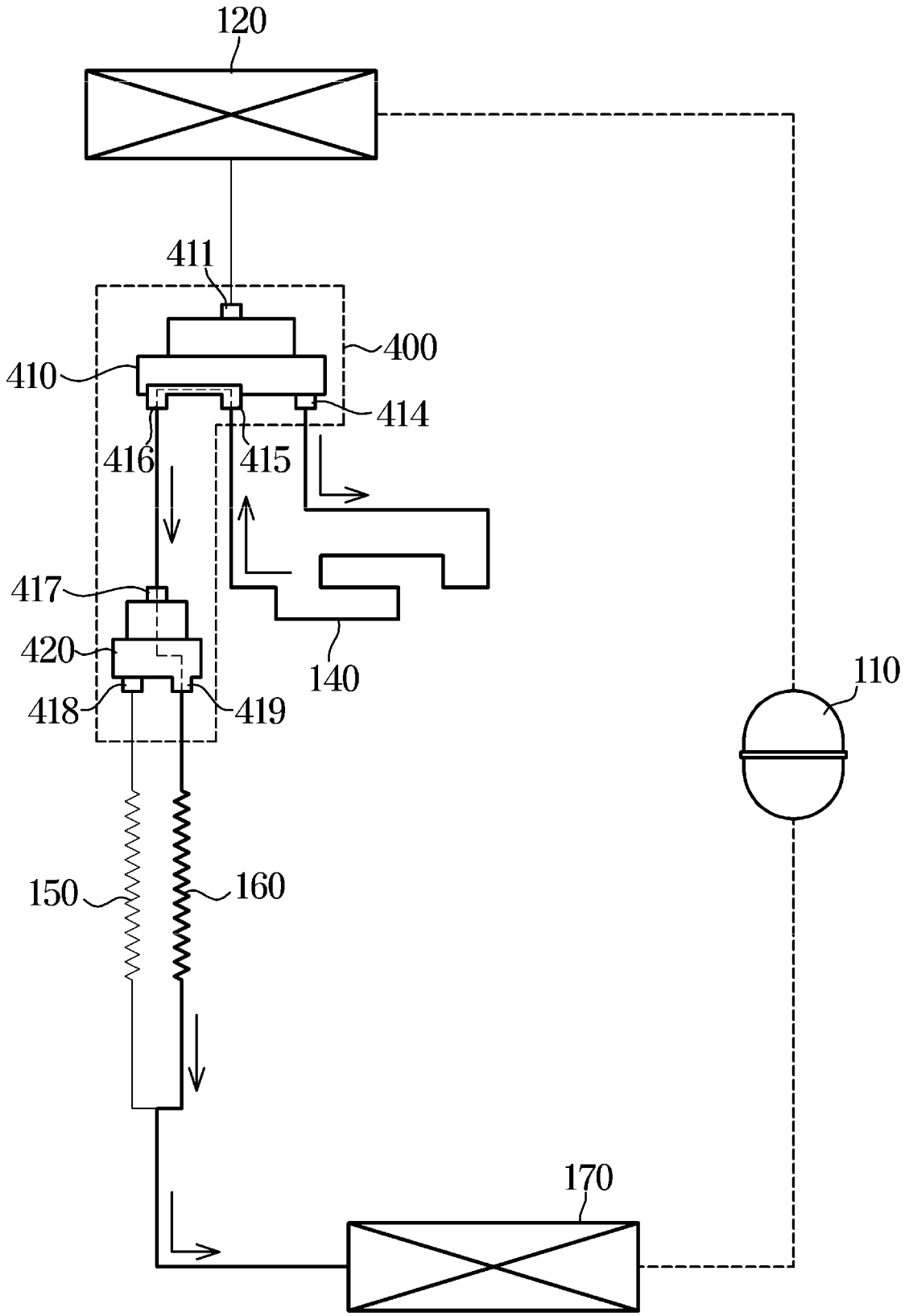
FIG. 25 illustrates flows of a refrigerant through a valve device operating in a second mode when a refrigerator operates in a freezer mode, according to an embodiment.

FIG. 24 illustrates flows of a refrigerant through a valve device operating in a second mode when a refrigerator operates in a fridge mode, according to an embodiment. FIG. 25 illustrates flows of a refrigerant through a valve device operating in a second mode when a refrigerator operates in a freezer mode, according to an embodiment.

When the valve device 400 operates in the second mode, the refrigerant left in the hot pipe 140 may be collected through the capillary tube 150 or 160.

The controller 60 may control the valve device 400 such that one of the first port 414 and the second port 415 is closed and the other is connected to the output port 418 or 419.

Accordingly, the second mode may be defined as a refrigerant collection mode.

In an embodiment, when the refrigerator 1 operates in the fridge mode and the valve device 400 operates in the second mode, the refrigerant left in the hot pipe 140 may be collected to the evaporator 170 through the first capillary tube 150.

In an embodiment, when the refrigerator 1 operates in the freezer mode and the valve device 400 operates in the second mode, the refrigerant left in the hot pipe 140 may be collected to the evaporator 170 through the second capillary tube 160.

Hence, the second mode may be classified into two modes, e.g., fridge-second and freezer-second modes, according to the operation mode of the refrigerator 1.

Referring to FIG. 24, when the refrigerator 1 operates in the fridge mode, the controller 60 may control the 4-way valve device 410 such that the first port 414 is closed and the second port 415 is connected to the other output port 416 in the second mode.

Furthermore, when the refrigerator 1 operates in the fridge mode, the controller 60 may control the 3-way valve device 420 to connect the input port 417 to the first output port 418 connected to the first capillary tube 150 in the second mode.

Furthermore, when the refrigerator 1 operates in the fridge mode, the controller 60 may control the 3-way valve device 420 to close the second output port 419 in the second mode.

Consequently, when the refrigerator 1 operates in the fridge mode, the controller 60 may control the valve device 400 such that the second port 415 is connected to the first output port 418 and the first port 414 is closed in the second mode.

As the compressor 110 operates, the refrigerant is moved in a direction from the evaporator 170 to the compressor 110.

In the fridge-second mode, as the first port 414 is closed, the refrigerant left in the hot pipe 140 may not move toward the first port 414. In the meantime, as the second port 415 is connected to the other output port 416, the refrigerant left in the hot pipe 140 is discharged toward the other output port 416.

As the refrigerant left in the hot pipe 140 is discharged toward the output port 416, the refrigerant may be collected to the first capillary tube 150 through the input port 417 and the output port 418 of the 3-way valve device 420.

According to the disclosure, the refrigerant may be collected while the refrigeration performance is maintained to a certain extent by collecting the refrigerant left in the hot pipe 140 to the evaporator 170 through the first capillary tube 150.

According to the disclosure, as the refrigerant left in the hot pipe 140 is collected to the evaporator 170, the shortage of refrigerant in the cold air supplier 100 may be prevented.

Furthermore, according to the disclosure, by securing a sufficient amount of refrigerant required for a cooling cycle through the second mode, frequency of the compressor 110 may be lowered, thereby saving energy.

Referring to FIG. 25, when the refrigerator 1 operates in the freezer mode, the controller 60 may control the 4-way valve device 410 such that the first port 414 is closed and the second port 415 is connected to the other output port 416 in the second mode.

Furthermore, when the refrigerator 1 operates in the freezer mode, the controller 60 may control the 3-way valve device 420 to connect the input port 417 to the second output port 419 connected to the second capillary tube 160 in the second mode.

Furthermore, when the refrigerator 1 operates in the freezer mode, the controller 60 may control the 3-way valve device 420 to close the first output port 418 in the second mode.

Consequently, when the refrigerator 1 operates in the freezer mode, the controller 60 may control the valve device 400 such that the second port 415 is connected to the second output port 419 and the first port 414 is closed in the second mode.

As the compressor 110 operates, the refrigerant is moved in a direction from the evaporator 170 to the compressor 110.

In the freezer-second mode, as the first port 414 is closed, the refrigerant left in the hot pipe 140 may not move toward the first port 414. In the meantime, as the second port 415 is connected to the other output port 416, the refrigerant left in the hot pipe 140 is discharged toward the other output port 416.

As the refrigerant left in the hot pipe 140 is discharged toward the output port 416, the refrigerant may be collected to the second capillary tube 160 through the input port 417 and the output port 419 of the 3-way valve device 420.

According to the disclosure, the refrigerant may be collected while the refrigeration performance is maintained to a certain extent by collecting the refrigerant left in the hot pipe 140 to the evaporator 170 through the second capillary tube 160.

According to the disclosure, as the refrigerant left in the hot pipe 140 is collected to the evaporator 170, the shortage of refrigerant in the cold air supplier 100 may be prevented.

Furthermore, according to the disclosure, by securing a sufficient amount of refrigerant required for a cooling cycle through the second mode, frequency of the compressor 110 may be lowered, thereby saving energy.

Figure 26:
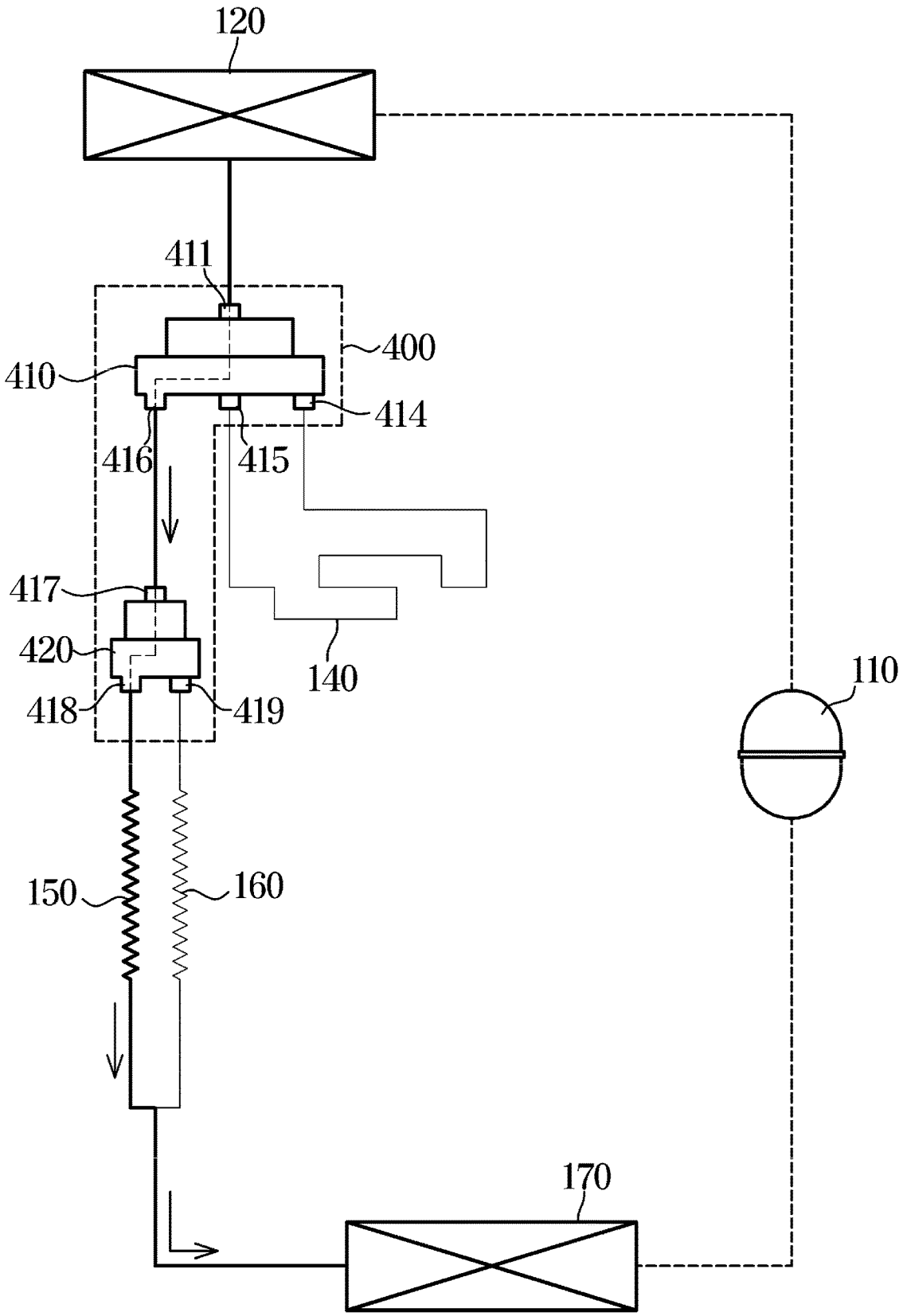
FIG. 26 illustrates flows of a refrigerant through a valve device operating in a third mode when a refrigerator operates in a fridge mode, according to an embodiment.
Figure 27:
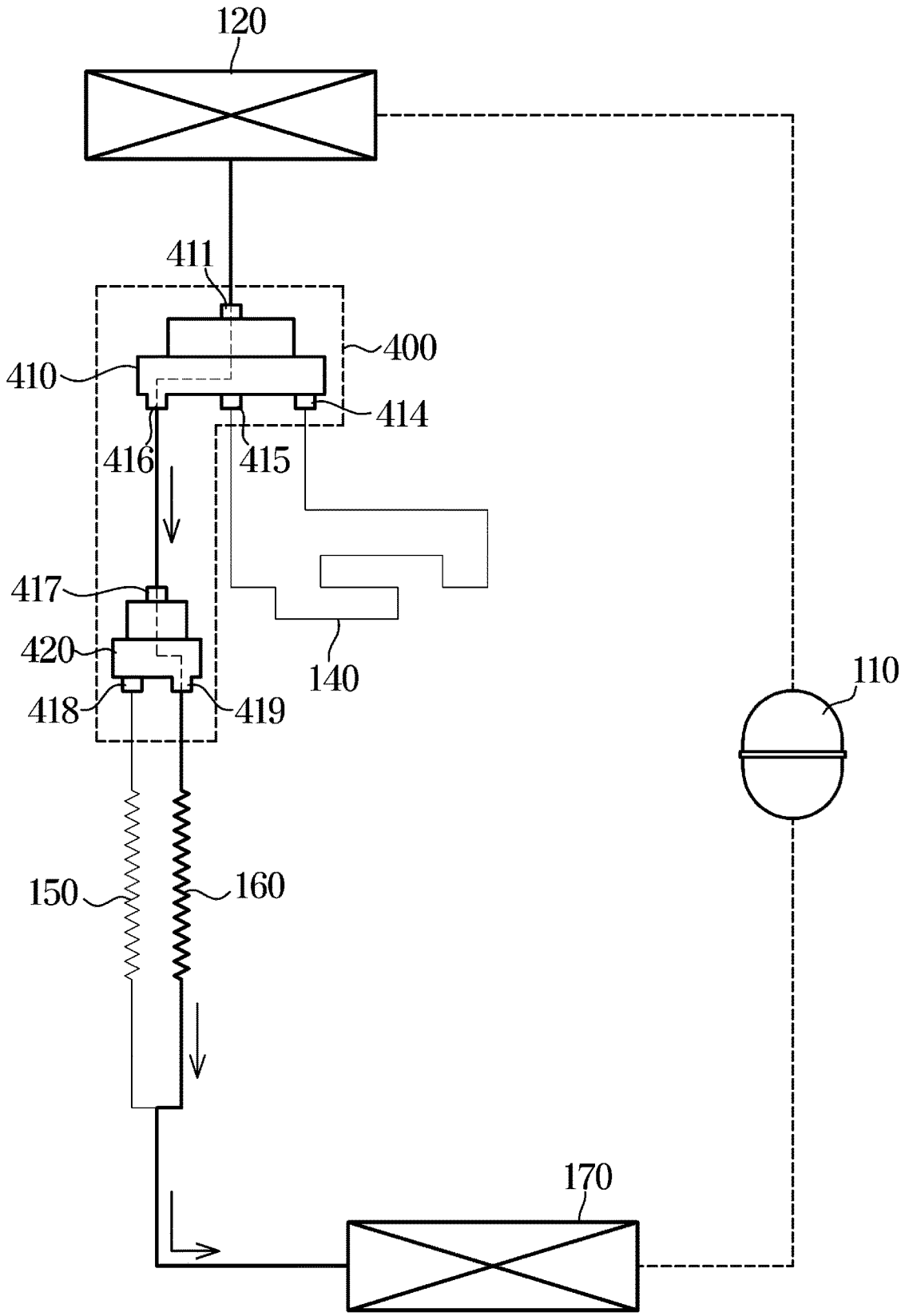
FIG. 27 illustrates flows of a refrigerant through a valve device operating in a third mode when a refrigerator operates in a freezer mode, according to an embodiment.

FIG. 26 illustrates flows of a refrigerant through a valve device operating in a third mode when a refrigerator operates in a fridge mode, according to an embodiment. FIG. 27 illustrates flows of a refrigerant through a valve device operating in a third mode when a refrigerator operates in a freezer mode, according to an embodiment.

When the valve device 400 operates in the third mode, the refrigerant discharged through the outlet of the condenser 120 may detour around the hot pipe 140 and be supplied into the capillary tubes 150 and 160.

The controller 60 may control the valve device 400 to close both the first port 414 and the second port 415 in the third mode. Furthermore, the controller 60 may control the valve device 400 to connect the input port 223 to the output port 284 or 286 in the third mode.

Accordingly, the third mode may be defined as a hot pipe-detour mode.

When the refrigerator 1 operates in the fridge mode and the valve device 400 operates in the third mode, the refrigerant discharged through the outlet of the condenser 120 may detour around the hot pipe 140 and be supplied into the first capillary tube 150.

When the refrigerator 1 operates in the freezer mode and the valve device 400 operates in the third mode, the refrigerant discharged through the outlet of the condenser 120 may detour around the hot pipe 140 and be supplied into the second capillary tube 160.

Hence, the third mode may be classified into two modes, e.g., fridge-third and freezer-third modes, according to the operation mode of the refrigerator 3.

Referring to FIG. 26, when the refrigerator 1 operates in the fridge mode, the controller 60 may control the 4-way valve device 410 such that the first port 414 and the second port 415 are all closed and the other output port 416 is connected to the input port 411 in the third mode.

Furthermore, when the refrigerator 1 operates in the fridge mode, the controller 60 may control the 3-way valve device 420 to connect the input port 417 to the first output port 418 connected to the first capillary tube 150 in the third mode.

Furthermore, when the refrigerator 1 operates in the fridge mode, the controller 60 may control the 3-way valve device 420 to close the second output port 419 in the third mode.

In the fridge-third mode, the refrigerant discharged from the condenser 120 and flowing into the input port 411 may flow into the output port 416, and the refrigerant flowing into the output port 416 may be delivered into the first capillary tube 150 through the 3-way valve device 420.

In this case, the refrigerant delivered into the first capillary tube 150 may not pass through the hot pipe 140.

According to the disclosure, the shortage of refrigerant may be prevented by forcing the refrigerant to detour around the hot pipe 140 and be directly delivered to the evaporator 170 in a situation where there is no need to put the refrigerant into the hot pipe 140.

Referring to FIG. 27, when the refrigerator 1 operates in the freezer mode, the controller 60 may control the 4-way valve device 410 such that the first port 414 and the second port 415 are all closed and the other output port 416 is connected to the input port 411 in the third mode.

Furthermore, when the refrigerator 1 operates in the freezer mode, the controller 60 may control the 3-way valve device 420 to connect the input port 417 to the second output port 419 connected to the second capillary tube 160 in the third mode.

Furthermore, when the refrigerator 1 operates in the freezer mode, the controller 60 may control the 3-way valve device 420 to close the first output port 418 in the third mode.

In the freezer-third mode, the refrigerant discharged from the condenser 120 and flowing into the input port 411 may flow into the output port 416, and the refrigerant flowing into the output port 416 may be delivered into the second capillary tube 160 through the 3-way valve device 420.

In this case, the refrigerant delivered into the second capillary tube 160 may not pass through the hot pipe 140.

According to the disclosure, the shortage of refrigerant may be prevented by forcing the refrigerant to detour around the hot pipe 140 and be directly delivered to the evaporator 170 in a situation where there is no need to put the refrigerant into the hot pipe 140.

Figure 28:
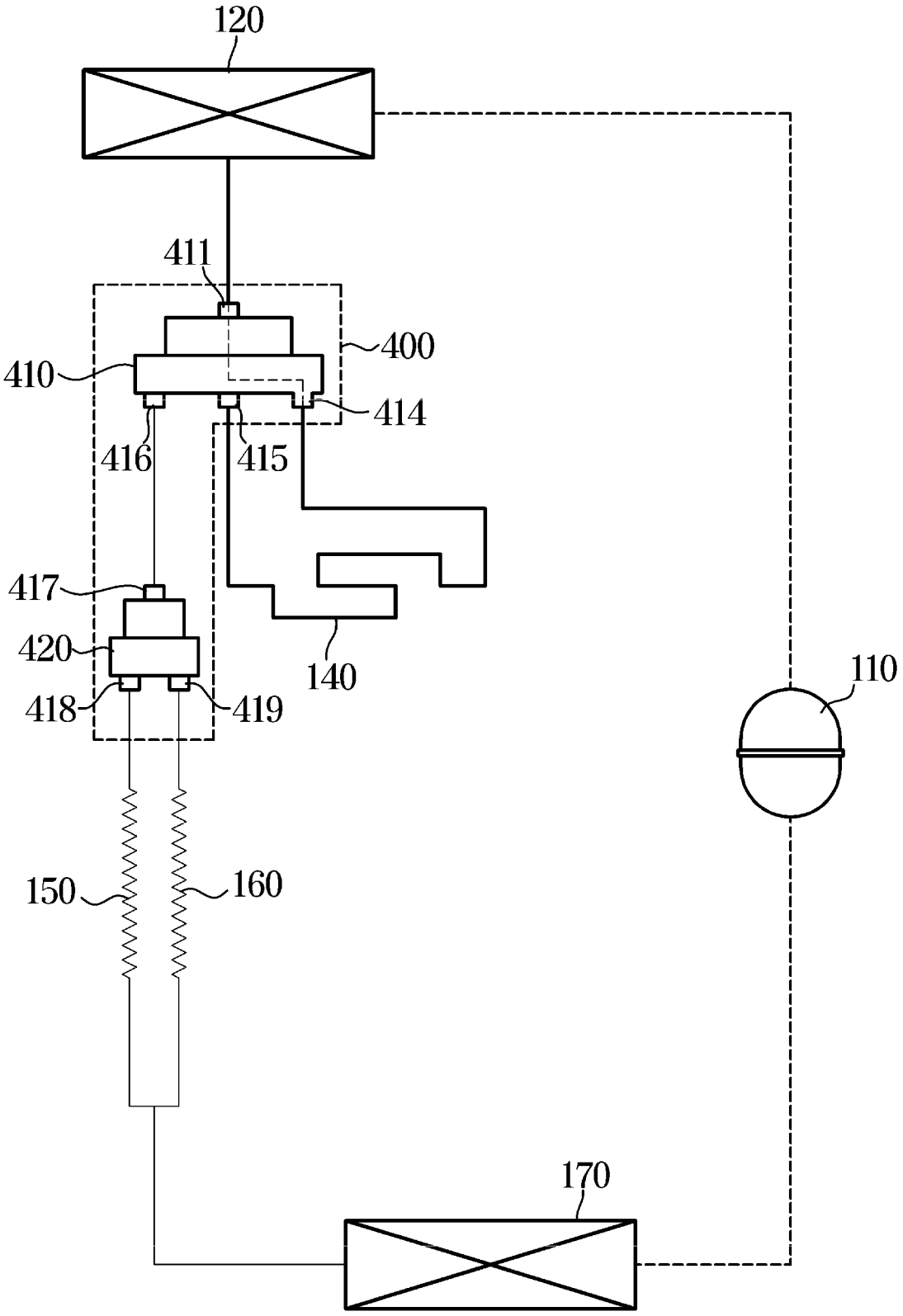
FIG. 28 illustrates flows of a refrigerant through a valve device operating in a fourth mode.

FIG. 28 illustrates flows of a refrigerant through a valve device operating in a fourth mode.

Referring to FIG. 28, the controller 60 may switch the valve device 400 into the fourth mode based on the compressor 110 being off.

The controller 60 may control the valve device 400 to close the output ports 418 and 419 in the fourth mode.

In an embodiment, the controller 60 may control the 3-way valve device 420 to close the first output port 418 and the second output port 419 based on the compressor 110 being off.

In various embodiments, the controller 60 may open one of the first port 414 or the second port 415 based on the compressor 110 being off.

In the fourth mode, as one of the first port 414 or the second port 415 is opened and the other is closed, flow-in of the refrigerant to the valve device 400 and/or the hot pipe 140 may be stopped due to a difference in pressure between inside and outside of the hot pipe 140.

Accordingly, the fourth mode may be defined as a differential pressure mode.

As the compressor 110 is off, movement of the refrigerant disappears, but the refrigerant having been in the 4-way valve device 410 may flow into the hot pipe 140 through the first port 414 or the second port 415.

According to the disclosure, when the compressor 110 is off, a problem of dew formation around the door 21, 22 or 31 may be prevented by leaving hot refrigerant in the hot pipe 140.

Flows of refrigerant in the cold air supplier 100C including the 3-way valve device 420 and the 4-way valve device 410 will now be described with reference to FIGS. 22 to 28.

According to the disclosure, a limited amount of refrigerant may be efficiently used by switching the valve device 400 into the first mode to third mode during operation of the compressor 110.

Especially, according to the disclosure, the first mode, the second mode and the third mode are divided into fridge-first mode and freezer-first mode, fridge-second mode and freezer-second mode, and fridge-third mode and freezer-third mode, respectively, thereby flexibly handling fridge operation and freezer operation of the refrigerator 1.

In an embodiment, based on the operation mode of the refrigerator 1 being switched to the freezer mode from the fridge mode while the valve device 400 is operating in the fridge-first mode, the controller 60 may switch the valve device 400 into the freezer-first mode. Furthermore, based on the operation mode of the refrigerator 1 being switched to the fridge mode from the freezer mode while the valve device 400 is operating in the freezer-first mode, the controller 60 may switch the valve device 400 into the fridge-first mode.

In an embodiment, based on the operation mode of the refrigerator 1 being switched to the freezer mode from the fridge mode while the valve device 400 is operating in the fridge-second mode, the controller 60 may switch the valve device 400 into the freezer-second mode. Furthermore, based on the operation mode of the refrigerator 1 being switched to the fridge mode from the freezer mode while the valve device 400 is operating in the freezer-second mode, the controller 60 may switch the valve device 400 into the fridge-second mode.

In an embodiment, based on the operation mode of the refrigerator 1 being switched to the freezer mode from the fridge mode while the valve device 400 is operating in the fridge-third mode, the controller 60 may switch the valve device 400 into the freezer-third mode. Furthermore, based on the operation mode of the refrigerator 1 being switched to the fridge mode from the freezer mode while the valve device 400 is operating in the freezer-third mode, the controller 60 may switch the valve device 400 into the fridge-third mode.

In various embodiments, the place of the second mode may come between the first mode and the third mode.

In an embodiment, the controller 60 may control the valve device 400 to sequentially operate in the first, second and third modes. Furthermore, the controller 60 may control the valve device 400 to sequentially operate in the second, third and first modes.

In other words, the controller 60 may control the valve device 400 to perform a cycle including the first mode, the second mode and the third mode at least once during operation of the compressor 110.

Operation of the cold air supplier 100 is not, however, limited thereto, and when an operation period of the first mode is set to be long, the controller 60 may control the valve device 400 to operate only in the first mode during operation of the compressor 110.

The controller 60 may switch the valve device 400 into a fourth mode based on the compressor 110 being off while the valve device 400 is operating in the first, second, or third mode.

After this, based on the compressor 110 being activated again, the controller 60 may switch the valve device 400 into one of the first to third modes.

For example, the controller 60 may operate the valve device 400 in the first mode based on the compressor 110 being started to operate. Hence, dew formation may be efficiently prevented by supplying the refrigerant to the hot pipe 140 as soon as the compressor 110 operates.

In another example, the controller 60 may operate the valve device 400 in the second mode based on the compressor 110 being started to operate. Hence, the shortage of refrigerant may be prevented by collecting the refrigerant left in the hot pipe 140 during operation of the compressor 110.

In various embodiments, the controller 60 may activate the compressor 110 according to a preset period or a preset condition to maintain the temperature of the storeroom 20 or 30.

The controller 60 may switch the valve device 400 into the first mode, the second mode and the third mode in sequence during operation of the compressor 110.

In the meantime, the controller 60 may determine duration of the first mode based on at least one of outside temperature or outside humidity.

In an embodiment, the controller 60 may determine duration of the first mode based on outside temperature.

For example, the controller 60 may set the duration of the first mode to be longer the higher the outside temperature. In another example, the controller 60 may set the duration of the first mode to be longer the larger the difference between the outside temperature and the inside temperature.

In an embodiment, the controller 60 may determine the duration of the first mode based on outside humidity.

For example, the controller 60 may set the duration of the first mode to be longer the higher the outside humidity. In another example, the controller 60 may set the duration of the first mode to be longer the larger the difference between the outside humidity and the inside humidity.

The duration of the second mode may be determined in advance based on various factors, such as the size of the evaporator 170 or the length of the hot pipe 140, and data about the duration of the second mode may be stored in the memory 62.

In an embodiment, the controller 60 may determine duration of the third mode based on inside temperature and set temperature. For example, the controller 60 may set the duration of the third mode to be longer the larger the difference between the inside temperature and the set temperature.

The first mode where the refrigerant circulates through the cold air supplier via the hot pipe 140 requires higher power of the compressor 110 than in the third mode where the refrigerant detours around the hot pipe 140 and circulates through the cold air supplier.

In various embodiments, the controller 60 may adjust the frequency of the compressor 110 to a first value when the valve device 400 operates in the first mode, and adjust the frequency of the compressor 110 to a second value smaller than the first value when the valve device 400 operates in the third mode. Hence, power consumption per hour of the compressor 110 when the valve device 400 operates in the third mode may be lower than that when the valve device 400 operates in the first mode.

According to the disclosure, power consumption may be reduced by adjusting the frequency of the compressor 110 down when the refrigerant detours around the hot pipe 140 and circulates through the cold air supplier 100.

In various embodiments, the controller 60 may adjust the frequency of the compressor 110 to a third value when the valve device 400 operates in the second mode. In this case, the third value may be set to an optimal value for refrigerant collection.

According to the disclosure, the shortage of refrigerant may be prevented by operating the valve device 400 in the refrigerant collection mode after the hot pipe-pass mode, thereby facilitating saving of the power consumption of the compressor 110.

A method of controlling the refrigerator 1 including the cold air supplier 100D will now be described according to an embodiment.

In an embodiment, the cold air supplier 100D may include the 4-way valve device 410.

The cold air supplier 100D may also include the single capillary tube 155 connected to the 4-way valve device 410.

Figure 29:
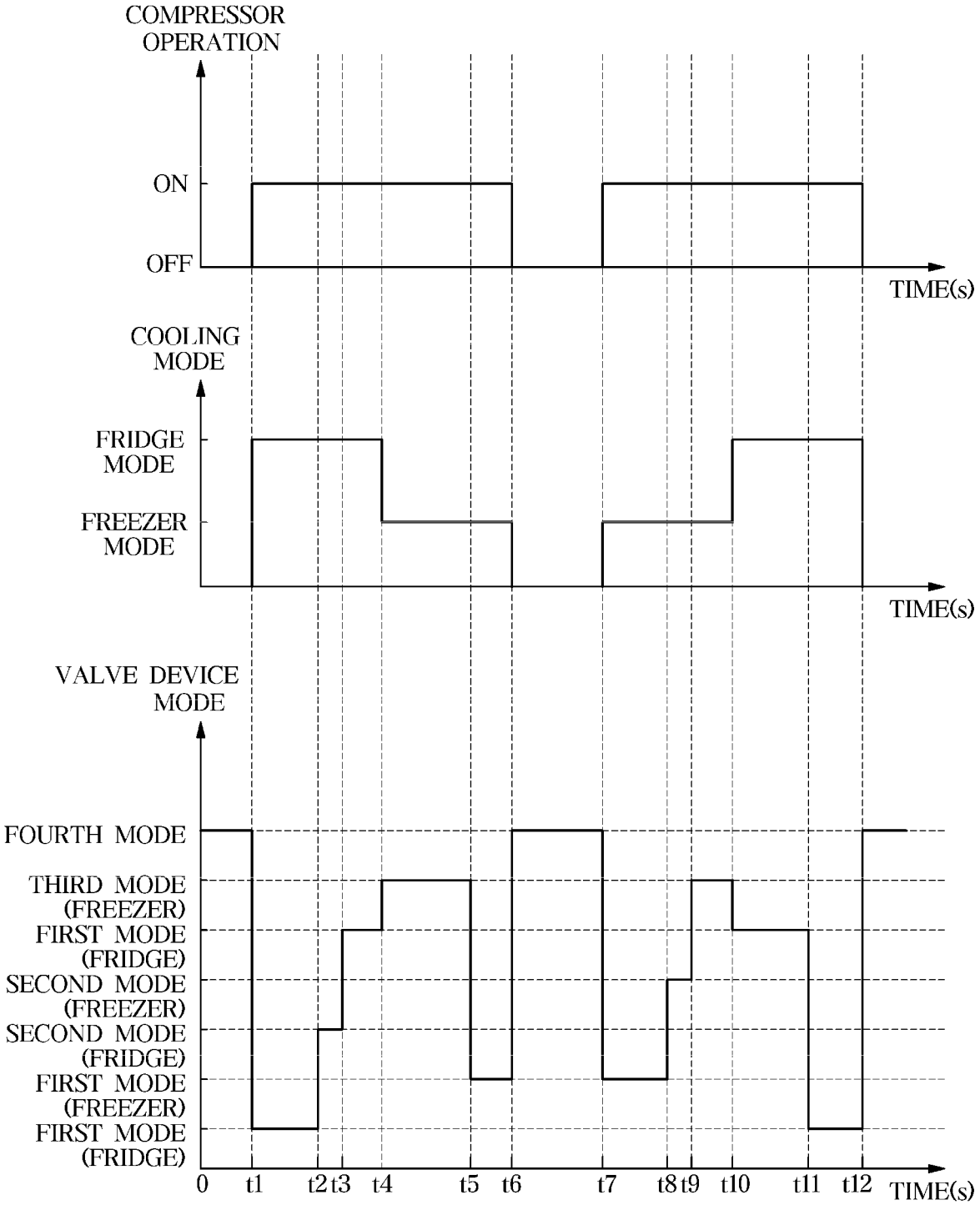
FIG. 29 illustrates an example of a method of controlling a refrigerator over time, according to an embodiment.

FIG. 29 illustrates an example of a method of controlling a refrigerator over time, according to an embodiment.

Referring to FIG. 29, the controller 60 may switch the valve device 400 into the fourth mode based on the compressor 110 being off (e.g., 0 to t1, t5 to t6 and t12~).

During operation (0 to t6 and t7 to t12) of the compressor 110, the controller 60 may operate the valve device 400 in a first mode, a second mode or a third mode.

In an embodiment, the controller 60 may switch the valve device 400 into the first mode from the fourth mode based on the compressor 110 being on (t1).

In the first mode, the controller 60 may operate the valve device 400 in the fridge-first mode when the refrigerator 1 operates in the fridge mode (t1 to t2 and t11 to t12).

In the meantime, in the first mode, the controller 60 may operate the valve device 400 in the freezer-first mode when the refrigerator 1 operates in the freezer mode (t5 to t6 and t7 to t8).

In an embodiment, the controller 60 may switch the valve device 400 into the second mode from the first mode based on termination of the first mode (t2 and t8).

In the second mode, the controller 60 may operate the valve device 400 in the fridge-second mode when the refrigerator 1 operates in the fridge mode (t2 to t3).

In the meantime, in the second mode, the controller 60 may operate the valve device 400 in the freezer-second mode when the refrigerator 1 operates in the freezer mode (t8 to t9).

In an embodiment, the controller 60 may switch the valve device 400 into the third mode from the second mode based on termination of the second mode (t3 and t9).

In the third mode, the controller 60 may operate the valve device 400 in the fridge-third mode when the refrigerator 1 operates in the fridge mode (t3 to t4 and t10 to t11).

In the meantime, in the third mode, the controller 60 may operate the valve device 400 in the freezer-third mode when the refrigerator 1 operates in the freezer mode (t4 to t5 and t9 to t10).

FIG. 29 illustrates mode switching behaviors of the valve device 400 for schematic description, but the mode switching behaviors of the valve device 400 are not limited thereto.

Although a period in which the valve device 400 operates in the first mode is shown in FIG. 29 as being shorter than a period in which the valve device 400 operates in the third mode, the period in which the valve device 400 operates in the third mode may be longer than the period in which the valve device 400 operates in the first mode depending on various conditions.

A period in which the valve device 400 operates in the second mode may be shorter than the period in which the valve device 400 operates in the first mode/third mode.

Furthermore, as described above, the controller 60 may switch the valve device 400 into the second mode from the fourth mode based on the compressor 110 being on (t1 and t7). In this case, the valve device 400 may be switched in the sequence of the second mode, the third mode, and the first mode.

Figure 30:
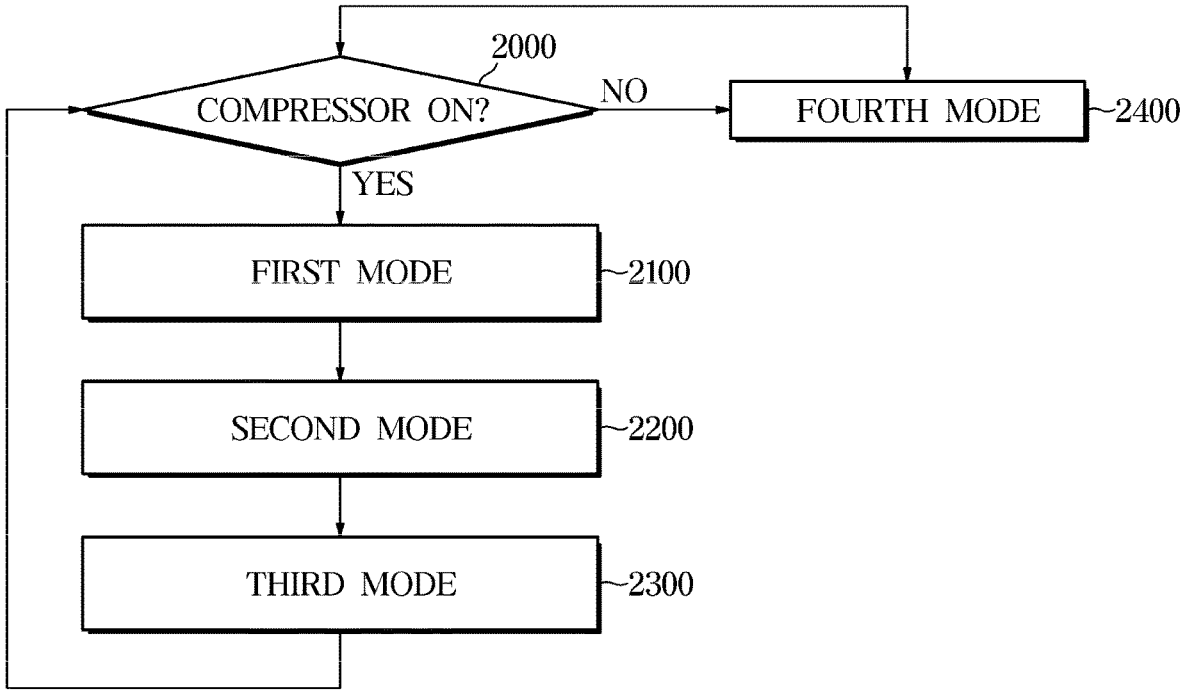
FIG. 30 is a flowchart illustrating an example of a method of controlling a refrigerator, according to an embodiment.

FIG. 30 is a flowchart illustrating an example of a method of controlling a refrigerator, according to an embodiment.

Referring to FIG. 30, the controller 60 may operate the compressor 110 based on an operation condition of the compressor 110 being satisfied.

In an embodiment, when the cold air supplier 100D includes one capillary tube, fridge operation and freezer operation may not be separated.

During operation of the compressor 110 in 2000, the controller 60 may operate the valve device 400 in a first mode, a second mode and a third mode in 2100, 2200 and 2300. The controller 60 may switch the valve device 400 into the fourth mode based on the compressor 110 being off in 1000, in 2400.

In this case, unlike the aforementioned embodiment, as the cold air supplier 100D includes the single capillary tube 155, each of the first, second and third modes may not be divided into two modes according to the operation mode of the refrigerator 1.

In other words, unlike in the flowchart as shown in FIG. 14, the first mode, the second mode and the third mode are not each divided according to the fridge or freezer operation in the flowchart shown in FIG. 30.

The description of the cold air supplier 100A, 100B and 100C may be applied to the cold air supplier 100D except that the first, second and third modes are not each divided according to the fridge or freezer operation.

Although it is shown that the controller 60 operates the valve device 400 in a sequence of the first mode, the second mode and the third mode, the controller 60 may operate the valve device 400 in a sequence of the first mode, the second mode and the third mode or the second mode, the third mode and the first mode based on the compressor 110 being started to operate.

For example, the controller 60 may operate the valve device 400 in the first mode based on the compressor 110 being started to operate.

Furthermore, the controller 60 may operate the valve device 400 in the second mode based on the compressor 110 being started to operate.

The controller 60 may switch the valve device 400 from the first mode to the second mode based on a termination condition of the first mode satisfied, switch the valve device 400 from the second mode to the third mode based on a termination condition of the second mode satisfied, and switch the valve device 400 from the third mode to the first mode based on a termination condition of the third mode satisfied, during operation of the compressor 110.

The controller 60 may switch the valve device 400 to a fourth mode based on the compressor 110 being off in 2000 while the valve device 400 is operating in the first, second, or third mode.

Figure 31:
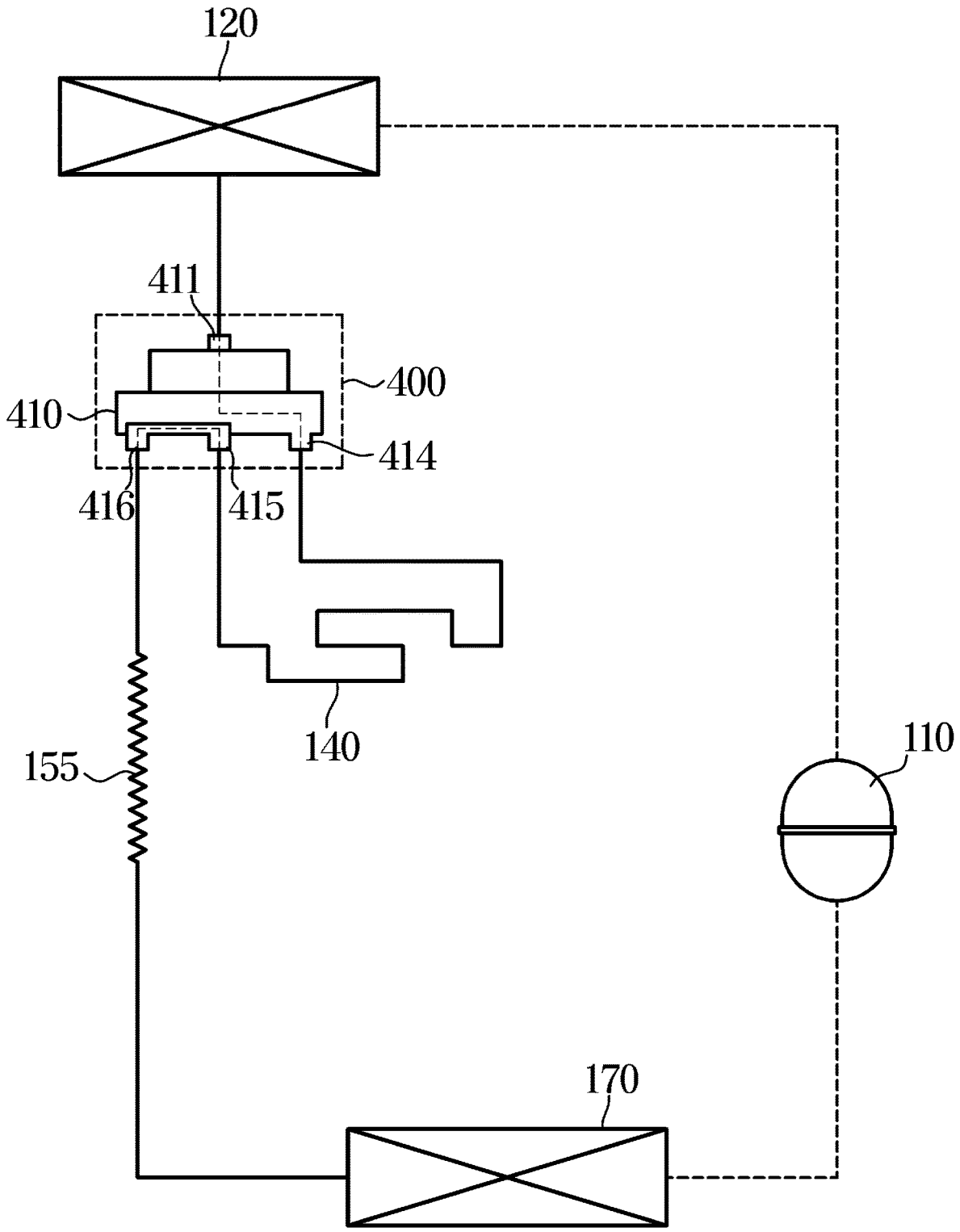
FIG. 31 illustrates flows of a refrigerant through a valve device operating in a first mode.

FIG. 31 illustrates flows of a refrigerant through a valve device operating in a first mode.

The controller 60 may operate the valve device 400 in the first mode during operation of the compressor 110, in 2100.

In an embodiment, the valve device 400 included in the cold air supplier 100D may include the input port 411 connected to the outlet of the condenser 120, the first port 414 connected to an end of the hot pipe 140, the second port 415 connected to the other end of the hot pipe 140, and the output port 416 connected to the capillary tube 155.

Referring to FIG. 31, the controller 60 may control the valve device 400 such that one of the first port 414 and the second port 415 is connected to the input port 411 and the other is connected to the output port 416 in the first mode.

Specifically, the controller 60 may control the 4-way valve device 410 such that the first port 414 is connected to the input port 411 and the second port 415 is connected to the output port 416 in the first mode.

When the valve device 400 operates in the first mode during operation of the compressor 110, the refrigerant flowing into the input port 411 may pass through the hot pipe 140 through the first port 414 and flow into the second port 415, and may be discharged from the second port 415 through the output port 416 and delivered into the capillary tube 155.

Figure 32:
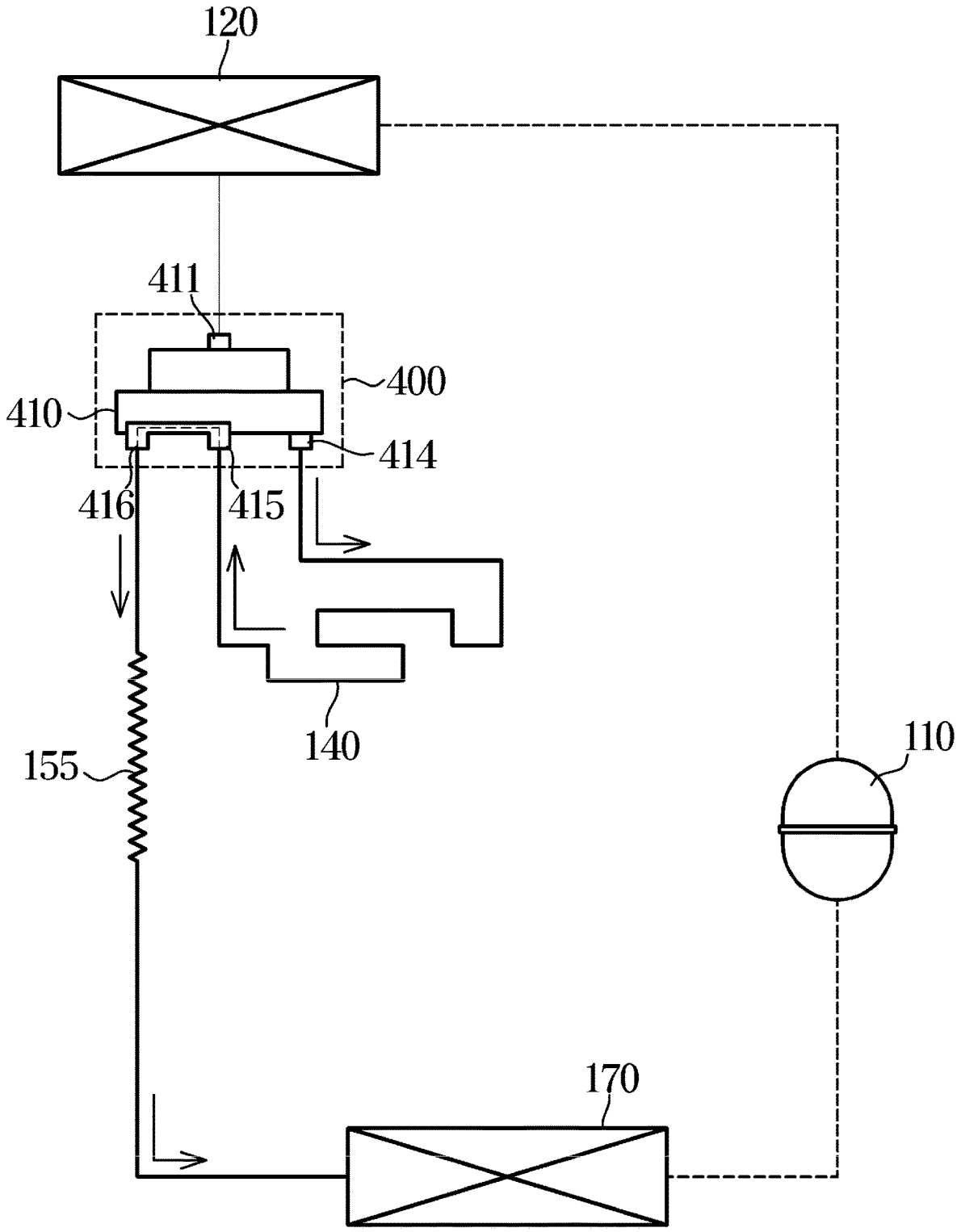
FIG. 32 illustrates flows of a refrigerant through a valve device operating in a second mode.

FIG. 32 illustrates flows of a refrigerant through a valve device operating in a second mode.

The controller 60 may operate the valve device 400 in the second mode during operation of the compressor 110, in 2200.

Referring to FIG. 32, the controller 60 may control the valve device 400 to close one 414 of the first port 414 and the second port 415 in the second mode.

Furthermore, the controller 60 may control the valve device 400 such that the other 415 of the first port 414 and the second port 415 is connected to the output port 416 in the second mode.

Specifically, the controller 60 may control the 4-way valve device 410 such that the first port 414 is closed and the second port is connected to the output port 416 in the second mode.

When the valve device 400 operates in the second mode during operation of the compressor 110, the refrigerant left in the hot pipe 140 may not flow toward the first port 414.

Accordingly, when the valve device 400 operates in the second mode, the refrigerant left in the hot pipe 140 may be moved toward the second port 415 and delivered to the capillary tube 155 through the output port 416.

According to the disclosure, the refrigerant left in the hot pipe 140 may be collected to the evaporator 170.

Figure 33:
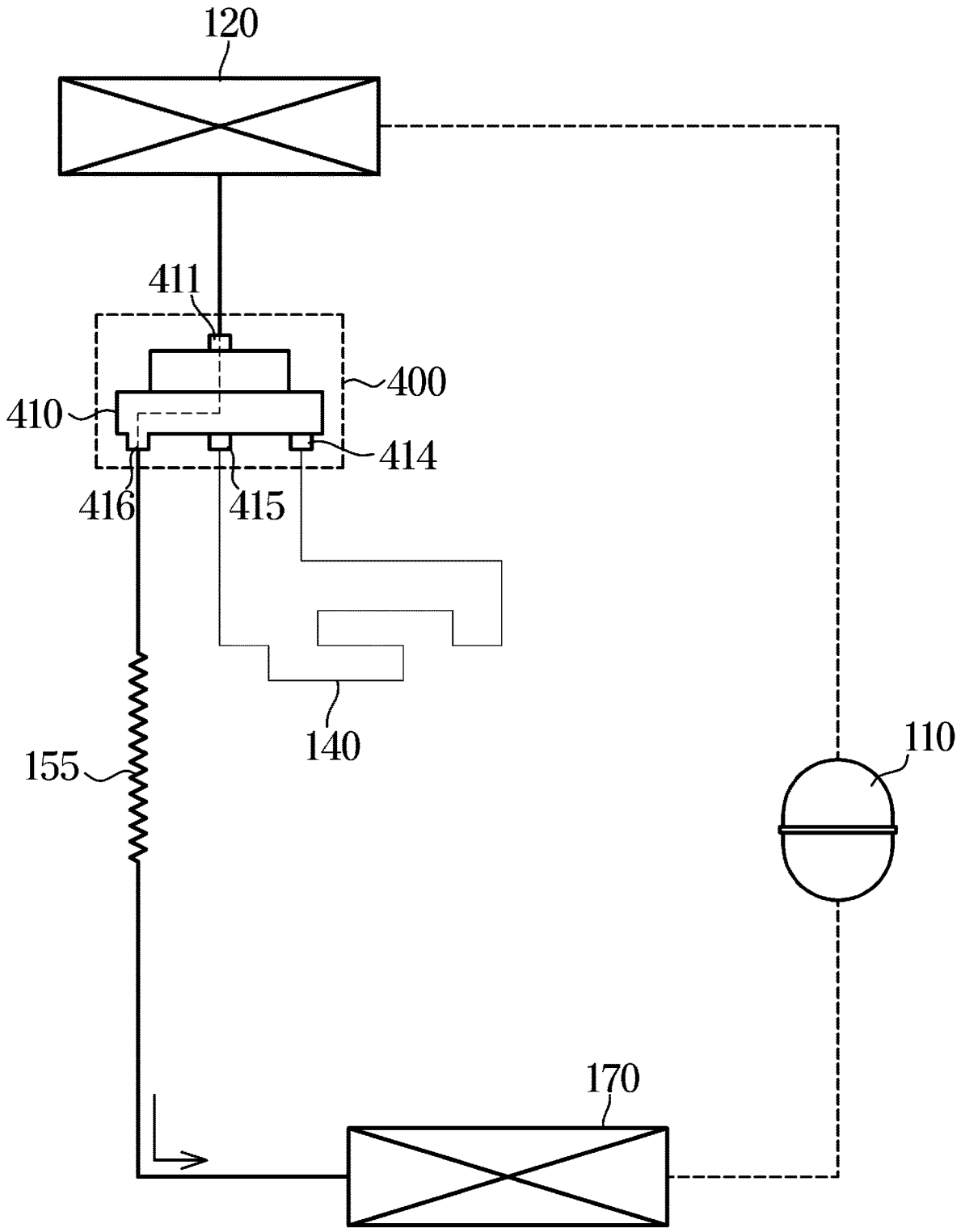
FIG. 33 illustrates flows of a refrigerant through a valve device operating in a third mode.

FIG. 33 illustrates flows of a refrigerant through a valve device operating in a third mode.

The controller 60 may operate the valve device 400 in the third mode during operation of the compressor 110, in 2300.

Referring to FIG. 33, the controller 60 may control the valve device 400 to close both the first port 414 and the second port 415 in the third mode.

Furthermore, the controller 60 may control the valve device 400 to connect the input port 411 to the output port 416 in the third mode.

Specifically, the controller 60 may control the 4-way valve device 410 such that the first port 414 and the second port 415 are closed and the input port 411 is connected to the output port 416 in the third mode.

When the valve device 400 operates in the third mode during operation of the compressor 110, the refrigerant discharged from the condenser 120 may detour around the hot pipe 140 and be supplied directly into the capillary tube 155.

Accordingly, when the valve device 400 operates in the third mode, the thermal load required by the hot pipe 140 may be reduced.

Figure 34:
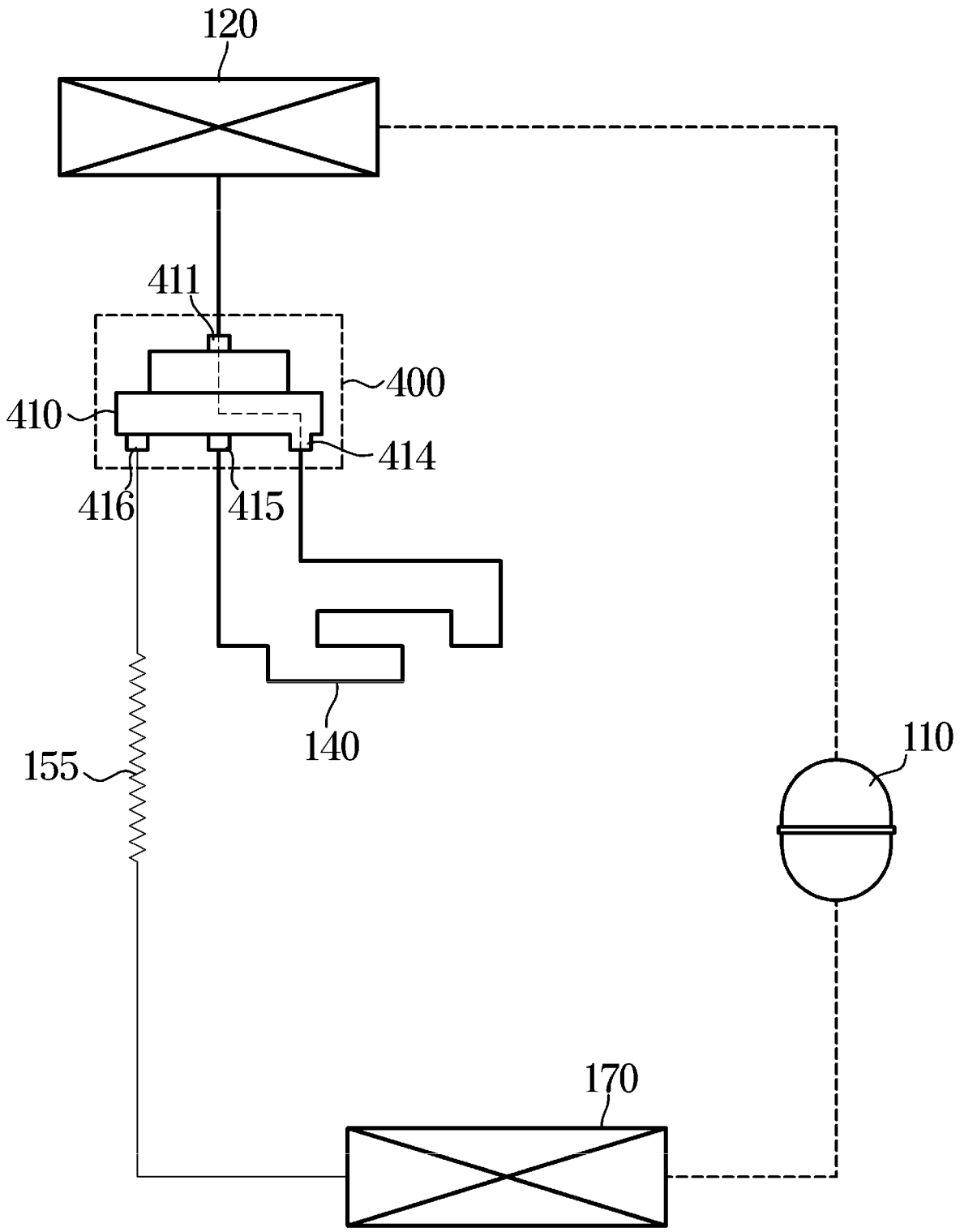
FIG. 34 illustrates flows of a refrigerant through a valve device operating in a fourth mode.

FIG. 34 illustrates flows of a refrigerant through a valve device operating in a fourth mode.

The controller 60 may operate the valve device 400 into the fourth mode based on the compressor 110 being off in 2000, in 2400.

Referring to FIG. 34, the controller 60 may control the valve device 400 to close the output port 416 in the fourth mode.

Furthermore, the controller 60 may control the valve device 400 such that one of the first port 414 and the second port 415 is closed and the other is opened in the fourth mode.

Specifically, the controller 60 may control the 4-way valve device 410 such that one of the first port 414 and the second port 415 is closed, the other is connected to the input port 411, and the output port 416 is closed in the fourth mode.

As the compressor 110 is off, movement of the refrigerant disappears, but the refrigerant having been in the 4-way valve device 410 may flow into the hot pipe 140 through the first port 414 or the second port 415.

According to the disclosure, when the compressor 110 is off, a problem of dew formation around the door 21, 22 or 31 may be prevented by leaving hot refrigerant in the hot pipe 140.

Figure 35:
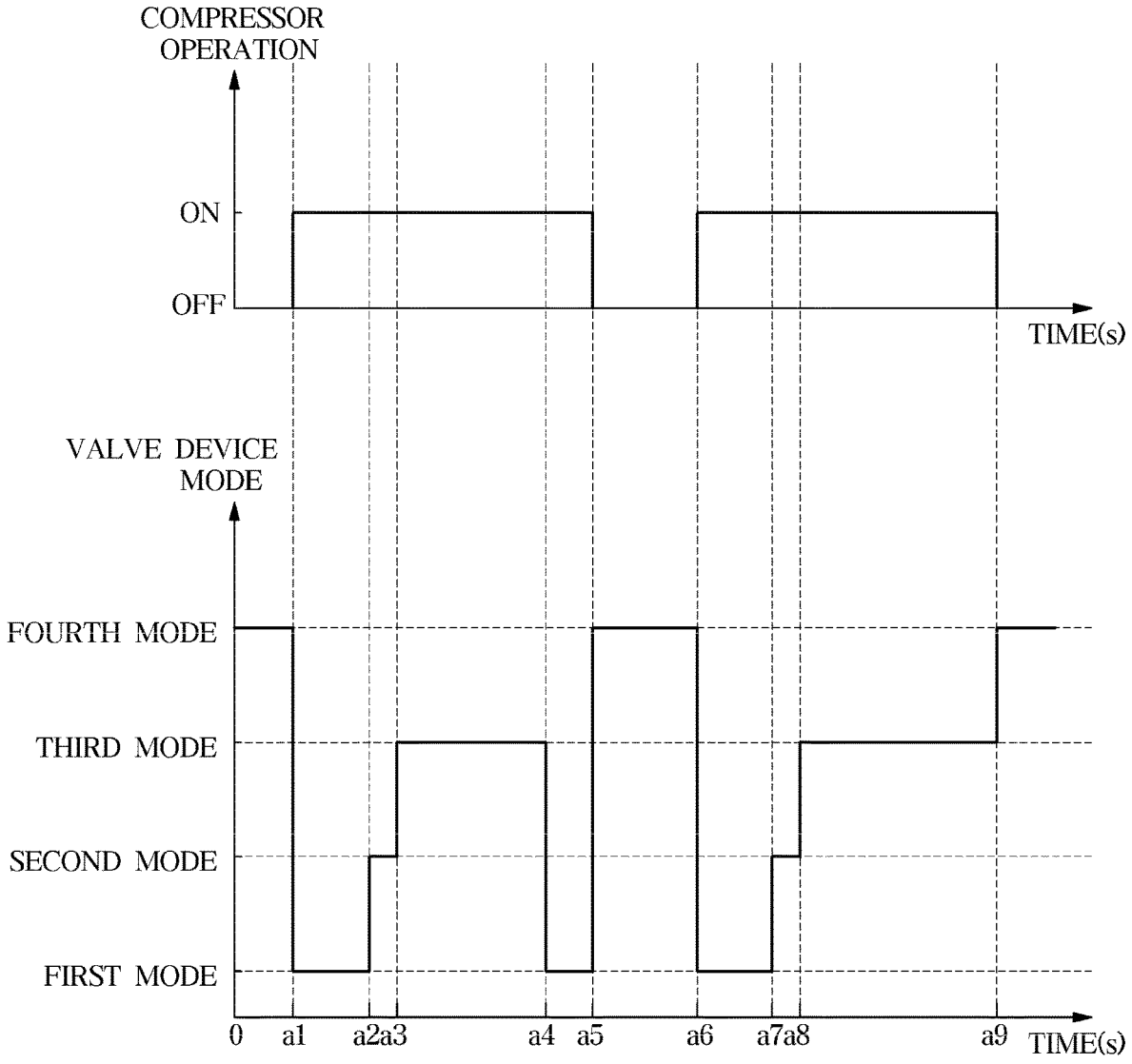
FIG. 35 illustrates an example of a method of controlling a refrigerator over time, according to an embodiment.

FIG. 35 illustrates an example of a method of controlling a refrigerator over time, according to an embodiment.

Referring to FIG. 35, the controller 60 may switch the valve device 400 into the fourth mode based on the compressor 110 being off (e.g., 0 to a1, a5 to a6 and a9~). The controller 60 may operate the valve device 400 in the first mode, the second mode or the third mode during operation of the compressor 110 (a1 to a5 and a6 to a9).

In an embodiment, the controller 60 may switch the valve device 400 into the first mode from the fourth mode based on the compressor 110 being on (a1).

In an embodiment, the controller 60 may switch the valve device 400 into the second mode from the first mode based on termination of the first mode (a2 and a7).

In an embodiment, the controller 60 may switch the valve device 400 into the third mode from the second mode based on termination of the second mode (a3 and a8).

In an embodiment, the controller 60 may switch the valve device 400 into the first mode from the third mode based on termination of the third mode (a4).

FIG. 35 illustrates mode switching behaviors of the valve device 400 for schematic description, but the mode switching behaviors of the valve device 400 are not limited thereto.

Although a period in which the valve device 400 operates in the first mode is shown in FIG. 35 as being shorter than a period in which the valve device 400 operates in the third mode, the period in which the valve device 400 operates in the third mode may be longer than the period in which the valve device 400 operates in the first mode depending on various conditions.

A period in which the valve device 400 operates in the second mode may be shorter than the period in which the valve device 400 operates in the first mode/third mode.

Furthermore, as described above, the controller 60 may switch the valve device 400 into the second mode from the fourth mode based on the compressor 110 being on (a1 and a6). In this case, the valve device 400 may be switched in the sequence of the second mode, the third mode, and the first mode.

The refrigerator including the cold air supplier 100 that may operate in the hot pipe-pass mode, the refrigerant collection mode, and the hot pipe-detour mode has thus far been described.

According to the disclosure, the shortage of refrigerant may be prevented by operating the cold air supplier 100 in the refrigerant collection mode before operation in the hot pipe-detour mode.

Meanwhile, the embodiments of the disclosure may be implemented in the form of a recording medium for storing instructions to be carried out by a computer. The instructions may be stored in the form of program codes, and when executed by a processor, may generate program modules to perform operations in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In an embodiment, the aforementioned method according to the various embodiments of the disclosure may be provided in a computer program product. The computer program product may be a commercial product that may be traded between a seller and a buyer. The computer program product may be distributed in the form of a recording medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a recording medium that may be readable to a device such as a server of the manufacturer, a server of the application store, or a relay server.

The embodiments of the disclosure have thus far been described with reference to accompanying drawings. It will be obvious to those of ordinary skill in the art that the disclosure may be practiced in other forms than the embodiments of the disclosure as described above without changing the technical idea or essential features of the disclosure. The above embodiments of the disclosure are only by way of example, and should not be construed in a limited sense.

What is claimed is:

1. A refrigerator comprising:

a compressor having an inlet and an outlet;

a condenser having an inlet and an outlet, the inlet of the condenser connected to the outlet of the compressor;

a hot pipe;

at least one capillary tube;

at least one evaporator connected to the at least one capillary tube and the inlet of the compressor;

a valve device including:

an input port connected to the outlet of the condenser;

a first port connected to one end of the hot pipe;

a second port connected to an other end of the hot pipe; and at least one output port connected to the at least one capillary tube; and a controller configured to:

control the valve device to operate in a first mode, a second mode, and a third mode during an operation of the compressor, control the valve device to operate in the first mode by connecting one of the first port and the second port to the input port and connecting an other one of the first port and the second port to the output port;

control the valve device to operate in the second mode, by closing one of the first port and the second port and connecting an other one of the first port and the second port to the output port; and control the valve device to operate in the third mode, by closing all the first port and the second port.

2. The refrigerator of claim 1, wherein the controller is configured to control the valve device to operate in an order of the first mode, the second mode, and the third mode or in an order of the second mode, the third mode, and the first mode.

3. The refrigerator of claim 1, wherein the controller is configured to determine a duration of the first mode based on at least one of outside temperature or outside humidity.

4. The refrigerator of claim 1, wherein the controller is configured to control the valve device to close the output port based on the compressor being turned off.

5. The refrigerator of claim 1, wherein the controller is configured to control the valve device to operate in the first mode or the second mode based on the compressor being started to operate.

6. The refrigerator of claim 1, wherein:

a refrigerant flowing into the input port passes through the hot pipe, and is discharged to the at least one evaporator in the first mode, a refrigerant left in the hot pipe is collected to the at least one evaporator in the second mode, and a refrigerant flowing into the input port bypasses the hot pipe, and is discharged to the at least one evaporator in the third mode.

7. The refrigerator of claim 1, wherein the controller is configured to control a frequency of the compressor to a first value based on the valve device being operating in the first mode and control the frequency of the compressor to a second value lower than the first value based on the valve device being operating in the third mode.

8. The refrigerator of claim 1, wherein the controller is configured to:

control the valve device to switch from the first mode to the second mode based on a termination condition of the first mode being satisfied;

control the valve device to switch from the second mode to the third mode based on a termination condition of the second mode being satisfied, and control the valve device to switch from the third mode to the first mode based on a termination condition of the third mode being satisfied, during the operation of the compressor.

9. The refrigerator of claim 1, wherein the controller is configured to control the valve device to operate in the second mode after an operation in the first mode and before an operation in the third mode.

10. The refrigerator of claim 1, wherein:

the at least one capillary tube comprises a first capillary tube and a second capillary tube;

the at least one output port comprises a first output port connected to the first capillary tube and a second output port connected to the second capillary tube; and the controller is configured to control the valve device such that the first port is connected to the first output port and the second port is connected to the input port in the first mode based on the refrigerator being operating in a fridge mode, and control the valve device such that the second port is connected to the second output port and the first port is connected to the input port in the first mode based on the refrigerator being operating in a freezer mode.

11. The refrigerator of claim 1, wherein:

the at least one capillary tube comprises a first capillary tube and a second capillary tube;

the at least one output port comprises a first output port connected to the first capillary tube and a second output port connected to the second capillary tube; and the controller is configured to:

control the valve device such that the first port is closed and the second port is connected to the second output port in the second mode based on the refrigerator being operating in a fridge mode, and control the valve device such that the second port is closed and the first port is connected to the first output port in the second mode based on the refrigerator being operating in a freezer mode.

12. The refrigerator of claim 11, wherein the controller is configured to control the valve device such that the input port is connected to the first output port in the second mode based on the refrigerator being operating in the fridge mode, and control the valve device such that the input port is connected to the second output port in the second mode based on the refrigerator being operating in the freezer mode.

13. The refrigerator of claim 1, wherein:

the at least one capillary tube comprises a first capillary tube and a second capillary tube;

the at least one output port comprises a first output port connected to the first capillary tube and a second output port connected to the second capillary tube; and the controller is configured to:

control the valve device such that the input port is connected to the first output port in the third mode based on the refrigerator being operating in a fridge mode; and control the valve device such that the input port is connected to the second output port in the third mode based on the refrigerator being operating in a freezer mode.

14. A method of controlling a refrigerator including a valve device including an input port connected to a condenser, a first port connected to one end of a hot pipe, a second port connected to an other end of the hot pipe, and at least one output port connected to at least one capillary tube, the method comprising:

controlling the valve device to operate in a first mode, a second mode and a third mode during an operation of a compressor;

controlling the valve device to operate in the first mode to connect one of the first port and the second port to the input port and connect an other one of the first port and the second port to the output port;

controlling the valve device to operate in the second mode to close one of the first port and the second port and connect an other one of the first port and the second port to the output port; and controlling the valve device to operate in the third mode to close all the first port and the second port.

15. The method of claim 14, wherein the controlling of the valve device to operate in the first mode, the second mode, and the third mode during an operation of the compressor comprises controlling the valve device to operate in an order of the first mode, the second mode and the third mode or in an order of the second mode, the third mode and the first mode.

* * * * *